US011219908B2

(12) United States Patent
Rayner

(10) Patent No.: US 11,219,908 B2
(45) Date of Patent: Jan. 11, 2022

(54) SYSTEMS AND METHODS FOR PRODUCING A FOAMABLE AND/OR FLOWABLE MATERIAL FOR CONSUMPTION

(71) Applicant: Gary Rayner, Henderson, NV (US)

(72) Inventor: Gary Rayner, Henderson, NV (US)

(73) Assignee: Gary Rayner, Henderson, NV (US)

( * ) Notice: Subject to any disclaimer, the term of this patent is extended or adjusted under 35 U.S.C. 154(b) by 0 days.

(21) Appl. No.: 16/851,581

(22) Filed: Apr. 17, 2020

(65) Prior Publication Data

US 2020/0238313 A1 Jul. 30, 2020

Related U.S. Application Data

(63) Continuation of application No. 15/744,747, filed as application No. PCT/US2016/042184 on Jul. 14, 2016, now Pat. No. 10,625,283.

(Continued)

(51) Int. Cl.
*B65D 83/14* (2006.01)
*B05B 9/04* (2006.01)

(Continued)

(52) U.S. Cl.
CPC ..... *B05B 7/04* (2013.01); *B05B 7/0483* (2013.01); *B65D 83/62* (2013.01); *B65D 83/64* (2013.01);

(Continued)

(58) Field of Classification Search
CPC B05B 7/04; B05B 7/0483; B05B 7/24; B05B 7/32; B65D 83/64; B65D 83/643;

(Continued)

(56) References Cited

U.S. PATENT DOCUMENTS 2,977,231 A 3/1961 Fox et al.
3,791,098 A * 2/1974 Webster ..... B65D 83/682 53/452

(Continued)

FOREIGN PATENT DOCUMENTS

CN 1756602 A 4/2006
CN 101128266 A 2/2008

(Continued)

OTHER PUBLICATIONS

Translation of JP2005-287319 Description, file attached and provided from Espace.net, an approved translation website, on Apr. 13, 2021. (Year: 2021).*

*Primary Examiner* — Charles P. Cheyney
(74) *Attorney, Agent, or Firm* — Mintz, Levin, Cohn, Ferris, Glovsky and Popeo, P.C.

(57) ABSTRACT

The present disclosure describes devices, systems, and methods for the production and/or delivery of a foamable and/or flowable material for consumption, such as by direct application to a consumer, such as directly to the mouth of the consumer. A device and/or system for converting a material from a first, unfoamed state to a second, foamed state is provided, and a device and/or system for converting a material from a first, non or semi-flowable state to a second, flowable state is provided.

11 Claims, 15 Drawing Sheets

2 - Fluid Bladder with Shear Nozzle

Related U.S. Application Data

(60) Provisional application No. 62/192,991, filed on Jul. 15, 2015.

(51) Int. Cl.

| | |
|---|---|
| ***B05B 7/04*** | (2006.01) |
| ***B65D 83/62*** | (2006.01) |
| ***B65D 83/64*** | (2006.01) |
| ***B65D 83/66*** | (2006.01) |
| ***B65D 83/68*** | (2006.01) |

(52) U.S. Cl.
CPC ..... *B65D 83/643* (2013.01); *B65D 83/66* (2013.01); *B65D 83/68* (2013.01); *B65D 83/682* (2013.01)

(58) Field of Classification Search
CPC ..... B65D 83/66; B65D 83/68; B65D 83/682; B65D 83/62
USPC ..... 222/190, 402.1, 136, 144.5
See application file for complete search history.

(56) References Cited

U.S. PATENT DOCUMENTS

| | | | | |
|---|---|---|---|---|
| 4,090,646 | A * | 5/1978 | Dubiel | B65D 47/20 222/326 |
| 4,851,239 | A | 7/1989 | Amen et al. | |
| 5,098,291 | A | 3/1992 | Curtis et al. | |
| 5,297,962 | A | 3/1994 | O'Connor et al. | |
| 5,848,729 | A | 12/1998 | Thornton | |
| 6,230,943 | B1 * | 5/2001 | Miyamoto | B65D 83/62 222/1 |
| 6,464,108 | B2 * | 10/2002 | Corba | B65D 83/682 222/136 |
| 6,488,974 | B1 * | 12/2002 | Kuehner | A23C 9/1524 222/190 |
| 6,520,377 | B2 * | 2/2003 | Yquel | B65D 83/34 222/1 |
| 7,137,536 | B2 | 11/2006 | Walters et al. | |
| 7,357,158 | B2 * | 4/2008 | Yerby | B65D 83/38 141/100 |
| 7,594,594 | B2 | 9/2009 | Troost et al. | |
| 8,113,832 | B2 | 2/2012 | Snyder et al. | |
| 8,459,311 | B2 | 6/2013 | Green | |
| 8,746,503 | B2 * | 6/2014 | Lim | B65D 83/625 222/3 |
| 8,893,933 | B2 | 11/2014 | Ohshima | |
| 2009/0045219 | A1 | 2/2009 | Helf et al. | |
| 2010/0091478 | A1 * | 4/2010 | Miller | F21K 2/06 362/34 |
| 2010/0297327 | A1 * | 11/2010 | Stangle | A23L 27/36 426/564 |
| 2013/0043274 | A1 | 2/2013 | Contal | |
| 2014/0014687 | A1 * | 1/2014 | Cornwell | B65D 83/62 222/144.5 |
| 2014/0097201 | A1 | 4/2014 | Otto | |
| 2014/0107224 | A1 * | 4/2014 | Osman | B65D 83/20 514/723 |
| 2018/0272367 | A1 | 9/2018 | Rayner | |

FOREIGN PATENT DOCUMENTS

| | | | |
|---|---|---|---|
| CN | 102083347 | A | 6/2011 |
| CN | 102341184 | A | 2/2012 |
| CN | 102971221 | A | 3/2013 |
| DE | 102009055125 | A1 | 5/2011 |
| JP | H10-305879 | A | 11/1998 |
| JP | 2005-287318 | A | 10/2005 |
| JP | 2011-251710 | A | 12/2011 |
| WO | WO-99/44916 | A1 | 9/1999 |
| WO | WO-01/89956 | A2 | 11/2001 |

* cited by examiner

1 - Simple With Single Gas

1 - Simple With Single Gas

1 - Simple With Single Gas

1 - Simple With Single Gas

1 - Simple With Single Gas

1 - Simple With Single Gas

2 - Fluid Bladder with Shear Nozzle

2 - Fluid Bladder with Shear Nozzle

2 - Split Container: Single Beverage Fluid

3 - Gas Cartridge

4 - Add-on Foaming Cap

4 - Add-on Foaming Cap

5 - Split Container: Dual Beverage Fluids

5 - Split Container: Dual Beverage Fluids

SYSTEMS AND METHODS FOR PRODUCING A FOAMABLE AND/OR FLOWABLE MATERIAL FOR CONSUMPTION

REFERENCE TO PRIORITY DOCUMENT

This application is a continuation of U.S. application Ser. No. 15/744,747, filed on Jan. 12, 2018, and granted as U.S. Pat. No. 10,625,283, entitled SYSTEMS AND METHODS FOR PRODUCING A FOAMABLE AND/OR FLOWABLE MATERIAL FOR CONSUMPTION, which claims priority to International Application No. PCT/US2016/042184, filed on Jul. 14, 2016, which claims priority under 35 U.S.C. § 119(e) to U.S. Patent Application No. 62/192,991 filed Jul. 15, 2015, the entire contents of each of which is incorporated herein by reference.

FIELD OF THE DISCLOSURE

The following disclosure relates to the production and delivery of a foamable and/or flowable material for consumption as well as the methods for producing and the vessels for storing and/or dispensing the same.

BACKGROUND

Foamable materials are known in the art. For instance, whipped cream is known to be stored in a canister under pressure such that when shaken and released, the whipped cream is expulsed from the canister, such as when being applied to a food item, such as a dessert. The addition of this whipped cream to the food item is experienced by some as enhancing the flavor of the underlying food item to which it is applied, thereby making the overall consumption experience more pleasurable. As such, whipped cream has been employed in the art as a food additive and is not formulated for direct consumption, that is, whipped cream is not meant to be consumed by itself directly from the canister.

Although whipped cream can be prepared by hand and be stored in any suitable manner, such as in a flexible confectioner's decorating pastry bag, often times, such as when produced for convenient mass consumption, for instance, in a ready-to-use formulation, whipped cream may be stored under pressure in a rigid canister that is capable of maintaining its contents under such pressure. For example, prior to its placement in the dispensing container, the cream is whipped in such a manner that gas bubbles are mixed within a matrix of the cream so as to produce a colloid material that in some instances may be double or triple its volume prior to being whipped and/or dispensed. Typically, in order to form a material having such a colloid consistency, the material must be capable of forming a matrix wherein bubbles may be trapped as the material is whipped, such as prior to storage within or dispensing from the canister. Traditionally, therefore, in order to be considered a foamable material, the material was assumed to need to be comprised of fat, such as at least 30% fat, such as butterfat, having a network of fat droplets wherein bubbles may be captured so as to form the colloid, such as prior to dispensing.

Additionally, foamable materials, such as whipped cream, had to be stored under pressure in combination with a propellant, such as an aerosol, in a canister adapted for being able to maintain its contents under such pressures, and having a minimally configured release valve, such that in order to be dispensed the material within the canister must be inverted prior to operating the release valve. Accordingly, when properly used the canister would be inverted, the valve depressed, and the pressurized contents would then be released. Such minimally configured release valves are problematic because they allow for incorrect operation such that if operated without inversion the propellant is rapidly depleted rendering the contents inaccessible and unusable.

These propellants are stored under pressure in the canister and serve two functions. First it keeps the gas suspended within the colloidal cream formulation. Secondly, it served as a propellant forcing the whipped cream out of the canister when the release valve was triggered. Typically, there is a gas-tight seal between the canister and the release valve that assists in maintaining the stored whipped cream under pressure. However, with use and/or if the seal of the canister is compromised in any way, which often happens with use and/or time, the compressed gas may leave the cream formulation, and along with the propellant, e.g., nitrous oxide, will leak out or otherwise be released from the canister resulting in the foamed material becoming defoamed making it unpleasant and unsuitable for its intended use as a food additive, if it can be released from the container at all.

Propellants have also been used in conjunction with the delivery of non-foamable materials, so as to make them flowable. For instance, Cheese Whiz is a secondary food item that has been configured to be stored under pressure and delivered in a flowable manner as a topping for a secondary food item. For example, Cheese Whiz includes a cheese flavored material that is formulated in such a manner that in a suitably configured delivery canister, the cheese-like material may be delivered in a flowable form to a secondary food substrate such as a cracker, a vegetable, bread, and the like. In such an instance, the canister may include a cavity having two compartments. A first compartment containing the cheese material, and a second compartment containing a gas, where the two compartments are separated from one another by a moveable platform, so as to form a piston-like configuration. In this instance, the gas exerts a positive pressure on the platform such that when a delivery nozzle is tilted, a passageway is opened allowing the piston to move and push the cheese-like material out of the nozzle and on to the food substrate.

In most of these instances, the cream, cheese, and other such flowable and dispensable materials have been formulated for delivery of the food topping to a secondary food item, such as prior to consumption of that secondary food item by the consumer. Hence, the dispensing mechanisms presently known are adapted for delivery to a secondary food item, and not configured for direct delivery to the mouth of the user. There are, however, those who have tried to employ such existing dispensing mechanisms for delivery of the food topping directly to the mouth, but with less than satisfactory results. Particularly, there are, for instance, a multiplicity of resultant problems given the configuration and mechanics of the delivery mechanisms and their intended use.

For example, the attendant nozzles are not shaped nor angled for delivery to the mouth, the canister's themselves have not been ergonomically designed for such delivery, and functional operation has not be adapted to account for such usage. More particularly, users who insist on direct delivery of such secondary food toppings directly to their mouth, are required to hold the canister in an inverted position above the head so that the bottom of the container and its contents are above the nozzle; otherwise, the propellant will escape and/or delivery cannot be commenced. However, this requires the arm be raised and the neck to be tilted back and/or crimped prior to usage. Such bodily contortions are uncomfortable, cannot be engaged while mobile, such as when exercising, block one's field of vision, and are all around unpleasant. Further, in such instances, the canisters themselves become unwieldy, lack grip, and are hard to operate. Moreover, if the angle of operation is not appropriately aligned within the design dimensions of the canister, spluttering and/or resultant gas leakage can cause frustration, embarrassment, and/or lead to consequential physical damage.

These results, therefore, make such usage dangerous, socially unacceptable, and open to ridicule. Specifically, fast food consumption often takes place while driving. However, to consume such flowable materials of the prior art while driving requires a tilted head position that is difficult to achieve, if possible at all, and further requires one to take his or her eyes off the road, e.g., looking upwards and not forwards, and is generally incompatible with such usage. Additionally, the canister itself, as well as the user's hand, blocks the user's field of vision. Further, the operation of the existing dispensing mechanisms requires dexterous manipulations of the actuator that interferes with concentration required for driving, and in the inverted dispensing position, the canister can collide with the headliner and/or other structures of the vehicle making driving dangerous. Similar problems can be experienced while walking, running, cycling, or participating in other forms of exercise, as well as when watching TV and/or engaging in conversation. For instance, head tilting is often times incompatible with participating in sporting events, following high-paced action, such as on a TV screen, interrupts eye contact often required for effective communication, and is a distracting gesture that may adversely affect others such as by impeding their field of view in a manner that may be considered rude and/or socially unacceptable.

As seen above, whipped cream, cheese-whiz and other such flowable food topping mechanisms have focused on the application of the material to secondary food items. Presently, there are no systems that have been specifically developed and well adapted for direct delivery to the mouth of consumer of food products and beverages that have been precisely formulated for optimal taste and texture as an imbibable food substance. Accordingly, as foamed and flowable liquid, beverage, and other food materials are experienced by some to be pleasant to the taste, there is a need in the art for the storage, production, and delivery of a wider range of such materials, which can be formulated for direct delivery to and consumption by the mouth of the consumer. It has now been determined that a wide variety of directly consumable materials may be foamed by a wide variety of foaming agents, which are safe for consumption, without being overly limited by the fat content of the material to be foamed.

Additionally, it has been determined that a wide array of liquids, beverages, and other food materials may be prepared so as to be flowably contained within a specially designed container for automatic delivery to a user. There is a need, therefore, for an apparatus, system, and/or delivery method that allows all such foamable and/or flowable materials to be stored in greater density, such as in a prefoamed state, and delivered direct to the consumer, such as in a manner that ensures that the foamed composition is optimally foamed substantially at the same time as delivery. This will not only allow for a greater quantity of material to be stored in a given delivery apparatus, but also ensure that the right amount of foaming agent is mixed with the right amount of foamable material so as to evoke the optimal taste experience upon delivery and consequent consumption by the consumer. Further, there is a need for an apparatus, system, and/or delivery method that allows ingestible materials to be stored in a manner that will allow them to automatically be delivered directly to the consumer, such as in a manner that ensures that the flowable composition is optimally delivered. The devices, methods, and systems of this present disclosure aim at meeting one or more of these and other related needs, while maximizing the individual's choice and enjoyment in consumable products.

SUMMARY OF THE DISCLOSURE

The present disclosure, in its many aspects, describes devices, systems, and methods for the production and/or delivery of a foamable and/or flowable material for consumption, such as by direct application to a consumer, such as directly to the mouth of the consumer. Accordingly, in one aspect, a device and/or system for converting a material from a first, unfoamed state to a second, foamed state is provided. In another aspect, a device and/or system for converting a material from a first, non or semi-flowable state to a second, flowable state is provided. In some instances, the device and/or system may be configured for assisting delivery of a foamable and/or flowable material to a user. In another aspect, a method is provided wherein the method is directed to converting a foamable and/or flowable material from a first, non-foamed and/or semi- or non-flowable state, to a second foamed and/or flowable state, and/or for delivering the foamable and flowable material from within the container directly to the mouth of the user. In a further aspect, a foamed and/or flowable consumable product is provided, wherein the foamed and/or flowable material is derived from a material and/or produced by a process that was not heretofore known to be foamable and/or flowable in the manner presented herein. Accordingly, in additional aspects, novel devices and methods for producing them and/or using them to produce foamed and/or flowable materials, such as for consumption, are provided. Systems including such materials, devices, and methods are also provided.

For instance, in a first aspect, a device for foaming, flowing, and/or containing a foamed and/or flowable material is provided. In various instances, the device includes a container. Any suitable container may be used so long as it is capable of retaining a material, such as a consumable or otherwise ingestible material, which material may be retained under pressure, such as where the pressure is added to the material, or a container retaining the material, so as to convert it from one state into another, such as from a non-foamed to a foamed state, and/or from a non- or semi-flowable to a flowable state. The container can be any suitable shape and of any suitable size, such as circular, triangular, square, rectangular, round, spherical, cylindrical, cubical, tubular, and/or a mixture of the above, and the like. For example, in one particular instance, the container may have a body, such as an extended and/or tubular body having a proximal portion and a distal portion that are separated from one another by an elongated body portion, which extended and tubular body may enclose or otherwise bound one or more cavities, such as a cavity configured for containing the foamed and/or flowable or to be foamed and flowable material and/or one or more foaming and/or propelling agents.

Accordingly, in certain instances, the extended and/or tubular body is configured such that it at least partially bounds a cavity, such as a cavity that is adapted for retaining the material in one or more of its non-foamed and/or non-flowable to a foamed and/or flowable state. In such an instance, the cavity may also be bounded by one or more of a proximal and/or distal end portion. In particular, in some instances, the container is box-like and includes an elongated body formed from a plurality of opposed surfaces, such as opposed front and back surfaces, as well as left and right side surfaces, such as where the front and back surfaces are separated one from the other by the opposed side surfaces. Likewise, the box-like container may additionally include opposed top and bottom surfaces. Accordingly, in such an instance, the elongated body may include one or both of a top member and/or a bottom member, e.g., transverse to the opposed bounding surfaces, for closing a top and/or bottom portion of the elongated body, and thereby enclosing the cavity.

In various other instances, the extended body may include one or more walls that are configured in a tubular shape, such as where the extended body includes a single wall that is curved so as to bound a cavity, such as where the wall includes a plurality of surfaces, such as an interior surface facing the cavity, and an outer surface opposite the interior surface. In such an instance, the wall forms a bounding member for the cavity, and in various embodiments may include one or both of a top member and/or a bottom member, e.g., transverse to the bounding wall, for closing a top and/or bottom portion of the elongated body, and thereby enclosing the cavity. In some instances, the top and/or bottom members may be removable and/or replaceable. In various instances, the bounding surfaces and/or walls may include one or more angles or curves so as to give the extended body an angled or curved configuration, thereby increasing or decreasing the interior surface area so as to better modulate the foaming and/or flowing action of the container.

Regardless of the configuration, the extended body member may be configured for bounding a cavity, such as a cavity including one or more interior portions, e.g., lumens or compartments, wherein the interior surface of the extended body forms a bounding member for the lumen(s) and/or compartment(s), which lumen(s) or compartment(s) may be configured for retaining one or more of a material to be foamed, e.g., in a prefoamed state, a semi-foamed or foamed material, and/or a flowable material, e.g., in a pre-flowable, a semi-flowable or flowable state, a foaming agent, and/or a propellant. Accordingly, in various instances, a container is provided wherein the container includes a cavity having a foamable and/or flowable material retained therein, and the cavity may additionally include one or more of a foaming agent and/or a propellant and/or be connected to another cavity containing the same. In other instances, the cavity can be subdivided, e.g., by one or more partitions or dividers, into compartments or sub-compartments, such as where each sub-compartment has its own lumen. For instance, the container may have a cavity that is further divided into first, second, third, fourth, fifth, sixth, etc., lumens.

For example, in some embodiments, a container is provided wherein the container includes at least a cavity with at least a first lumen and a second lumen, such as where the first lumen is configured for retaining the foamable and/or flowable material, and the second lumen is configured for retaining a foaming agent and/or propellant, such as where the first and second lumen are separate from one another. In other embodiments, a third and/or fourth lumen may be provided, such as where the third and/or fourth lumen includes a propellant and/or a mixing chamber. In various instances, the one or more lumens may include one or more materials to be mixed and/or delivered when leaving the container, and may further include one or more of a foaming agent and a propellant.

Particularly, in various embodiments, the container includes a plurality of container portions, such as where the container includes a first container portion, such as for retaining the foamable material, and a second container portion, such as for retaining a foaming and/or propelling agent, where the first and second container portions are separated one from the other by one or more divider portions. In various of such instances, the first container portion may not be in communication with the second container portion, such as where the container includes an elastic member, such as a non-movable wall, a stretchable bladder, or a moveable and/or flexible diaphragm, that divides the lumen into two sections, for instance, a section containing the material to be expelled from the container, and a section containing a foaming agent and/or propellant, such as a gas. For example, the second container portion may include a wall, elastic member, or diaphragm that is substantially impermeable to the foaming agent and/or propellant, and thus may be under a positive pressure caused by the forces the gas, e.g., of the foaming and/or propelling agent exerts against the bladder and/or diaphragm.

In such an instance, when the container or a passageway there through is opened a volume of the contained material under pressure may escape through the opening. Correspondingly, as the gas expands against a bladder it causes the lumen containing the material to be compressed, or where a diaphragm is included, it causes the diaphragm to be retracted, thereby reducing the volume of the lumen and allowing the contents within the cavity to be expelled. However, in various other instances, the plurality of container portions may be in communication with one another, such as by permeable interfaces, walls, and/or one or more conduits. For instance, one or more passageways and/or valves may be provided in a bounding member of the container portions, such as a wall or divider, so as to allow communication between various of the different compartments and/or the materials stored therein. Additionally, in various embodiments, one or more conduits may be present whereby the plurality of compartments or the materials within the compartments are fed into an additional compartment, such as a mixing chamber, which may or may not be part of the container, wherein in the additional compartment the two or more materials are allowed to intermix, such as to form a foamed and/or flowable material therein.

For example, in one embodiment, a container is provided wherein the container includes at least a first compartment, having a lumen containing a material to be delivered, such as a foamable and/or flowable material, and a second compartment, having a lumen containing a foaming agent and/or propellant, such as where the first compartment is separated from the second compartment by a divider, wherein the divider includes a conduit or passageway that is configured for allowing and/or controlling the flow of the contents from one compartment into another compartment. In such an instance, the conduit can be an opening, such as an opening fitted with a valve, e.g., a controllable valve, whereby the opening connects the first and second compartments thereby allowing flow between the two, and the valve may further be configured for controlling the rate of that flow.

The valve may have an orifice of variable dimensions, from fully open to fully closed, and variations in between, which opening and closing may be controlled by an actuator. More particularly, the actuator may be configured to control the opening and closing of the orifice of a portion of the conduit and thereby control the flow through that passageway. For instance, controlling the flow of the foaming agent to the foamable material, such as from one compartment to the other, so as to convert the foamable material from a nonfoamed state to a foamed state and/or to expel the flowable material from the lumen of the container, and/or controlling the flow of the propelling agent to the flowable material, such as from one compartment to the other, so as to convert a non or semi-flowable material from a first state to a flowable state and/or to expel the flowable material from the lumen of the container. In other embodiments, the conduit may be a plurality of conduits, such as a first conduit that is interconnected with a first chamber, and a second conduit that is interconnected with a second chamber, wherein the two conduits may themselves be interconnected with a third chamber, which third chamber may be present within the container and/or a dispensing mechanism associated therewith, whereby the first and second conduits may feed into the third chamber, e.g., a mixing chamber, thereby allowing the contents of the first and second chambers to intermix, for instance, in the third chamber, such as prior to dispensing, such as through a third conduit or other passageway.

In certain of these instances, one or more of these chambers may be configured for receiving a removable storage chamber unit, such as a cartridge, for instance, a cartridge containing one or more of a foamable and/or flowable material and/or a foaming agent and/or propellant. For example, in various instances, the container may be configured to include an auxiliary chamber unit or cartridge having a foaming and/or propelling agent therein, and thus may be configured as a foaming and/or propelling member, such as where the foaming and/or propelling agent is a gas, such as nitrous oxide, nitrogen, oxygen, carbon dioxide, a noble gas, e.g., argon, butane, methane, and the like. Accordingly, once the foaming and/or propelling member is coupled with, e.g., inserted into the container, and a valve associated with one or more of the auxiliary chamber and the container is opened, the foaming agent, which may be configured as a propellant, may be released into the chamber containing the foamable material so as to intermix therewith and thereby convert the material from a non-foamed to a pre-foamed or foamed state and/or from a non or semi-flowable to a flowable state. Accordingly, in some instances, the container may include at least a first chamber for retaining a material to be foamed and/or flowably delivered, and may further include a separate compartment containing a foaming agent and/or propellant, where the separate compartment includes an actuator mechanism that is configured for releasing the foaming agent and/or propellant into the first chamber for effectuating foaming and/or release of the material within and/or from the container.

The material to be delivered may be any material, such as a flowable and/or a foamable, pre-foamed, and/or foamed material. In some instances, the material may be a material capable of being foamed, such as being converted from a first, non-foamed state, into a second foamed state, and in some instances, may further be converted into one or more additional foamed states. In other instances, the material may be a material capable of being flowed, such as being converted from a first, non or semi-flowable state, into a second flowable state. For instance, in various embodiments, the material may be an ingestible material, such as a drink or food item, condiment, topping, additive, and the like, that is configured to be controllably delivered to a user of the container, such as by the operation of an actuator, for instance, by use with one or more hands of the consumer. In various instances, the deliverable material may be a flowable material, such as a medicine, a medicament, and the like.

A suitable foaming agent may be any agent that is capable of converting the non-foamed material into a pre-foamed or foamed material or super-foamed material, such as when applied to or otherwise mixed with the non-foamed material. For example, a foaming agent may be a gas, liquid, solid, powder, suspension, and/or catalyst that when introduced to and/or mixed with the foamable material converts it from being substantially non-foamed into being pre-foamed or foamed and/or may convert it into a super foamed state, such as where the solution includes an increased number, density, or area of bubbles, and/or bubbles that last for a relatively longer time period within the matrix before popping or leaving the solution. A suitable propelling agent may be any one or more agents that is capable of causing the flow of a material, such as from within to outside of the container and/or a compartment thereof, and may be capable of converting a non or semi-flowable material into a flowable material, such as when applied to or otherwise mixed with the material. For example, a propellant may be any agent capable of being added to the material, e.g., the foamable and/or foamed material, and thereby facilitating the expulsion of the material from a lumen of the container. In certain instances, a plurality of agents may be employed that when mixed together form a propelling and/or foaming agent.

In various instances, a foaming and/or propelling member may be included, such as where the foaming and/or propelling member may be configured as a mechanical mechanism and/or may be a chemical catalyst, such as a gas, a liquid, a suspension, a pill, a powder, and/or the like, and may further be configured for causing the movement and/or foaming and/or delivery of the ingestible material to the consumer, such as in a controlled manner. For instance, the propelling member may be configured for effectuating the movement of a foaming and/or propelling agent so as to contact and/or be at least partially subsumed within the consumable material, and/or the propelling member may be configured for effectuating the movement of the foamed and/or flowable material out of one or more compartments of the container and/or out of the container itself. Particularly, the foaming and/or propelling member may be configured for effectuating the movement of a foaming and/or propelling agent into the chamber containing the ingestible material and/or into another container portion, e.g., a mixing chamber, into which the foaming and/or flowable material may be added, such as in combination with the foaming and/or propelling agent. In more particular instances, the propelling member may be an additional material added to one or more of the chambers, such as in addition to one or more of the foaming and/or flowable material and/or foaming agent and/or propellant. For example, the foaming and/or propelling member may be any agent that is capable of creating one or more pressure and/or temperature gradients within and/or between one or more chambers or cavities of the container, which pressure gradient(s) can be employed in a manner sufficient to foam the foamable material and/or eject the foamable and/or flowable material out of the container, such as when the dispensing member, e.g., actuator, is actuated.

Hence, in various embodiments, the one or more chambers of the container, e.g., the two or three chambers, along with the one or more control valves controlling communication between the chambers, may be configured for allowing and/or regulating the extent and/or rate of intermixing of the foamable and/or flowable material with the foaming agent and/or propelling agent, such as within a mixing region of the container, so as to ensure the production of a flowable and consumable end product having the optimal proportion of foamable and/or flowable material to foaming agent/propellant such that the resulting foamed and/or flowable material has the desired amount of foaminess and/or flowability. This intermixing may be performed prior to insertion of the foamed and/or flowable material into the container, after insertion within the container, such as within a single, e.g., main, chamber within the container, and/or within an auxiliary chamber, such as a mixing chamber, within or associated with the container, external to the container, and/or within a dispensing member of the container. As indicated above, where the foaming and/or flowing process takes place within the container, the foamable and/or flowable material may be within the same chamber or may be separated, such as by a partition, from the foaming agent and/or propellant, but in such a manner that the materials are capable of being intermixed, such as in a controlled fashion, upon an activation event, so as to produce the foamed and/or flowable material, and/or are capable of being expulsed out of the container.

Accordingly, a conduit may be provided for allowing one or more of the materials within the container to be transported there through. Hence, in various instances, the conduit may include a control mechanism, such as a control valve, for regulating flow through the conduit, and thus, the conduit may be a control release conduit. Particularly, in various instances, a controlled release conduit may be included in one or more bounding members or partitions of the container so as to regulate the rate and extent of flow and/or intermixing of the various materials within the container. In such instances, the controlled release conduit and the container itself may be configured in such a manner so as to accommodate the physical characteristics of the foaming and/or propelling agent being employed as well as to accommodate the foaming and/or propelling action. In various instances, dependent on the identity of the foaming and/or propelling agent and/or the configuration of the container and its portions, the conduit, such as a controlled release conduit, may have any configuration suitable to creating a pressure and/or temperature differential between the inside of the container and the outside of the container and/or between various different chambers within or otherwise associated with the container, such as between the chamber containing the foamable and/or flowable material and the chamber(s) containing the foaming and/or propelling agent(s).

For instance, in various embodiments, a controlled release conduit may be included where the controlled release conduit may have a mechanical configuration so as to operate mechanically. For example, the controlled release conduit may be configured as and/or otherwise be associated with a slow or quick release valve, a hand or screw pump, a screw and plate, a spring release plate, an elastic member, a diaphragm, a tear-able or puncture-able membrane, a lever, one or more of the same including a motor, a compressor, a pyrotechnic composition, piezo-electric component, or other mechanical and/or electrical element capable of increasing the pressure in at least one conduit or chamber, such as by exerting a force against the contents of that chamber, and the like. In such an instance, in certain embodiments, the foaming and/or propelling mechanism and controlled release conduit may be one in the same.

In various other embodiments, the controlled release conduit may have or otherwise be associated with an electrical and/or electro-mechanical configuration so as to operate at least in part electronically. For instance, the controlled release conduit may be configured as or otherwise include an electronic slow or quick release valve, an electronic pump, electronic screw plate, an electronically activated spring release plate, an electronic lever or fan or propeller or compressor, an electronic solenoid, an electronic MEMS device, piezo-electric device, and the like. In various instances, where the conduit is controlled mechanically and/or electronically, the conduit may have control circuitry, such as a microprocessor that controls a mechanism that in turn controls the opening of the conduit and/or the size, e.g., volume, of one or more of the chambers, and thereby controls the extent and rate of expulsion and/or communication between the chambers. In such an instance, the microprocessor may include one or more of a CPU, a memory, a transmitter, a receiver, other communications module, and/or one or more sensors or gauges, such as for determining flow rate, one or more flow characteristics, and/or the amount of air, gas, or other foaming and/or propelling agent being captured within the generated foam matrix or colloid of the foamable material.

In further embodiments, the foaming agent and/or propellant may be a chemical composition, and the conduit, such as a control release conduit, may be configured for facilitating the mixing of the chemical foaming and/or propelling agent with the foamable and/or flowable material, such as where the foaming and/or propelling agent is in a gaseous, liquid, gel, powder, suspension, and/or semi or solid form, and the like. For instance, the foaming and/or propelling agent may be one or more components that when intermixed with each other and/or the foamable material and/or material to be expelled from the container, cause an increase in pressure within one or more of the conduits and/or chambers of the container, which increase in pressure may be employed, via the conduit, e.g., control release conduit, or other valve, so as to pre-foam or foam the foamable material and/or facilitate in the expulsion of the material from the container, such as in response to activation of an actuator or other dispensing member. For example, the foaming and/or propelling agent may include one or more elements that when admixed causes an exothermic or endothermic or other reaction that transfers energy from one material to another in such a manner as to create a pressure differential, such as an increase or decrease in pressure, such as within a conduit and/or chamber of the container. For instance, any consumable chemical agent that undergoes a physical change, such as from a solid to a semi-solid, to a liquid and/or to a gas, with a resultant pressure change, such as an increase or decrease in pressure, for instance, due to occupying more or less space within the chamber after the change in form, may be employed in this manner.

Additionally, in various instances, the foaming and/or propelling agent may include one or more elements that when admixed causes an exothermic or endothermic or other reaction that transfers energy within the system in such a manner so as to create a temperature differential, such as between the temperature prior to admixture and/or subsequent thereto, such as an increase or a decrease in temperature, such as within a chamber of the container. In various embodiments, where there is a pressure change, the resultant change in pressure may be accompanied with a change in the temperature, either higher or lower, such as of the foamable and/or propelling material, which change in temperature may be produced for the purpose of heating or cooling the foamable and/or propelling material, such as prior to dispensing. In certain instances, the addition of the foaming agent and/or propelling agent to the foamable and/or propelling material may be accompanied by a change in pressure and/or temperature such as within the container. In particular instances, the foaming and/or propelling agent may be in a gaseous form, such as carbon dioxide, nitrous oxide, hydrogen, helium, argon, other noble gas, compressed air, and the like, wherein the gas is contained within a chamber, such as an insertable and/or removable chamber, within the container, and the control release conduit controls the flow of the gas into the chamber containing the foamable and/or propelling material, whereby upon mixing of the gas with the foamable and/or propelling material a foamed and/or flowable material is produced.

Accordingly, in one aspect, the disclosure is directed to the conversion of a foamable material from a first, non-foamed state to a second, foamed state, such as by the introduction of a foaming agent into the foamable material, for instance, for the production of a consumable foamed material end product having a desired amount of foaminess. For example, the foamable material and the foaming agent are selected such that when admixed the foamable material is converted from a non-foamed state to a foamed state wherein in the foamed state, the foamable material has a colloidal structure that is characterized by the amount of foaming agent that is trapped within the colloid. In such an instance, the foamable material is changed by the foaming agent, such as being converted from a liquid state to a state wherein the composition includes the foaming agent, such as in a foamed or partially foamed state.

For instance, in various instances, the foamable material is a material capable of absorbing and/or otherwise retaining within its formulation at least a portion of the foaming and/or propelling agent or a reactant of the foaming and/or propelling agent. For example, in certain embodiments, the foamable material is a liquid and the foaming agent is one or more of a gas, such as a soluble gas, a dissolvable powder, a suspension, a solute, a liquid, and the like. In other embodiments, the foamable material may be one or more of a gas, such as a soluble gas, a dissolvable powder, a suspension, a solute, a liquid, and the like, and the foaming and/or propelling agent may be a liquid. Accordingly, in various embodiments, a composition is provided wherein the composition includes a formulation produced by introducing a foaming agent to a foamable material, such as to produce a foamed composition, such as where the foamable material goes from a first, non-foamed state, to a second foamed state, such as by intermixing with the foaming agent. More particularly, in certain embodiments, the composition provided is a consumable product, such as a beverage, such as a foamed beverage, or other food item to be delivered to a user of the container.

In certain instances, the foaming agent and/or propellant and/or a reactant thereof may already be present within the foamable and/or flowable material, such as in a latent form that is activatable, where in such an instance, prior to activation the foaming agent and/or propellant, is quiescent within the foamable material, which may be in a non or only partially foamed or flowable state, but upon activation of the foaming agent and/or propellant, it is converted from a latent form to an active form whereby it then causes the foamable material to change from a non or partially foamed state to a foamed or super foamed and/or flowable state. In certain instances, the activatable foaming agent and/or propellant is capable of several different levels of activation and can thus convert the foamable material into a foamed and/or flowable material a multiplicity of times and/or to a multiplicity of extents, such as from partially foamed, foamed, superfoamed, and/or flowable states, and the like.

Particularly, in certain instances, the foaming agent may already be present within the foamable material, such as in a latent form that is activatable, where in such an instance, prior to activation the foaming agent is quiescent within the foamable material, which may be in a non or only partially foamed state, but upon activation the foaming agent is converted from its latent form to its active form whereby it then causes the foamable material to change from a non or partially foamed state to a foamed or super foamed state. In instances, the activatable foaming agent is capable of several different levels of activation and can thus convert the foamable material into a foamed material a multiplicity of times and/or to a multiplicity of extents, such as from partially foamed, foamed, superfoamed, and the like.

More particularly, in certain instances, the propellant is present within the foamable material in a latent form that is quiescent within the foamable and/or flowable material but capable of being activated, where upon activation of the propellant, it is converted from its latent form to its active form whereby it then causes the foamable material to be foamed and/or ejected or otherwise propelled out of the container or from one portion of the container to another portion of the container, such as in flowable form. In certain instances, the activatable propellant is capable of several different levels of activation and can thus act to propel the foamed material a multiplicity of times and/or to a multiplicity of different compartments, and the like.

Accordingly, in various embodiments, a container is provided, wherein the container includes a foamable and/or flowable material, such as a liquid capable of being foamed and/or flowed, and further includes a foaming and/or propelling agent, such as at least a partially soluble, e.g., a liquid soluble, foaming and/or flowable agent, wherein the container is configured for allowing the foamable and/or flowable material to intermix with the foaming and/or propelling agent in such a manner that a solution of the two results. In various instances, the intermixing of the foamable and/or flowable material and the foaming and/or propelling agent results in a change in pressure and/or temperature, such as an increase or decease of pressure and/or temperature, as described herein. Hence, the container and/or its component parts may be configured so as to withstand any resultant pressure or temperature change without substantially being deformed and/or without allowing the increased or decreased pressure and/or temperature from substantially escaping its bounds prior to activated release.

For example, in certain embodiments, the beverage is provided within a container, such as a container described above. In such an instance, the container may include a foamable material, or other material, to be retained within a first container portion of the container, such as in a non-foamed state, prior to expulsion therefrom and delivery to a user. In various instance, a foaming agent or other propellant may also be included, such as a foaming agent or propellant retained in a second container portion of the container. In such an instance, the second container portion may be connected to the first container portion, such as by a secondary compartment, conduit, or other dispensing mechanism that is operable, for instance, by an actuator.

For instance, in such an instance, when the actuator is actuated, the foaming agent and/or propellant may be added to the contained material to be mixed therewith, thereby converting the foamable material from a non-foamed state to a foamed state and/or propelling the material out of the container, such as through a release valve. Accordingly, in various instances, the container may include an outlet, such as an outlet that is coupled with the first and/or second container portions, such that once intermixed the foamed, flowable, and/or other material may be translated from within a lumen of the container to the outside of the container, such as through a translating member, for instance, and out through the outlet for delivery to a user, e.g., for consumption. Where an additive or sweetener is included, such as a flavor, the flavor may be delivered with the material, such as in a foamed, flavored beverage form.

Accordingly, in various aspects, a container is provided, where in various instances, the container is configured in such a way that an auxiliary reservoir may be coupled therewith, such as a reservoir that may include a foaming agent and/or propellant, which reservoir may be included in a separate compartment within the container, e.g., within a lumen thereof, or may otherwise be coupled with the container, or a portion thereof, e.g., such as by being inserted therein, or be associated with the outside of the bounds of the container, in such a manner that the auxiliary reservoir is in communication with a retaining lumen of the container. For instance, in certain instances, a foaming member, containing a foaming agent, or propellant, may be included, such as within an insertable and/or ejectable reservoir that is configured for being coupled to the container, such as a container having a foaming and/or propelling member receptacle therein.

Hence, in these various embodiments, the container may be configured to facilitate the intermixing of the foamable and/or flowable material, such as in liquid form, with the foaming agent and/or propellant, or other material, such as where the foaming agent, or propellant, is at least partially dissolvable within the foamable and/or flowable material, and functions at least in part to assist the conversion of the foamable material from a non or partially foamed state to a foamed or super foamed state and/or functions to expel the material, foamed or otherwise, out of the container. Accordingly, in various instances, the foamable and/or flowable material may be a liquid, such as a beverage, or a gel, or other solid or fluid matrix, and the foaming agent converts the foamable material from its present state into a foamed state, such as within the canister. In other instances, the foamable material may be a foamed or a partially foamed material, e.g., within the container, and the addition of the foaming agent thereto results in the production of a super foamed material. In other instances, the material is a material that is meant to be flowed, and the addition of a propelling material assists in that flowing. As indicated above, the foaming and/or propelling process may take place within or through the container, such as within one or more compartments or passageways within the container, and/or within a chamber or passageway that is associated with the container, such as within a chamber that is part of a translating element and/or within a release valve and/or within an outlet mechanism associated with the container, such as a conduit and/or control valve.

In one aspect, therefore, a system is provided, wherein the system may include one or more of: a container, as exemplified above, such as a canister that contains a material, e.g., a foamable material; one or more conduits, which conduits may include one or more valves, such as controllable release valves; one or more translating members, for translating the material, e.g., a non-foamed, partially foamed, or foamed material from the inside of the canister to the outside of the canister, e.g., through a release valve and/or nozzle; and may further include a foaming agent or propellant, which foaming agent or propellant may be contained within a separate portion of the container and/or within a foaming and/or propelling member associated therewith.

In some instances, there may be a conduit, e.g., including a control valve that regulates the transmission of the foaming agent and/or propellant to the flowable and/or foamable material, or vice versa. In various instances, the foamable material may be positioned within the container after it has at least been partially or fully foamed, and in such an instance, the container may be configured for retaining the foamed material in the foamed state, and a foaming agent may be employed to make the foam super foamed or a foaming agent need not be provided. Hence, in such instances, foaming may have already occurred and/or may occur through providing a shock and/or a shake to the container, so as to assist with or further promote foaming. A shock and/or shake can also be employed to break a seal that separates the material, e.g., foamable material, from the foaming agent and/or propellant.

Accordingly, the container may be configured for facilitating the intermixing of the foamable and/or flowable material, such as in liquid form, with the foaming agent and/or propellant, such as where the foaming and/or propelling agent, or an other agent associated therewith, is at least partially dissolvable within the foamable material, and functions at least in part to assist the conversion of the foamable material from a non or partially foamed state to a foamed or super foamed state. Hence, in various instances, the foamable material may be a liquid, such as a beverage, or a gel, or a semi-solid or solid, or a gas or other fluid matrix, and the foaming agent converts the foamable material from its present state into a foamed state, such as within the container. In other instances, the foamable material may be a foamed or a partially foamed material, e.g., within the container, and the addition of the foaming agent thereto results in the production of a super foamed material. As indicated above, the foaming process may take place within the container, within one or more compartments within the container, and/or within a chamber that is associated with the container, such as within a chamber that is part of a translating element and/or within a release valve and/or within an outlet mechanism associated with the container, such as control valve. In various embodiments, the propellant converts the flowable material from its then present state at rest into a flowable state, such as within the container.

In various of these embodiments, the container not only facilitates the intermixing of the foamable material with the foaming agent, but may also, or alternatively, facilitate the intermixing of the foamable material with a propellant, such as when the foamable and/or propelling material is in its pre-flowable, prefoamed and/or foamed state, e.g., precedent or subsequent to the intermixing of the foamable and/or flowable material with the foaming and/or propelling agent. Accordingly, in various instances, the propellant, or an agent associated therewith, is at least partially dissolvable within the flowable, foamable, and/or foamed material, and functions in one or more of assisting the conversion of the foamable material from a non or partially foamed state to a foamed or super foamed state, and/or propelling the material from the container, such as through one or more translating elements and/or dispensing mechanisms. Hence, in various instances, the foamable and/or flowable material may be a liquid, such as a beverage, or a gel, or a semi-solid or solid, or gas or fluid matrix, the foaming agent (and/or propellant) converts the foamable material from its present state into a foamed state, such as within the container, and/or the propellant functions to expel the flowable material, e.g., the at least partially foamed material, out from the interior of the container.

In other instances, the foamable material may be a foamed or a partially foamed material, e.g., within the container or canister, and the addition of the foaming agent and/or propellant thereto results in the production of a super foamed material. As indicated above, the foaming process may take place within the container, within one or more compartments within the container, and/or within a chamber that is associated with the container, such as within a chamber that is part of a translating element and/or within a release valve and/or within an outlet mechanism associated with the container, such as a control valve, and the movement of the flowable, foamable and/or foamed material through the container is facilitated by the addition of the propellant or a proponent thereof to the flowable and/or foamable material.

As indicated, in one aspect, a translating element, e.g., for coupling to and/or for use with a container, such as a canister described herein, may be provided. In such an instance, the translating element may be configured as an extended member, for instance, as an extended member having an elongated, hollow and/or tubular body. The hollow extended member includes a proximal portion and a distal portion separated by a medial portion. The distal portion of the elongated body may be configured for interfacing with and/or receiving within its bounds the foamable, flowable, and/or other material, and the proximal portion may be configured for interfacing with an outlet of the canister, such as a release valve member and/or passageway associated therewith. Further, the elongated body may be configured for allowing the transmission or movement of the material, e.g., the partially or fully foamed and/or flowable material, from within the bounds of the cavity to the exterior of the cavity, such as by translating the material from the distal portion to the proximal portion of the extender tubular member.

Accordingly, in various instances, a translating element or member is provided, such as where the translating member is configured as a feeder element, for example, a feeder tube that is adapted for moving or otherwise transferring the material, e.g., a foamed and/or flowable beverage, from within a cavity of the container to the outlet. In such an instance, the outlet of the container may be configured as, or otherwise be associated with, a valve, such as an actuatable release valve. For instance, a release valve that is configured for allowing and/or effectuating the movement of the foamable material from within the container to outside of the container, such as through the feeder tube, such as when the actuatable release valve is actuated, such as for consumption or ingestion of the foamable and/or flowable material directly or indirectly by a user. In various instances, the foaming agent, where included, may also function as a propellant, so as to also facilitate the expulsion of the foamable and/or flowable material out of the container, such as out through the feeder tube and/or outlet, such as a nozzle associated there with. In other instances, a propellant may be employed wherein the propellant does not substantially intermix with the foamable and/or flowable material, such as where the propellant is substantially immiscible with and/or non-soluble in the foamable and/or flowable material.

Where a propellant is included, a feeder element, such as a translating element, may or may not be included within the container and it's systems. For instance, where included the propellant may be employed to facilitate the movement of the material, e.g., foamable and/or flowable material, such as in a non-foamed, partially foamed, or foamed state, through the translating element and out through the outlet, e.g., either directly or through a controllable release valve and/or associated nozzle. However, in other instances, the propellant may be employed to facilitate the movement of the flowable and/or foamable material, in a foamed, partially foamed, or non foamed state, directly out through the outlet, e.g., not via a translating tube, such as through an opening and/or a controllable release valve coupled to the opening of the container itself.

Various different types of propellants and/or propelling members having various different types of configurations may be employed. In certain instances, the propellant may be the same as, or different from, the foaming agent and/or other foaming member. Any suitable propellant may be used, so long as it is capable of facilitating the movement and/or translation of the foamable material form within the container to outside of the container, and where the foamable material is provided for consumption, the foamable material and/or propellant should also be at least inert with respect to consumption, e.g., it should be consumable, such as GRAS.

Further, as indicated, the foaming agent and/or propellant may already be present within the foamable material, such as in a latent form that is activatable, where in such an instance, prior to activation the foaming agent and/or propellant, is quiescent within the foamable material, which may be in a non or only partially foamed state, but upon activation of the foaming agent and/or propellant, it is converted from its latent form to an active form whereby it then causes the foamable material to change from a non or partially foamed state to a foamed or super foamed state and/or from a non-flowable to a flowable state. In certain instances, the activatable foaming agent and/or propellant is capable of several different levels of activation and can thus convert the foamable and/or flowable material into a foamed and/or flowable material a multiplicity of times and/or to a multiplicity of extents, such as from partially foamed, foamed, superfoamed, and the like.

Accordingly, in various embodiments, a container or canister is provided, wherein the canister includes a foamable material, such as a liquid capable of being foamed, and/or includes a propellant, such as a soluble, e.g., a liquid soluble, gas propellant, wherein the canister is configured for allowing the foamable material to intermix with the foaming agent and/or propellant in such a manner that a solution of the two results. In various instances, the intermixing of the foamable material and the foaming agent and/or propellant results in a change in pressure and/or temperature, such as an increase or decease of pressure and/or temperature, as described above. Hence, the canister may be configured so as to withstand any resultant pressure and/or temperature change without substantially being deformed and/or without allowing the increased or decreased pressure and/or temperature from substantially escaping its bounds prior to activated release.

For example, in various instances, the material of the container or canister may be one or more of a non-conductive, insulated, thermal retaining material that is adapted to retain the foamable material, e.g., once foamed, under pressure and/or within a warmed or cooled state. For instance, in certain instances, the foamable material is a liquid and one or more of the foaming agent and/or propellant is a liquid soluble gas or solute that at least to some extent intermixes with and/or is otherwise at least partially dissolvable within the liquid, so as to form a solution and/or suspension; and in various instances, the formation of the solution may result in the generation of an increased pressure gradient, such as within the canister, such as a pressure gradient that is increased as compared to outside of the canister, or as between different portions within the canister. In such an instance, the foaming agent and/or propellant going into solution may cause a pressure increase within a portion of the canister and may further thereby cause the foamable material to foam.

In other instances, the foaming agent and/or propellant may already be in solution and the foaming occurs by the creation of a pressure and/or temperature gradient or other mechanism that draws the foaming agent and/or propellant out of solution, so as to equalize the pressure and/or temperature in the local environment, thereby causing the foamable material to foam, such as by the foaming agent exiting the solution, e.g., by bubbling out of solution such as where the bubbling generates the foaming action and/or causes the material to become flowable. In certain instances, the foamable and/or flowable material, e.g., a liquid portion, and the foaming and/or propelling agent, e.g., a gas portion, are contained in separate portions of the canister, and are not intermixed until exiting the canister, such that just prior to egress the foaming agent is intermixed with the foamable material, which intermixing causes the foaming material to foam, such as by the foaming agent, e.g., liquid soluble gas, forming gas bubbles within the foamable material, e.g., liquid beverage, such as by at least partially dissolving therein, prior to exiting the outlet of the canister.

For instance, the container or canister may include a release valve portion that is configured for allowing the foamable material and the foaming agent to intermix, such as just prior to egress from the canister. More particularly, the canister may include at least two distinct portions, one containing the foamable material and the other containing the foaming agent. In such an instance, the canister may further include two distinct translation element portions, such as one interfacing with the foamable material and the other interfacing with the foaming agent, such as where the translating element are two separate translating elements or where the translating element is forked, such as where the translating element is configured for translating the foamable material and the foaming agent into a common receptacle, such as for intermixing, prior to release from the canister. In various instances, the outlet of the canister may be configured to feed into a valve, such as a control release valve, where the valve includes a chamber into which one or both of the foamable material and/or the foaming agent are delivered thereto, such as for intermixing and/or foaming, e.g., prior to release through the valve, for instance, upon actuation of the valve, and/or the valve may further feed into a delivery nozzle.

Accordingly, in one aspect, a valve is provided, wherein the valve is configured for interfacing with a portion of a container, canister, and/or a translation member associated therewith so as to facilitate, e.g., control, the release of a flowable and/or foamable material from within the canister to outside of the canister, such as for delivery to a user, e.g., a consumer of the translated flowable material. Accordingly, the valve may have a distal portion, such as for interfacing with a portion of the canister, e.g., a portion of the canister bounding an opening therein, or a translating element associated therewith; and it may have a proximal portion, such as for interfacing with a user of the canister of the system, such as for dispensing the fluid therein, such as to a user. Typically, the valve will have an orifice or passageway extending the length of the valve, such as an orifice for translating the flowable and/or foamable material through the valve, such as for dispensing the flow of the flowable and/or foamable material out from the cavity of the canister. In various instances, the orifice may be of increasing or decreasing radius and may have one or more internal configurations, such as for creating shear with respect to the flowable and/or foamable material.

In various instances, the valve may be a control valve, such as a control release valve that upon activation allows and/or facilitates the flow of the flowable and/or foamable material, e.g., in the foamed state, out of the canister, such as by interacting with the outlet of the canister and/or one or more translation members associated therewith. The valve may have any suitable configuration so long as it is capable of facilitating and/or controlling the movement and/or release of the contents of the canister out of the container, such as in a controllable manner, e.g., with respect to one or more of flow rate, density, pressure, temperature, aeration, foaminess, and/or contour of the flowable material. For instance, in one particular instance, the valve is adapted to allow the flowable and/or foamable material, such as in a beverage form, to mix with one or more of the foaming agent and/or propellant, e.g., in gas form, such as in the presence of a pressure gradient, for example, in a pressure gradient created by the valve itself, which mixing of the liquid beverage and the gas, such as in the presence of a pressure gradient, causes gas bubbles to form within the liquid, or exit therefrom, thereby creating a foam. In various instances, the amount of the foaming agent/propellant that is intermixed with and/or absorbed by the flowable and/or foamable material is controlled so as to control the nature of the flowable and/or a foamable material. It is to be noted that the above has been described with respect to a valve associated with the container or canister, however, it is understood that the valve may be part of the canister or be part of a dispensing mechanism, such as a nozzle, and/or one or more of these functions may be performed by either the valve, the nozzle, or other dispensing element.

Accordingly, as indicated, the dispensing mechanism, e.g., translating passageway, valve and/or nozzle, may be adapted for increasing or decreasing the pressure of the flow, e.g., of the flowable and/or foamed material, such as by having a passageway there through that changes dimensions, such as from larger to smaller or smaller to larger, and in some instances, the dimensions of the passageway are capable of being changed, such as where the valve is articulable thereby being able to change the dimensions and/or openings of one or more portions of the orifice thereby increasing or decreasing the pressure driving the flow of the flowable material through that portion(s) of the orifice. Additionally, the valve may be configured for increasing or decreasing foamability of the foamable material, for instance, the passageway, valve, and/or nozzle may be configured so as to include one or more additional openings such as to aerate the foamable material as it passes through the passageway, valve, and/or nozzle, such as in a controllable fashion, so as to make the foamable material more or less foamy and/or flowable. More particularly, the passageway, valve, and/or nozzle may be configured for allowing air, or another gas, such as the foaming agent and/or the propellant to intermix with the flowable material so as to modulate the foaminess and/or flowability of the material, such as when it passes through the passageway, valve, and/or nozzle. Hence, the flow of the material may be regulated so as to be a relatively fast, medium, or slow flow rate, such as by thickening, thinning, aerating, foaming, defoaming, and/or otherwise changing the characteristics of the flowable material and/or the container or its components itself.

Accordingly, in certain instances, the passageway, valve, and/or nozzle are configured for changing a characteristic of the flowable and/or foamable material, such as with respect to flowability, e.g., thickness, viscosity, thixotropic effect, and the like, the taste, flavor, shape, look, and/or feel, such as in the delivery of the flowable material. For instance, the passageway, valve, and/or nozzle may be configured for contouring the shape of the flowable and/or foamed material, so as to enhance the flow, taste, flavor, shape, look, and/or feel of the flowable material, such as to make it easier to use and/or more pleasant to the user, e.g., upon delivery directly to the user such as for direct consumption by the user. For example, in various particular instances, various different types of passageways, release valves, and/or nozzles, and/or translating elements, alone or in combination, may be employed for one or more of translating and/or extracting the foamable and/or flowable material from a portion of the container; translating and/or extracting the foaming agent and/or propellant from one or more other portions of the container; and/or introducing the foaming agent and/or propellant into a common reservoir where these components can intermix, which intermixing can be fashioned in such a way as to change the flow, taste, flavor, shape, contour, look, and/or feel of the flowable material, for instance, the taste may be changed such as by adding a flavoring agent upon the mixing and/or contouring the foamed material upon release. The rate of release may also be important either for enhancing taste and/or for ensuring optimal mixing of propellant and/or foaming agent with the translatable material to ensure appropriate amount of foaming and/or flowability.

Hence, in some particular instances, a system is provided wherein a material, such as an ingestible, foamable and/or flowable material is stored in one physical state within a container or canister and undergoes a physical change, such as prior to delivery, e.g., direct delivery to a user, whereby due to the physical change the foamable and/or flowable material is converted at least partially to another physical state, such as from a non-foamed and/or non-flowable state to at least a partially foamed and/or flowable state. For instance, in various instances, the foamable material may be a beverage, in a liquid form, and upon the addition or intermixing of the foamable material, the liquid is changed, e.g., converted, from a liquid to at least a partial colloid or matrix, such as to form a foamable material. More particularly, the foamable material may be such that it is capable of forming a matrix with one or more components of the foaming agent and/or propellant and may further form a colloid such as upon the foaming agent and/or propellant being introduced with and/or mixed with the foamable material, wherein the foaming agent and/or propellant may at least be partially dissolvable within the foamable material so as to be captured within the matrix and may thereby form a foamable colloid therewith.

For example, a container having at least a first cavity and a passageway, conduit and/or valve may be provided where in a portion within the cavity a foamable material, such as a liquid, e.g., a beverage, is stored; and within a second portion of the cavity a foaming agent and/or propellant, such as a gas, e.g., a liquid soluble gas or a mixture of gasses, is stored, and at some point prior to dispensing the liquid beverage is intermixed with the liquid soluble gas in a manner sufficient to form a foam and/or a flowable material that may then be delivered directly to the mouth of a user for consumption, such as for drinking. Hence, in various instances, the container may be a beverage container that contains a liquid beverage as well as a foaming agent and/or propellant, such as a gas or mixture of gases, such that prior to or upon actuation of the valve, e.g., a control valve, a solution of the liquid and gas, e.g., in a foamed or semi-foamed state, is released or otherwise dispensed, such as directly to the mouth of the consumer, e.g., by single-handed activation of a delivery actuator, such as via a nozzle, in a manner that allows for the direct drinking, imbibing, or otherwise ingesting of the beverage by the user.

For instance, in a particular embodiment, the container or canister along with the foamable and/or flowable material, e.g., liquid beverage and/or food, in combination with the foaming agent and/or propelling agent, e.g., in gaseous form, forms a pressure and/or temperature gradient, such as between the contents within the container and the ambient pressure outside of the container, such that as the valve is actuated the foamable liquid and/or food material and the gaseous foaming agent and/or propellant exit the container, e.g., through the valve, in a manner such that the pressure and/or temperature gradient causes the gas to go into solution and/or gas already in solution to leave the solution, which entering and/or exiting of the gas into and/or out of solution causes bubbling, which bubbling is at such an amount and rate so as to cause the liquid beverage or food item to flow and/or foam, e.g., by gas bubbles being created and/or captured within a matrix of the material, e.g., so as to form a colloid or by gas bubbles already present within the matrix to leave the solution, which foamed beverage and/or food material may be delivered to the user, such as via a nozzle, for direct consumption by the mouth of the user, such as for drinking and/or eating or otherwise imbibing the flowable and/or foamed solution.

Accordingly, as detailed herein, a container for containing a beverage or food product, and/or a beverage or food product so contained, may be provided where the container includes one or more of a top, a bottom and a side wall, such as a side wall between the top and the bottom. The container may include a first cavity, such as within or otherwise defined by the top, bottom, and sidewall, where the first cavity is sized or otherwise configured to hold an ingestible material, e.g., beverage, such as a foamable liquid in a pre-, mid-, or post-foamed state.

The container may include a valve mechanism having a proximal portion and a distal portion, such as where the proximal portion of the valve mechanism extends outward from the top of the container, and the distal portion of the valve mechanism extends inwards toward the first cavity of the container. In such an instance, the valve mechanism may include a valve, such as a valve configured to regulate the flow of the ingestible material from within the interior of the container to outside of the container, such as through an inlet aperture of a feeding mechanism that may be associated with the valve mechanism. Hence, the valve may be a control valve that is controllable by a consumer, such as via a consumer-operable flow controller, so as to control the valve in a manner sufficient to vary the flow, such as between no flow and a maximal flow, e.g., based on a physical force applied by the consumer to the consumer-operable flow controller. In a manner such as this, the flow of the ingestible beverage into the distal portion and out through the proximal portion of the valve may be regulated, e.g., in response to the operation of a suitably configured control mechanism.

Further, in various instances, the valve mechanism may be coupled with a nozzle, such as a delivery nozzle having a distal portion configured for being coupled with the proximal portion of the valve, and a proximal portion configured for delivering the ingestible substance directly to the user, e.g., to the mouth of the user, such as for direct ingestion, e.g., drinking and/or eating, by the user. For instance, the delivery nozzle may be configured to form a pathway that extends from the container, e.g., associated with the first cavity, through the nozzle to an exit aperture that is adapted to deliver the ingestible substance to the mouth of the consumer. In such an instance, the pathway between the valve and the exit aperture of the delivery nozzle may be flexible. In particular instances, the proximal portion of the nozzle may be sized and adapted to be received in a mouth of the consumer. Accordingly, in operation, the ingestible substance may be translated from the interior of the cavity, through the pathway formed by the delivery nozzle and to the exit aperture of the delivery nozzle. In various instances, the pathway through a proximal, medial, and/or distal portion of the delivery nozzle may be angled from the pathway through one or more of the other, e.g., distal, portion of the nozzle and/or outlet thereof.

The container may include a feeding mechanism, for instance, a translating member, e.g., a feeder tube, having a proximal end that is coupled with the distal portion of the valve, and a distal end positioned in the first cavity, such as proximate the bottom of the container. Hence, the feeding mechanism may be associated with the first cavity of the container so as to access the ingestible substance therein. Particularly, the feeder element may include an elongated body having a proximal interface and a distal interface, such as where the proximal interface is configured for communicating with the proximal or top portion of the container, such as via the distal portion of the valve; and where the distal interface is configured for communicating with the ingestible beverage, e.g., foamable and/or flowable material, within the first cavity. In various embodiments, the feeder and/or translating element may be configured or otherwise adapted for transferring the ingestible substance, e.g., foamable and/or flowable beverage, from the lumen of the first cavity to the valve of the container, such as for delivery of the ingestible beverage to the user, for example prior to or post foaming of the beverage.

The container may include one or both of a foaming and/or propelling mechanism that may be connected with one or more of the first cavity or a secondary and/or third cavity, such as a secondary or tertiary cavity within a valve, e.g., a dispensing valve, of the container. In various instances, the foaming and/or propelling mechanism is adapted to or otherwise configured for converting an ingestible beverage and/or food item and/or medicine from a non-foamed and/or non-flowable state to a foamed and/or flowable state. Hence, the foaming and/or propelling mechanism may be configured for flowing, e.g., upon consumer control of a controllable dispensing valve, the ingestible beverage and/or food item and/or medicine, e.g., in the foamed and/or flowable state, through the feeding mechanism to the controllable dispensing valve and out the proximal portion of the valve, e.g., out through the nozzle, if included.

In certain embodiments, the foaming and propelling mechanism includes a foaming agent, e.g., the foaming and propelling mechanism may be the same as the foaming agent, and in other embodiments, they are distinct elements that may act in concert to foam and/or propel the ingestible substance, e.g., beverage or other food item, such as within and/or out of the container. In some embodiments, a foaming mechanism is included wherein the foaming mechanism is coupled with the first cavity of the container and adapted to convert, e.g., using a foaming agent, the ingestible substance from a non-foamed state to a foamed state for exiting the exit aperture, e.g., of the delivery nozzle, such as in response to the operation of a controller, e.g., a consumer-operable flow controller. Accordingly, in particular embodiments, the container may include a propelling mechanism, such as a mechanism that is configured for generating a positive pressure within the first cavity, which propelling mechanism is sufficient to propel the ingestible substance through the container, e.g., a feeding mechanism where included, and out of the proximal portion of the delivery nozzle, such as for delivery of the ingestible substance to the mouth of the consumer, for example, when the valve is controlled by the consumer-operable flow controller. In certain instances, the proximal portion of the delivery nozzle at least partially includes a flexible member, such as at the exit aperture In various embodiments, the container may include a second cavity that may be operationally or otherwise connected with the first cavity, such as by a secondary valve, e.g., a controllable feeding valve, or by a feeder element. In such an instance, the first cavity may be configured for retaining and storing the flowable and/or foamable beverage or food item, and the second cavity may be configured for retaining and/or storing the foaming and/or propelling mechanism, e.g., foaming and/or propelling agent, such as until the consumer activates one or both of the dispensing and/or feeder control valves. For instance, in certain embodiments, the foaming and/or propelling mechanism may include a foaming agent and/or propellant that may be introduced into the first cavity, such as upon the operation of a consumer-operable conduit, e.g., a feeder valve, to the first cavity. In such instances, the feeder valve may be configured so as to control the feeding of the foaming and/or propelling agent into contact with the foamable and/or flowable material, such as within the first or second or even third cavity, so as to create a positive pressure therein. For example, the foaming and/or propelling mechanism may include a gas, such as a foaming agent and/or propellant, that is introduced from the second cavity to the first cavity, and/or a third cavity, such as a mixing chamber. Such introduction may take place as a result of the operation of an operable, e.g., consumer-operable, flow controller for controlling a passageway and/or a valve thereof. In various instances, the gas propellant may also be the foaming agent and may therefore function to convert the ingestible substance from a non-foamed state to a foamed state and/or a flowable state for exiting the exit aperture of the delivery nozzle. As indicated, the valve controller may operate to control the flow of an amount of the gas proportion of a mixture with the ingestible substance sufficient to convert the ingestible substance to the foamed and/or flowable state.

Accordingly, in certain embodiments, a third cavity, e.g., a mixing cavity, may also be present such as where the third cavity is operationally or otherwise coupled with one or both of the first and/or second cavities, such as where the first and/or second cavities feed directly into the third cavity, e.g., via a tertiary operational flow control valve, such as a mixing valve. In such an instance, the first and/or second cavities may feed into the third cavity, such as for the purpose of mixing the foamable material with the foaming agent, by the operation of the feeder control element. Additionally, in various embodiments, a foaming mechanism may be included, where the foaming mechanism includes a foaming agent that is configured for converting the ingestible substance from a non-foamed state to a foamed state, e.g., within the first, second, and/or third cavities, prior to exiting the exit aperture of the delivery nozzle in the foamed state.

As indicated above, in various instances, such a third cavity may be part of, e.g., within the bounds of the container, and/or may be a part of a control, e.g., a dispensing, valve; and/or part of a dispensing nozzle. It is to be understood that any of the passageways, valves and/or nozzles disclosed herein may be configured for regulating the flow, mixing, and/or foaminess of the flowable and/or mixable materials disclosed herein, such as with respect to controlling or otherwise regulating the rate, amount, quality, and/or other characteristics of the flow, mixing, taste, texture, and/or foaminess of the flowable and/or mixable materials. The valves may be positioned anywhere within the bounds of the container or a component thereof such as between the boundaries of the various compartments or within one or more of the translating elements and/or nozzles.

In view of the different configurations of the container and/or the cavities therein, a feeding mechanism, such as a translating element, e.g., feeder tube, may be configured so as to act as a conduit directing the flow of the various flowable materials held within one or more components of the system. For instance, the translating element may be composed of one or more elements that are configurable for or otherwise adapted for directing a flow of one or more of the flowable materials, e.g., the one or more foamable materials and/or one more foaming agents and/or propellants, that are held or otherwise stored within the one or more cavities of the container. One or more control valves may be included as part of the feeder element so as to further control and direct the flow of the flowable materials through the feeder element. Hence, the translating element may include a portion that contacts the flowable and/or foamable material and/or may include a portion that contacts the flowable foaming agent and/or propellant, and may include another portion that contacts a top portion of the container, such as via a dispensing valve and/or dispensing nozzle, so as to facilitate the flow and/or mixing of the flowable and/or foamable materials within and/or out of the container.

For example, a feeding member may be provided, wherein the feeding member has a proximal end that may be coupled with the distal portion of a valve mechanism, and the feeding member has a distal end that may be positioned in the first cavity, such as where the distal end has an inlet aperture. Particularly, the container may include a valve mechanism that is coupled with a delivery nozzle and further includes a feeding mechanism, such as a feeder member that is associated with the first cavity of the container so as to access the ingestible substance therein, such as where the valve mechanism includes a valve configured to regulate the flow of the ingestible substance from the first cavity and through the pathway formed by the feeding mechanism and delivery nozzle.

In various embodiments, the translating mechanism includes a member that translates the one or more flowable materials through its componentry via the action of a propellant, actuation of one or more of control mechanisms, such as a consumer-operable flow controller detailed herein, and/or the creation of a pressurized chamber or vacuum, such as that created by a user sucking or blowing into one or more of a user contactable portion of a dispensing nozzle, dispensing valve, and/or proximal portion of the translating member directly. For instance, a propelling mechanism connected with a first cavity of the container may be included, wherein operation of the propelling mechanism is based on operation of a consumer-operable flow controller for controlling a valve regulating the flow through the feeding and/or dispensing mechanism of the container, which functions to propel the ingestible substance into an inlet aperture, e.g., of a delivery nozzle, through the feeding mechanism, and out of an exit aperture of a distal portion of the nozzle, such as for delivery of the ingestible substance, e.g., directly to the mouth of the consumer. In certain instances, the propelling mechanism may be capable of mechanical motion and the operable flow controller may be mechanically coupled with the valve so as to control the valve in a manner sufficient to vary the flow, e.g., between no flow and a maximal flow, proportional to a degree of a physical force applied by the user to the user-operable flow controller. In such an instance, the propelling mechanism, which may be a deformable bladder and/or an elastic member, may be coupled with the first cavity in such a manner so as to generate a pressure against the movable portion of the first cavity sufficient to propel the ingestible substance from the first cavity, through the feeding mechanism and out of the distal portion of the delivery nozzle for delivery of the ingestible substance to the user and/or to an external item when the valve is controlled by the consumer-operable flow controller.

Accordingly, a translating member, e.g., a feeder tube, of the disclosure may have any suitable configuration that may be useful in translating the flowable ingestible materials through the system such as for one or both of mixing and/or direct dispensing to the user, e.g., directly to the mouth of the user for ingestion, such as for drinking. In various instances, the translating member is configured for functioning regardless of the orientation of the canister, such as regardless of how the device is manipulated and/or used by the consumer in ingesting, e.g., drinking and/or eating, the foamable material stored therein. Hence, the feeder tube(s), as disclosed herein, may be configured to assist in directing the flow of the mixable elements, assisting in mixing the elements, and for delivering the mixture to a user, such as in a flowable, foamed state, e.g. via a control valve, such as a siphon valve, or nozzle. In various instances, the container may be configured for simple activation, such as via single left or right hand of the user. Additionally, in particularly instances, the delivery mechanism, e.g., nozzle, passageway, and/or valves, may be configured with respect to the feeder mechanism and/or container and/or a cavity therein such that while the ingestible substance is delivered, the inlet aperture is proximate a portion of the container that is closest toward the center of the earth, and an angle between a vector from the inlet aperture of the feeding mechanism to the exit aperture of the delivery nozzle and a vector from the inlet aperture of the feeding mechanism to the center of the earth is greater than about 45, greater than about 60, or greater than about 90 degrees.

In a particular embodiment, an apparatus such as for serving an ingestible substance is provided, wherein in the apparatus includes a container, such as a container having a at least a first cavity such as to hold an ingestible substance therein. In various instance, the first cavity may have a movable portion. In certain instances, the container may include a delivery nozzle, which nozzle may be configured so as to form a pathway through or from the container. The delivery nozzle includes a distal portion that may extend away from the container, and a proximal portion having an exit aperture extending from the pathway that is adapted to deliver the ingestible substance directly to a mouth of a user, e.g., a consumer of the ingestible substance.

In certain embodiments, the container may additionally include a valve mechanism that may be coupled with the delivery nozzle. The container may also have a feeding mechanism that may be associated with the first cavity so as to access the ingestible substance therein, such as where the valve mechanism includes a valve that is configured to regulate the flow of the ingestible substance from the first cavity through the pathway formed by the delivery nozzle. Additionally, the container may include a consumer-operable flow controller that is mechanically coupled with the valve and configured to control the valve so as to vary the flow, e.g., between no flow and a maximal flow proportional to a degree of a physical force that is applied by the consumer to the consumer-operable flow controller. In certain instances, a propelling mechanism may be included and be coupled with the first cavity so as to generate a pressure against the movable portion of the first cavity, such as a pressure that is sufficient to propel the ingestible substance from the first cavity, such as through the feeding mechanism and out of the distal portion of the delivery nozzle for delivery of the ingestible substance to the user and/or an external item when the valve is controlled by the consumer-operable flow controller.

In particular instances, the container may include a plurality of first cavities, such as where each of the plurality of first cavities is adapted to hold a different ingestible substance. As indicated above, one or more or all of the plurality of first cavities may have a movable portion therein. In such an instance, one or more propelling mechanisms may be included, where the propelling mechanism(s) may be coupled with one or more, e.g., each, of the plurality of first cavities so as to generate a pressure against the movable portion(s) of one or more of the plurality of first cavities, such as a pressure sufficient to propel the ingestible substance from one or more of the plurality of first cavities. In such an instance, the force is sufficient to push the ingestible substance through the feeding mechanism and out of the distal portion of the delivery nozzle for delivery of the ingestible substance such as when the consumer-operable flow controller is operated so as to control the valve to effectuate the release.

In various instances, the propelling mechanism may include a second cavity that envelopes at least the moveable portion of the first cavity, such as where the second cavity exerts a pneumatic pressure against the movable portion of the first cavity. For instance, the second cavity may be associated with a piston that moves to exert pressure against the first cavity, such as where the moveable portion is the piston. In particular instances, a spring member may be include such as where the spring member exerts the pressure against the movable portion of the first cavity. In some instances, a consumer-operated air pump may be included and rigidly attached to the container, such as for exerting pressure against the movable portion of the first cavity upon a force exerted on the consumer-operated air pump. In such an instance, a consumer-operable flow controller is included and adapted to vary the proportion of delivery of each ingestible substance from each of the one or more of the plurality of first cavities. In certain instances, a moveable nozzle may be included such as where the nozzle rotates or pivots from one of the plurality of first cavities to another of the plurality of first cavities, such as where the pressure generated by the propelling mechanism may be selectively applied to the one or more of the plurality of first cavities.

Additionally, in various embodiments, the container may include a foaming mechanism, such as where the foaming mechanism includes a foaming agent that is configured for converting the ingestible substance from a non-foamed state to a foamed state, such as prior to exiting the exit aperture of the container or a delivery nozzle associated therewith in the foamed state. For instance, a foaming mechanism having a foaming member associated therewith may be included such as where the foaming member has a foaming chamber associated with it, such as for mixing a pressurized gas with the ingestible substance so as to convert the ingestible substance from a non-foamed state to a foamed state for exiting the exit aperture of the delivery nozzle in the foamed state. A propelling mechanism may also be included where the propelling mechanism may be included in or may include a second cavity, such as a second cavity containing a pressurized propellant gas. In some instances, the foaming mechanism may include a conduit from the second cavity to the foaming chamber so as to deliver the pressurized gas to the foaming chamber. In particular instances, the foaming mechanism further includes a second valve so as to regulate the flow of the pressurized gas to the foaming chamber, such as where the conduit passes through a movable portion of the first cavity and/or where the second cavity is associated with a piston that moves to exert pressure against the first cavity. In such an instance, the conduit may be configured to pass through an aperture of the piston. In particular instances, the first and/or second cavity may be bounded by a container body that is rigid under pressure, where as the first cavity may be bounded by a more flexible and/or stretchable body.

Hence, in various embodiments, the container may include a liquid or a mixture of liquids, e.g., in a drinkable and/or foamable beverage form, and/or may include a liquid soluble gas or a mixture of gasses that may be configured as one or both of a foaming and/or a propelling agent, wherein upon contact, under increased or decreased pressure and/or temperature, the liquid(s) in admixture with the soluble gas(es) may form a solution, such as a foamable and/or flowable solution, that may be delivered to a user, such as for drinking, e.g. directly from the container, such as through a suitably formed delivery nozzle. As indicated, the liquid(s) and/or liquid soluble gas(es) may be retained within the container in the same or different compartments, can be intermixed in the same or different compartments, and/or can be translated throughout the system and/or to a user, such as through one or more suitably formed translating elements, e.g., feeder tubes, and/or one or more control valves associated therewith. In some embodiments, the container includes a first compartment for retaining both a liquid and a gas, such as where the liquid and the gas are separated from one another in the container, such as via a pressure gradient between the two, e.g., under increased pressure; and in some embodiments, the container includes a first compartment for retaining the liquid, which first compartment may be flexible or semi-flexible, and a second compartment for retaining the gas, which may be rigid or semi rigid, such as where the liquid and the gas are separated from one another in the canister by a dividing wall, which may be moveable, but may be configured for communicating with one another, such as for the purpose of intermixing, such as via one or more valves, e.g., a feeding, mixing, and/or dispensing valve, and/or one or more translating elements, and/or one or more passageways and/or nozzle elements.

In such an instance, the liquid may be an ingestible beverage or food item, the gas may be at least a partially liquid soluble gas, and the feeder element(s) and/or release valve(s) may be configured for intermixing the liquid and the liquid soluble gas, such as to produce a foamed and/or flowable material, such as on release, e.g., actuation of a release mechanism, e.g., an operable control mechanism, of the container. For instance, the gas may be a dissolved gas in solution of the ingestible substance. Particularly, the dissolved gas may create a propelling mechanism so as to generate a pressure within the first cavity sufficient to propel the ingestible substance through the container, e.g., a feeding mechanism associated therewith, and out of a proximal portion of a delivery nozzle. As indicated, in various embodiments, the container may include a plurality of compartments, such as a first compartment for retaining the ingestible substance, and a second compartment for retaining the foaming agent and/or propellant. In various instances, the second compartment may be configured for receiving an interchangeable gas reservoir, such as a cartridge containing a foaming and/or propelling member therein, e.g., a gas cartridge, which cartridge may be inserted into the container for discharging, and may be replaceable once the cartridge has been discharged, such as through activation of a release mechanism of the container or a component associated with the container. In various embodiments, a cap that seals over a portion of the container having an opening into an inner cavity of the container, e.g., a proximal portion of the nozzle, a feeder mechanism, and/or the container, may be included. In such instances, a retaining mechanism for retaining the cap in relation to the nozzle, feeder mechanism, and/or container may be included. A sealing mechanism such as to seal an interface between the cap and the container to seal the cavity of the nozzle, feeder mechanism, and/or container may be provided.

In a further aspect, methods for producing a foamable and/or flowable material are provided, such as where the foamable and/or flowable material is comprised of a liquid, such as a beverage, or other food item or topping or medicine that may be consumed, for instance, in imbibable and/or ingestible form, or where the foamable material is at least partially prefoamed but subjected to conditions that function to increase or decrease the foaminess of the material, such as prior to delivery from a storage and/or delivery canister. The methods may include one or more steps, such as a step that includes actuating a delivery mechanism of the container, which actuation functions to eject the foamable and/or foamed material in conjunction with one another and/or out of the container.

For example, the actuation of the delivery mechanism, e.g., via a consumer operable controller, may involve the actuation of one or more of a nozzle, a valve, and/or a translation element associated with a container configured for retaining the foamable material, such as where the actuation may involve activating a control element, such as depressing or pulling a button, turning a nozzle or screw or knob, pulling a trigger, squeezing a depressible element, flipping a switch, biting a valve, pulling a tab, removing a pin or stop, operating a pressure differential valve, activating an electronically controlled valve by an electrical input sensor or signal, and the like. In some instances, one or more of the components contained within the container may be under pressure, and such actuation may function to mix the contained components and/or release one or more of the contained components, such as after they have been mixed together, such as to produce a non-foamed or at least a partially foamed material. In various instances, the container or a portion thereof may include a cap or seal that must be removed or unsealed, e.g., burst or punctured or the like, prior to delivery of the ingestible material.

In particular, the recited actuation may involve one or more of releasing one flowable component into another flowable component contained within the container, such as by the operating of one or more valves that function to open one or more conduits and/or translating element(s); and/or the translating of one or more of the components such that they come into contact with one another, such as within one or more chambers within the container, passageways, valves, and/or nozzles associated therewith, such as prior to or in conjunction with actuation of the delivery mechanism and/or release from the container. In some instances, the actuation may involve an electronic control mechanism, for instance involving a control circuit that may be in a wired or wireless configuration, such as part of a processor on a microchip, such that by electronic activation of the control circuit the delivery mechanism may be activated and the components of the container may be mixed and/or released, such as for delivery of the foamable and/or flowable material to a user. Such control may be operated in a wired configuration such as by employing an integrated circuit, or may be performed wirelessly, such as through Bluetooth or Low Energy Bluetooth.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1A:
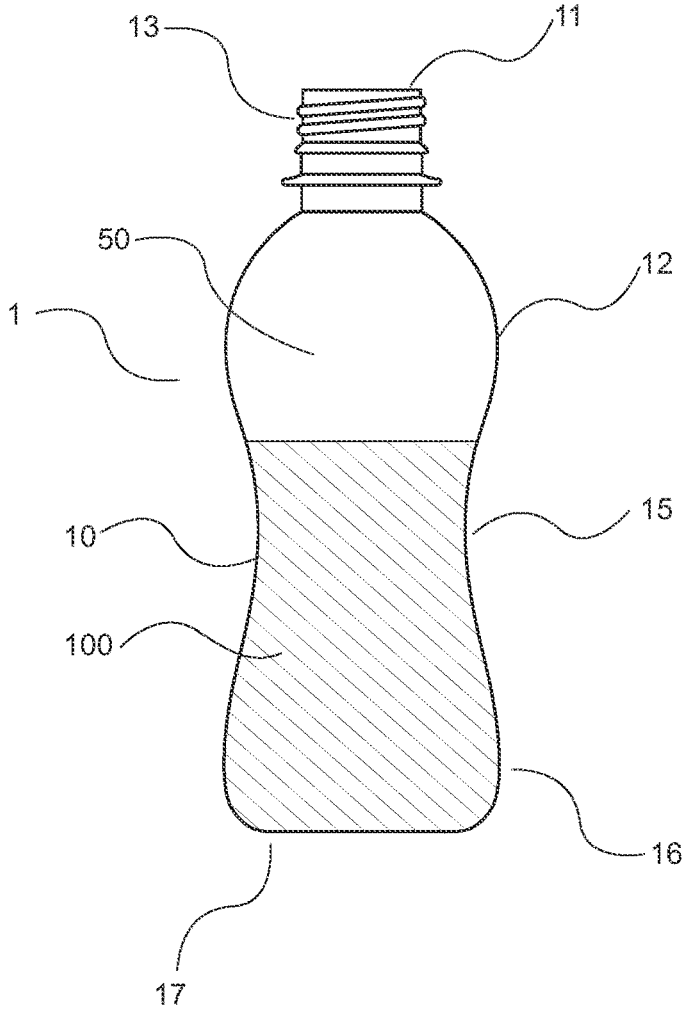
FIG. 1A is a schematic representation of a container, e.g., a soda bottle, as known in the prior art.

In the following paragraphs, the present apparatuses, systems, and methods of using the same will be described in detail by way of example, sometimes with reference to the appended drawings. Throughout this description, the various aspects, embodiments, instances, and/or examples shown should be considered as exemplary, rather than as limitations on the present implementations. Additionally, as used herein, the use of the words "embodiment" and "instance" refer to any one of the embodiments and/or instances of the disclosure described herein, and any equivalents thereof. Furthermore, reference to various feature(s) of the present disclosure throughout this document does not mean that all claimed embodiments and/or instances must include the referenced feature(s) and/or elements as these features may be mixed or matched in any logical manifestation dependent upon the particular embodiment being employed.

The present disclosure, in its many aspects, describes devices, systems, and methods of using the same for the production of a consumable material, such as a foamable and/or flowable material, for instance, for ingestion, such as by direct delivery to a consumer, such as by drinking, eating and/or otherwise imbibing and/or consumption. In one aspect, a device and/or a system using the device is provided, such as, a device for foaming and/or delivering an ingestible material, such as to a user. In another aspect, a method is provided wherein the method is directed to converting a foamable material from a first, semi or non-foamed state, to a second foamed state and/or from a semi or non-flowable state to a flowable state. Additionally, in some embodiments, a method is provided for manufacturing a delivery apparatus of the disclosure and/or using the device for delivering a material, such as a foamable and/or a flowable material, from within a chamber of the device containing the material. In a further aspect, a foamed and/or flowable consumable product is provided, wherein the foamed and/or flowable material is derived from a material and/or produced by a process that was not heretofore known to be foamable and/or flowable in the manner presented herein. Accordingly, in further aspects, novel methods and devices for foaming and/or delivering materials, such as fluid and flowable materials are provided, and in other aspects methods for producing foamed and/or flowable materials, such as for ingestion, are provided. Systems including such materials, devices, and methods are also provided.

Hence, in various aspects, a material is provided, such as a material capable of being foamed, for instance, by being converted from a first, e.g., non-foamed state, to a second, foamed state, or from a foamed state to a super foamed state. In certain instances, the foamable material may be any material capable of forming a matrix, such as by at least partially absorbing a gas, such as a dissolvable gas therein, such as by forming a colloid there with. More particularly, the material may be converted to a foam such as by the partial absorption and/or desorption of gas bubbles within a matrix of the material. For instance, in various instances, the material is a foamable material that is foamed such as by the contacting of the material with a foaming agent, such as where the foaming agent is a gas, or where the foaming agent is a mechanism that is capable of forming a gas that is contactable with the foamable material, such that upon contact gas bubbles may be formed and/or trapped within the foamable material and/or a matrix therein such as to form a colloid with the foamable material. In other instances, the material may be converted to a foam such as by gas bubbles leaving the solution of the material and/or by other purely mechanical mechanisms. For example, the foamable and/or flowable may be formulated such that it forms a matrix into which a foaming agent, such as a gas, may be retained so as to form a solution therewith. In such an instance, as the container or a passageway or a valve thereof is opened, the gas is allowed to expand, leaving the solution, and thereby causing the material to foam, such as prior to exiting the nozzle.

In various aspects, a flowable material may be produced, such as a material capable of being flowed, for instance, by being converted from a first, e.g., non- or semi-flowable state, to a second, flowable state, or from a flowable state to a super flowable state. In certain instances, the flowable material may be any material capable of being converted into a flowing form and/or capable of being modulated with respect to one or more of its flowable properties, such as to increase or decrease flowability. More particularly, the material may be converted to a more or less flowable state, such as by becoming more or less viscous, thixotropic, and/or the like. In certain instances, the flowable material may be a foamable material.

Accordingly, in various instances, the flowable and/or foamable material may be a liquid, a solution, a semi-liquid, an emulsion, a gel, a solid, a semi-solid, a powder, and the like, capable of being flowed and/or foamed. For instance, material may be foamed and then placed in the container, under pressure, so as to retain the foaminess. In such an instance, the foamed material may include a gas, such as a gas dissolved within the fluid, such as a liquid under pressure. Hence, when the pressure drops, the more volatile gas may leave solution thereby forming a foamed matrix. In some instances, the flowable material may be a prefoamed material, such as where the liquid and/or prefoamed material is retained within a container of the disclosure prior to being foamed and/or delivered. For example, the flowable liquid and/or foamed material may be a drink and/or food item and/or medicine adapted for being imbibed and/or consumed, such as directly from the container, such as by a user drinking or eating or otherwise ingesting the flowable material. In various instances, the flowable material may be one or more liquids, semi-liquids, gels, solids, semi-solids, suspensions, powders, and/or the like.

In some instances, the material is foamable and thus is capable of being foamed such as by the contacting of the material with a foaming agent, such as where the foaming agent is a gas, a liquid, a semi-liquid, a gel, a solid, a semi-solid, a powder, or the like. For instance, in certain instances, the foaming agent may have one form that is convertible to another form, such as when contacted with the flowable material and thereby causing the foamable material to foam. For example, the foaming agent may have one form prior to contact with the foamable material, however, upon contact with the foamable material, the foaming agent may then be converted into another form, such as by forming a gas that may then be contactable with the foamable material, such that upon contact therewith gas bubbles may be formed and/or trapped within the foamable material and/or a matrix therein such as to form a colloid with the foamable material causing it to foam. In other instances, the foaming agent may be configured for being trapped, e.g., in gaseous form, within the matrix of the foamable material, such as in a latent form, which when exposed to the appropriate conditions the foaming agent leaves the matrix and thereby causes the material to foam. In various embodiments, the foaming agent may be a mechanism that is capable of generating a gas that is contactable with the foamable material, such that upon contact between the foamable material and generated gas, bubbles may be foamed and/or trapped within the foamable material, and/or a matrix therein, such as to form a colloid within the foamable material.

In various instances, the foaming agent, therefore, may be a chemical agent, such as a chemical agent that is a liquid, a semi-liquid, a solution, a gel, a gas, a solid, a semi-solid, a powder, and the like. In other instances, the foaming agent may be a mechanical mechanism and in some instances, the mechanical mechanism may be configured for releasing a chemical agent. For instance, in some instances, the foaming agent may be a liquid or a semi-liquid and/or a solution.

In some instances, the material is a material to be flowed, such as from an inside portion of the container to outside of the container, and thus is capable of being flowed such as by the contacting of the material with a propelling agent, such as where the propelling agent is a gas, a liquid, a semi-liquid, a gel, a solid, a semi-solid, a powder, or the like. For example, the propelling agent may have one form prior to contact with the material to be flowed, however, upon contact with the flowable material, the propelling agent may then be converted into another form. Hence, in various instances, the propelling agent may be a chemical agent, such as a chemical agent that is a liquid, a semi-liquid, a solution, a gel, a gas, a solid, a semi-solid, a powder, and the like. In other instances, the propelling agent may be a mechanical mechanism and in some instances, the mechanical mechanism may be configured for releasing a chemical agent.

In a further aspect, a device for foaming and/or flowing a material, such as a material described herein, is provided. In various instances, the device may be part of a containing mechanism such as a container, vessel, receptacle, canister, or the like. Any suitable containing mechanism may be employed so long as it is capable of retaining a material, such as a consumable or otherwise ingestible material, in some instances under pressure. For instance, in various embodiments, the material may be a foamable material that is foamed prior to insertion into a canister; in other embodiments, the material is inserted into the canister in a non or prefoamed state, and then foamed. In such an instance, the prefoamed material may be inserted into the canister, e.g., via a suitably configured insertion valve, along with the foaming agent and/or propellant, for example, under pressure, such as where the foamable material is a liquid, and the foaming and/or propelling agent is a gaseous element, such as where the liquid and gas are phase separated within the canister and maintained therein, such as under pressure. Particularly, in certain instances, the foaming and/or propelling agent may be one or more gasses, such as a gas that is subsumed or otherwise dissolved, or at least partially dissolved within the foamable and/or flowable material, such as to from a solution therewith. And in such instances, foaming and/or flowing may occur because of an increase or decrease of pressure and/or a partial pressure within the canister.

In an instance such as this, the foamable and/or flowable material and foaming and/or propelling agent may combine to form a foam and/or a flowable material such as upon release of the pressure from the canister, for instance, when the canister is opened, and air ingresses into the canister and/or mixing chamber associated therewith and/or when the foaming and/or propelling agent, e.g., gas(es), and/or foamable and/or flowable material egresses from the canister, such as where the ingestion of the foamable material is to be consumed, e.g., by a user wishing to imbibe the foamed and/or flowable material. Where the foamed material is prefoamed prior to being inserted into the canister, or foamed subsequent thereto but prior to release, the foamed material may be imbibed directly from the canister, such as upon opening the canister. In such an instance, the foamable material may be foamed by the foaming agent combining to form a foam such as upon an increase in pressure within the canister, for example, when the foaming agent mixes with the foamable material within a chamber within the canister. Accordingly, in certain embodiments, the foamable and/or flowable material is inserted into the canister and separated from the foaming and/or propelling agent, e.g., phase separated, such as where the foaming and/or propelling agent is a gas and the gas is maintained under pressure. In such an instance, contacting of the foaming and/or propelling agent with the foamable and/or flowable material under pressure converts the foamable and/or flowable material from a first state into a second state.

The present devices, systems, and methods of using the same will now be described in greater detail by way of example with reference to the appended drawings.

Figure 1B:
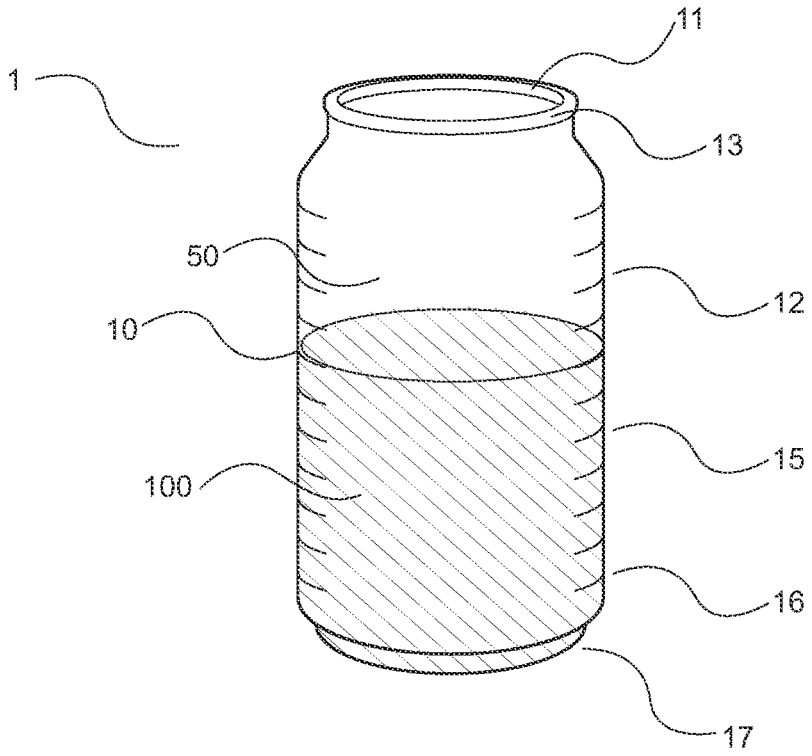
FIG. 1B is a schematic representation of another container, e.g., a soda can, as known in the prior art.

For instance, as can be seen with respect to FIGS. 1A and 1B, a container 1 is provided. The container can be any suitable vessel, such as a canister or bottle 1, for instance, a typical soda bottle or soda can, as known in the art. In various instances, such a vessel may be configured to retain its contents, such as under minimal pressure. The present container may be configured to contain its contents under greater pressure, such as much greater pressure than that of the prior art. The container or other canister of the disclosure can be of any suitable shape and of any suitable size, such as circular, triangular, square, rectangular, round, spherical, cylindrical, pyramidal, cubical, tubular, and the like. As exemplified in FIGS. 1A and 1B, in particular instances, the container 1 may have a body 10, such as an extended body having a proximal portion 12 and a distal portion 16 that are separated from one another by an extended, e.g., medial, portion 15. In particular instances, the extended body 10 may be tubular and therefore may have a curved configuration.

In certain instances, the extended body 10 may be spherical or semi-spherical, e.g., the extended body may have a rounded body configuration. The extended body 10 may be configured such that it at least partially bounds a chamber 50, such as a chamber that is adapted for retaining a material 100 in one or more of its non-foamed, non-flowed, and/or foamed and/or flowable states. In such an instance, the chamber 50 may be bounded by a rounded and/or curved body 10, and may further be bounded by one or more of a distal end 17 and/or a proximal end 11 of the canister, such as a proximal end 11 having threading, or other coupling mechanism 13. In some embodiments, the bounding member 10 may be rigid, semi-rigid, semi-flexible, flexible, and/or the like.

Figure 1C:
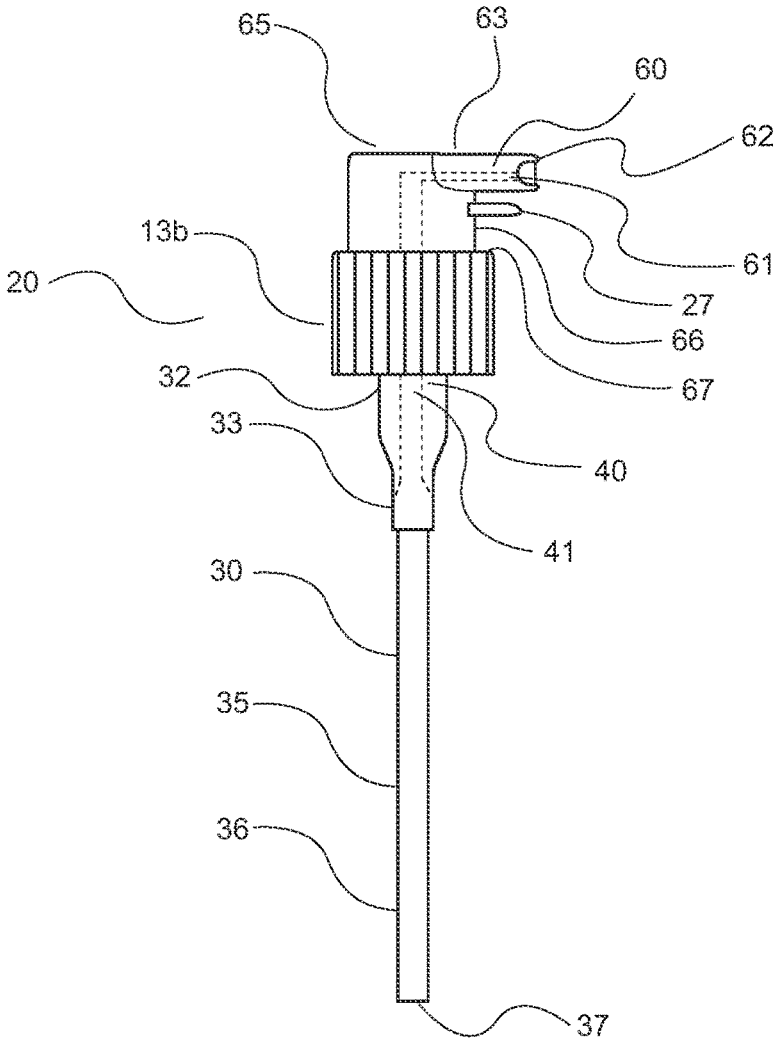
FIG. 1C is a schematic representation of an exemplary delivery mechanism configured as a conversion for a container, such as the bottle of FIG. 1A.
Figure 1D:
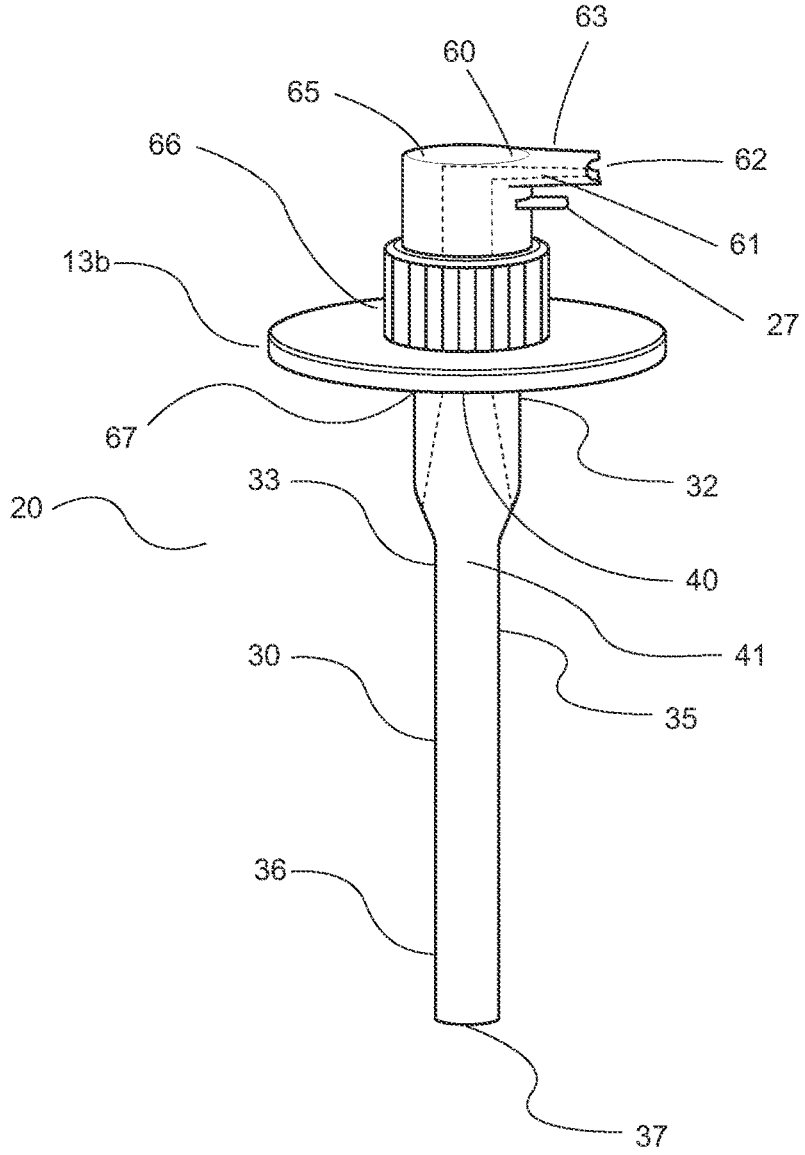
FIG. 1D is a schematic representation of another exemplary delivery mechanism configured as a conversion for a container, such as the can of FIG. 1B.

As can be seen with respect to FIGS. 1C and 1D, in various embodiments, a delivery mechanism 20 may be provided. The delivery mechanism 20 may be configured as a dispensing mechanism that may be adapted so as to be coupled to a device 1. The delivery mechanism 20 may have any suitable configuration so long as it is capable of effectuating the movement of the flowable and/or foamable material 100 from within the container 1 to outside of the container 1. To effectuate such movements, the delivery mechanism 20 may include an elongated hollow and/or tubular member 30, which tubular member may be configured as a feeder or straw element.

The feeder element 30 will include a proximal portion 33, having a proximal end 32, which may be configured so as to be coupled to an outlet of the container 1, such as a nozzle 60, which nozzle 60 may include a passageway 61 that is configured increase velocity of the flowable material and/or pressure within the passageway. Additionally, the feeder element 30 will include a distal portion 36, having a distal end 37, such as where the distal end 37 is configured for contacting the material 100 within the container 1 and functions to receive and/or translate that material 100 out of the container 1. The feeder element 30 will also include a medial portion 35 that separates the proximal portion 32 from the distal portion 36. Additionally, the delivery mechanism 20 may include a container interface 13B, which may be configured for associating the delivery mechanism 20 with the container 1, such as by allowing it to be coupled to a proximal end 11 of the container 1. This coupling may be by any suitable means such as by screwing, snapping, stamping, clamping, crimping, welding, and/or adhering the coupling mechanism 13*b* on to the container 1, and as such the container interface may include suitable snaps, and/or threads, and/or adhesives, and/or deformable gaskets, and the like.

Additionally, as can be seen with respect to FIGS. 1C and 1D, the device 1 may include a delivery or dispensing mechanism 20, as described above, and in some embodiments, the delivery mechanism 20 may be coupled to a nozzle 60, which nozzle may be constructed to be rigid, semi-rigid, semi-flexible, flexible, moveable, and/or articulable. The nozzle 60 will include a proximal portion 63, having a proximal end 62, and a distal portion 66, having a distal end 67. The nozzle will additionally include a medial portion 65 separating the proximal portion 63 from the distal portion 66. The nozzle 60 may have any suitable configuration so long as it is capable of participating in the translation of the flowable material out of the container, such as into the mouth of a user, and in this instance the nozzle 60 is configured so as to include a curve or bend, such as in its medial portion 65, so that as the fluid is drawn up into the nozzle 60, its flow path 61 transcribes an angular arc. The angle between the proximal 63 and distal 66 portions of the nozzle may be any suitable angle from 0 degrees to about 180 degrees, such as from about 45 degrees to about 160 degrees, for instance, from about 60 degrees to about 160 degrees, including about 90 degrees to about 120 degrees. In various instances, the nozzle 60 may have a plurality of bends or curves and/or contain a plurality of angles between its proximal 62 and distal ends 67. In various instances, the nozzle portion 60 may be configured to be movable with respect to the container body 10, such as to facilitate delivery, such as in a pumping towards and away action, and/or ease of use, such as in a rotational or pivotal motion.

In further instances, the container 1 and/or the nozzle 60 may include one or more valve mechanisms 40, which valve may be operably connected to one or more of a control mechanism 45 and/or an actuator 27, such as a trigger, together which valve 40, control mechanism 45 and actuator 27 may be adapted to control the flow of the material 100 out of the container 1, such as through the feeder element 30 and/or nozzle 60. Accordingly, in various instances, a valve 40 is provided, such as where the valve 40 has a conduit 41 there through its length, and is configured for interfacing with a proximal portion 12 of the container 1, and/or a translation member 30 associated therewith, so as to facilitate, e.g., control, the release of the flowable material 100 from within a chamber 50 of the container 1 to outside of the container through an outlet 61 of the nozzle, such as for delivery to a user, e.g., a consumer of the translated flowable material 100.

Figure 1E:
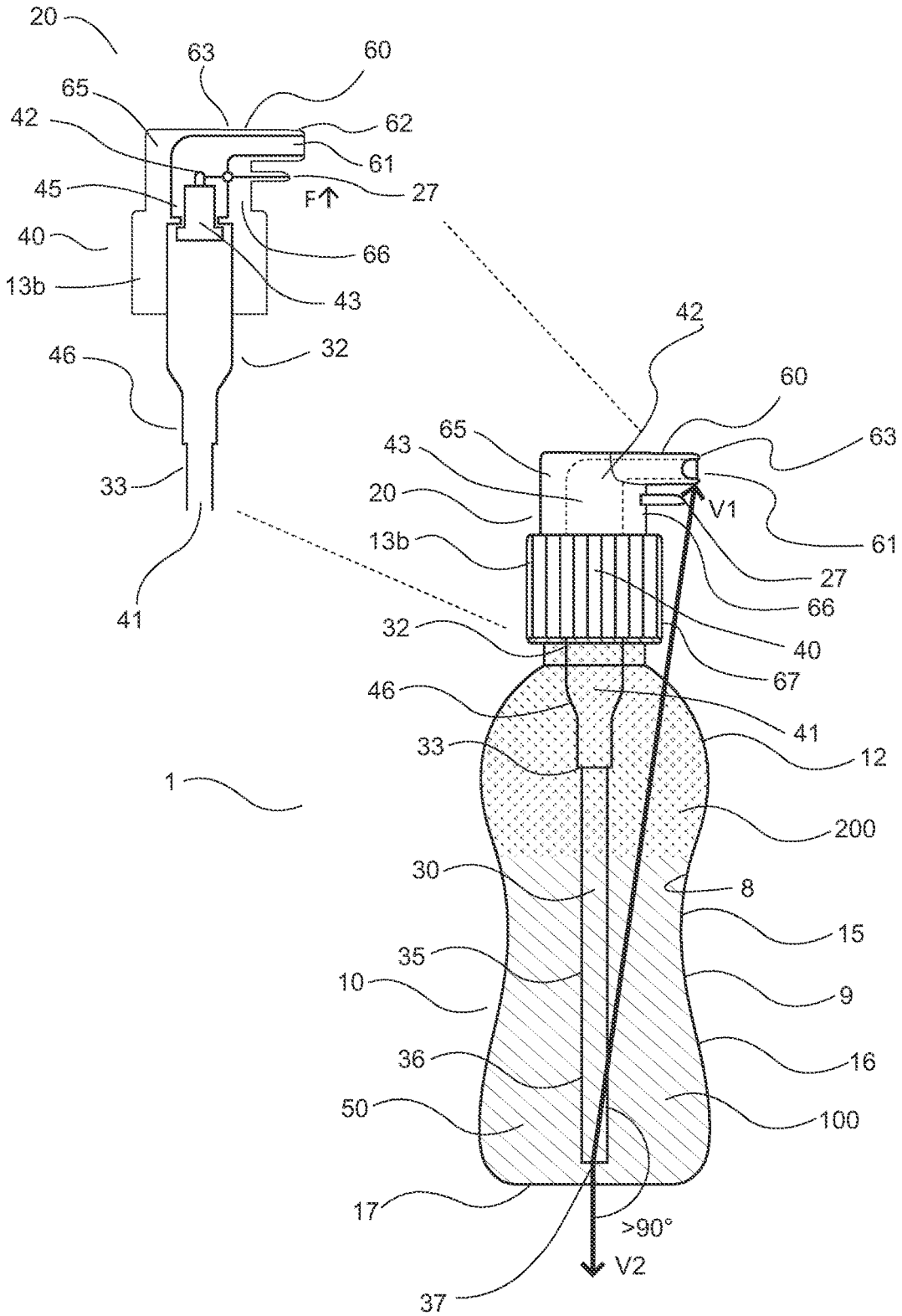
FIG. 1E is a schematic representation of an exemplary embodiment of a container, e.g., configured as a soda bottle, of the present disclosure.
Figure 1F:
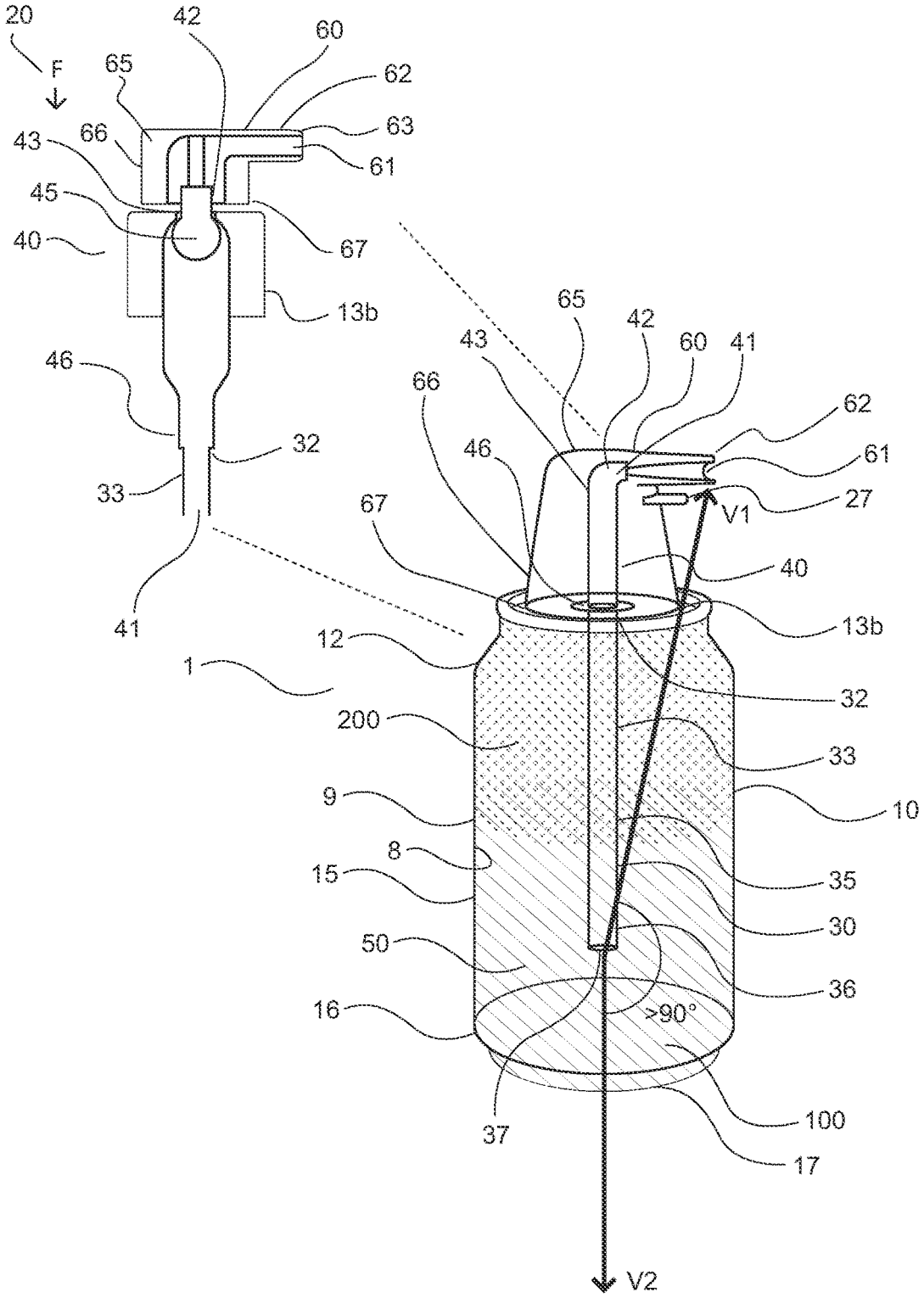
FIG. 1F is a schematic representation of a further exemplary embodiment of a container, e.g., configured as a soda can, of the present disclosure.

As can be seen with respect to FIGS. 1E and 1F, the valve 40 may have any suitable configuration, and may be any suitable size and shape, but in various embodiments, may have a proximal portion 42, such as for interfacing with a distal portion of a nozzle 66, and may have a distal portion 46, such as for interfacing with a portion of the container 1, e.g., a portion of the container bounding an opening or conduit therein, or a 33 proximal portion of the translating element 30 associated therewith. The valve 40 may also have medial portion 43, between the proximal 42 and distal 46 portions, such as where the medial portion 43 has a bend therein, for instance, a bend that corresponds to a bend in the nozzle 60. In various embodiments, the valve 40 itself may be configured for interfacing directly with a user of the container 1, and/or for interfacing with some other dispensing mechanism 20, associated therewith, such as for dispensing the fluid therein to a user. Typically, the valve 40 will have an orifice 41 extending the length of the valve 40, such as an orifice for translating the flowable and/or foamable material 100 through the valve, such as for controlling the dispensing of the flow of the foamable material out from a chamber 50 of the container 1.

In such instances, the valve 40 may be a control valve, such as a control release valve 45 that upon activation allows and/or facilitates the flow of the flowable and/or foamable material 100, e.g., in the foamed state, out of the container 1, such as by interfacing with the outlet of the container 1 and/or one or more translation members 30 associated therewith. Such activation may be through operation of an actuator 27, as depicted in the cutout portion of FIG. 1E, which actuation may result from an upwards force (F) being applied to the actuator 27 causing the control valve 45 to lower relative to the nozzle portion 60, thereby opening the valve 40; or through actuation of the nozzle portion 60, such as by asserting a downwards force (F) by depressing the nozzle 60 relative to the container 1, as depicted in the cutout portion of FIG. 1F, which depression moves the nozzle portion 60 downwards towards the container 1, actuating the valve 40 so as to open up and thereby connect the passageways 41 and 61 thereby allowing for release of the contained material(s). It is to be understood that the configuration of the valves 40 as detailed herein are for exemplary descriptive purposes only, and can be configured to function in a number of different ways to effectuate delivery of the consumable material 100, such as by the application of forces from different directions of exertion with the corresponding adjustments being made to the delivery mechanism 20 and/or valve 40 componentry. Hence, the valve 40 may be operably connected with a control mechanism 45. Such a control mechanism 45 may have any suitable configuration so long as it is capable of facilitating and/or controlling the movement and/or release of the material 100 out of the container 1, such as in a controllable manner, e.g., with respect to one or more of flow rate, density, pressure, temperature, aeration, intermixing between gases and flowable material, foaminess, and/or contour of the flowable material.

For instance, the control mechanism 45 of the valve 40 may be configured as a simple push or pull valve, or other control element that turns flow on or shuts it off, such as by opening or closing the passageway 41 or conduit there through. The action of opening and/or closing of the passageway 41 may be effectuated by any suitable mechanism, such as by articulating or otherwise rotating or pivoting about a hinge or pivot point, such as in a flap valve configuration. In some instances, the valve 40 may include an obstructing member 48, e.g., a flap member, plunger, or ball, that can controllably articulate within a passageway 41, such as by at least partially impinging or non-impinging the passage therein. In such instances, the control mechanism 45 of the valve may include a biasing, e.g., a spring, element that is operably connected to the obstructing and/or occluding member 48, such as a diaphragm, wherein based on the condition of the spring element, e.g., in its compressed or non-compressed (e.g., biased) form, the passageway may either be opened or closed or partially there between, such as by the positioning of the diaphragm in relation to the diameter of the passageway, which positioning may be governed by the spring element, such as via the control mechanism 45 and/or actuator 27. In various instances, the dimensionalities of the valve 40 and/or passageways 41 and/or 61 may be controlled by mechanics and/or electronically, and the valve 40 may be configured as a hydraulic, pneumatic, solenoid (piston), motorized, electronic, and/or manually operated valve.

In certain instances, the valve may be a one-way (one-directional), two-way (bi-directional), or three or more way (multi-directional) valve, which may allow the fluid within the passageways to flow in one, two, three, or more directions through the system. For example, the valve may be a check valve that is at least partially opened by the flow of material from greater pressure or temperature to lower pressure or temperature, but closes in the absence of such a pressure and/or temperature gradient. Such a valve may be operated, e.g., opened, by flow in one direction, and closed by flow in the opposite direction, and/or in various instances, may be opened or closed manually, mechanically, electrically, and/or by the suction, vacuum, and/or blow forces exerted on the system by a user of the device 1.

The control mechanism 45 of the valve 40 may be configured so as to be operated by a control element 45*a*. The control element 45*a* may be a mechanical element, such as a handle, lever, a twist valve, tilt valve, bite valve, crimp valve, depressible button, switch, turn knob or wheel, twist screw, vacuum or suction activated valve, diaphragm, and/or the like, and in some instances, the control element 45*a* may be an electronic actuator. In either instance, the control element 45*a* may be configured for effectuating the opening and closing and/or diameter of the valve 40 and/or the passageways 41, 61 associated therewith. For instance, the control element 45*a* may be configured for effectuating the opening and closing via mechanical operation, or the opening and closing may be effectuated through receipt of an electronic signal or impulse that then automatically controls the opening or closing of the valve, e.g., through an electronically controlled mechanical actuator, e.g., a motor.

Particularly, in various embodiments, the valve mechanism 40 and/or control mechanism 45 and/or control element 45*a* (or 45*b*) may be controlled via a controller, such as valve actuator 27. More particularly, the valve actuator 27 may be configured for controlling a control mechanism 45 and/or control element 45*a*/45*b* that is adapted for controlling the opening and/or closing and/or diameter of the passageway 41 of the valve 40 through which the material 100 flows. Such a valve actuator 27 and/or controller 45 may include a control mechanism configured to control the condition of one or more of the valve elements 40 of the system, such as based on the various inputs it receives thereby allowing the one or more valves 40 of the system to be accurately positioned thereby allowing minute control of the flow through the system based on a wide variety of system conditions (e.g., pressure, temperature, foaminess, flow rate, etc.) and/or user selected and/or controlled configurations, e.g., by selecting which valves will be opened, to what diameter, how, when, and under what conditions. Hence, the valve 40 may be configured so as to control the flow through a passageway 41 and/or 61 of the container 1.

Accordingly, in certain instances, the delivery mechanism 20 may be configured so as to be associated with a feeder element 30. For instance, the delivery mechanism 20 may be configured such that it associates the proximal portion 33, e.g., the proximal end 32, of the feeder element 30 with the distal end 67 of the nozzle 60. This association may further be mediated, such as by control valve 40 and/or control mechanism 45. In such instances, the distal portion 36 of the feeder tube 30 may be configured for contacting the flowable material 100 and facilitating translation of the flowable material into and through its body, such as through its distal end 37, for instance, in response to activation of the control actuator 27.

Additionally, as can be seen with respect to FIGS. 1E and 1F, the shape and/or dimensions of the nozzle 60 and/or delivery mechanism 20, the passageways 41, 61 there through as well as the feeder element 30, may be configured with respect to one another such that there is an angle between these elements or parts thereof. For instance, the container may include a delivery nozzle 60 having a proximal portion 63 and a distal portion 66 together which form pathways 41, 61 from the container 1. In such an instance, the distal portion 66 of the nozzle 60 and/or delivery mechanism 20 may include an inlet aperture, e.g., 61, for receiving the flowable material 100. Furthermore, in some of these instances, the inlet aperture 41 may further be associated with a feeder element 30, such as via a proximal portion 33 thereof, where the feeder element 30 has a distal end 37, having a corresponding inlet aperture 41 passing there through, which inlet aperture may be in contact with the foamable and/or flowable material 100 to be delivered. Further still, pathway 41, 61 of the delivery mechanism 20 and/or nozzle 60 may pass through a proximal portion, e.g., 63, having an exit aperture 61, such as where the passageway 61 may be adapted to deliver the ingestible substance to the mouth of the consumer, and in various instances, the proximal portion 63 of the nozzle 60 may be sized and adapted to be received and/or conformed directly by a mouth of a consumer.

In particular instances, the angle between the feeder tube 30 and/or the delivery mechanism 20 and/or the nozzle 60, and/or the various inlet/outlet apertures, and/or passageways thereof, may range from 0 degrees to 180 degrees in the positive or negative direction. For instance, the nozzle 60 and/or the delivery mechanism 20 may be configured and/or positioned in relation to one another and/or the feeder element 30 such that there is an angle between them, which angle may be between about 10 or 15 degrees and about 140 degrees or 160 degrees, such as between about 20 or 30 degrees and about 110 or 120 degrees, for example, between about 45 or 60 degrees and about 90 or about 100 degrees, including about 75 degrees. Further, in some instances, there may be a curve between these elements, which curve may have a radian equivalent to the angles detailed herein. Particularly, the configuration between the feeder element 30, delivery mechanism 20, and/or nozzle 60 may be such that while the ingestible substance 100 is delivered, the inlet aperture, e.g., of the feeder element 30 and/or delivery and/or control mechanism 20 and/or nozzle 60 or their component parts, is proximate a portion, e.g., 16 or 17, of the container 1 that is closest toward the center of the earth, and an angle between a vector (V1) from the inlet aperture, e.g., of the feeding mechanism 37, to the exit aperture 61, e.g., of the delivery nozzle 60, and a vector (V2) from the inlet aperture, e.g., of the feeding mechanism 37, to the center of the earth is greater than about 90 degrees but less than about 180 degrees, such as about 120 to about 160 degrees or there between.

In various instances, a valve mechanism 40 may be included and be associated with one or more of the delivery nozzle 60, the delivery mechanism 20, and the feeding mechanism 30, which feeding mechanism 30 may be associated with the first cavity 50 of the container 1 so as to access the ingestible substance 100 therein. Hence, in particular instances, the valve mechanism 40 may have a controllable valve 45 that is configured to regulate a flow of the ingestible material 100 from an inlet aperture of the feeding mechanism 37 in a first cavity 52*a* of chamber 50, such as through a pathway 41 to delivery mechanism 20 formed by the delivery nozzle 60 and to the exit aperture 61 of the delivery nozzle. In various instances, the proximal portion 63 of the nozzle 60 and/or exit aperture 61 may be flexible and/or may have a shape and/or configuration adapted to be closely and comfortably associated with the mouth of a user.

In such an instance, the inlet aperture 41 and/or 61 may be orientated with respect to the container 1, and the material 100 to be delivered, such that the inlet, e.g., 37, 46, 67, is closest to the center of the earth. In various instances, the reverse may be the case such as where the outlets 61, 42, and/or 32 are closest to the center of the earth when the container 1 is in use. This may be useful so as to assure that the maximal amount of contents 100 are capable of being expelled without the substantial loss of propellant 300, regardless of the orientation of the container 1 when employed for delivery. Particularly, in certain particular embodiments the container 1 may be configured with the specific gravities of the materials to be contained and employed in performing a delivery in mind, such that the specific gravity of the flowable and/or foamable material 100 is greater than that of the foaming agent 200 and/or propellant 300, such that the material to be delivered 100 will naturally center itself by the force of gravity within the container 1 so as to be positioned closest to the center of the earth during delivery.

Specifically, where the material to be delivered 100 is a liquid or flowable material, and the propellant 300 and/or foaming agent 200 is a gas, or a liquid or fluid with a lesser specific gravity, the component with the lesser specific gravity will form one or more layers on top of the layer with the greater specific gravity, and thus, dependent on the particular specific gravities and orientation of the fluids relative to one another to be delivered, the container 1 can be configured to preferentially deliver one fluid over the other and/or in one orientation over the other, such as by being held with the nozzle 60 further away from the earth's center of gravity, where the flowable substance 100 with the greater specific gravity will rest at the bottom 17 of the container, and therefore be delivered in preference over the fluid with the lesser specific gravity, such as where the feeder tube 30 extends proximate the bottom portion 16 of the container; or by being held with the nozzle 60 closest to the earth's center of gravity, where the flowable substance 100 with the greater specific gravity will rest at the top 13 of the container 1, such as where the feeder tube 30 extends proximate the top portion 12 of the container 1.

Accordingly, in such an instance, the inlet, e.g., of one or more of the feeder tube 30 or delivery mechanism 20 or the nozzle 60, may be designed so as to be proximate the material to be delivered 100, e.g., at the lower or lowest point of the material, when the container is positioned in its configured use orientation. This is particularly useful for preventing the loss of foaming agent and/or propellant as well as assuring that the maximal amount of the contents are capable of being expelled. For instance, the container may be configured so that in intended use the container may be orientated during dispensing such that the feeding point will be closest to the center of gravity at its intended use orientation, which will require a long feeding tube or short feeding tube or no feeding tube at all dependent on the specific gravities, desired use orientation, and resultant configuration of the container and its components. In various instances, the interior surface 8 of the cavity may be contoured so as to effectuate the desired flow characteristics, for example, the interior bounding walls may be configured to effectuate a funneling type flow of the fluids prior to delivery.

Figure 2A:
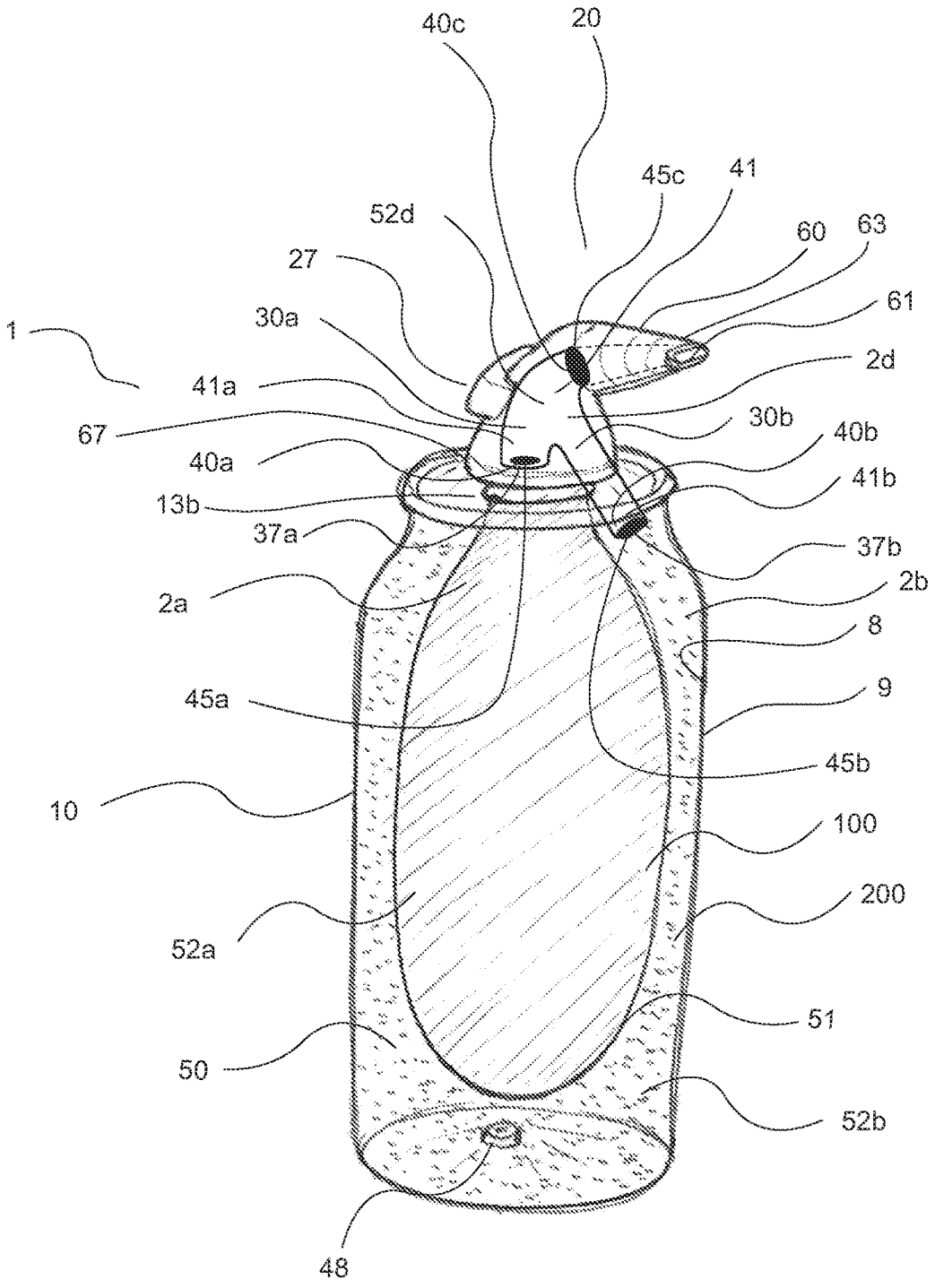
FIG. 2A is a schematic representation of an additional exemplary embodiment of a container of the present disclosure, where the container includes a propelling mechanism configured as a stretchable membrane.
Figure 2B:
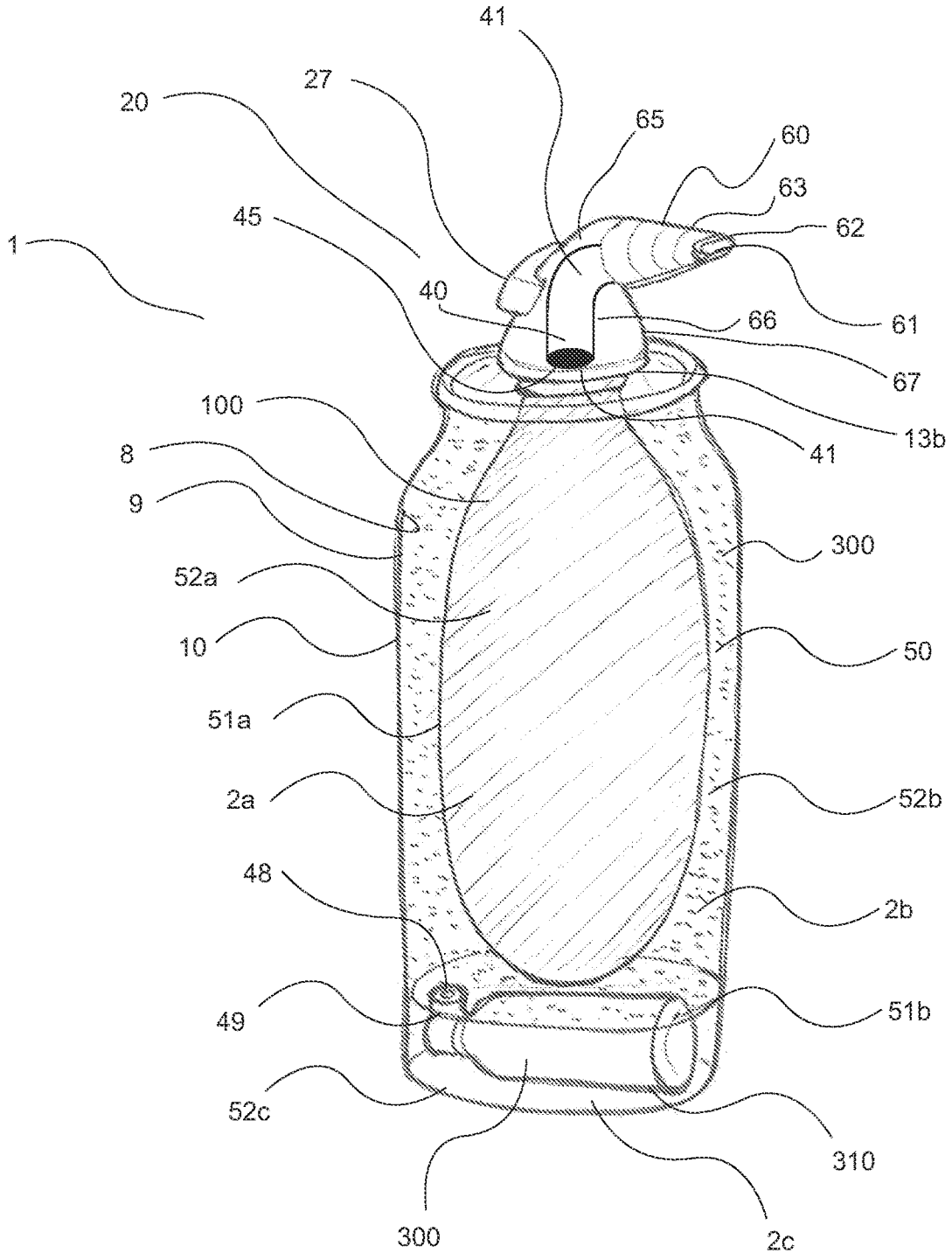
FIG. 2B is a schematic representation of a further exemplary embodiment of the container of FIG. 2A, where the container includes a secondary propelling mechanism configured as an auxiliary propelling canister.
Figure 2C:
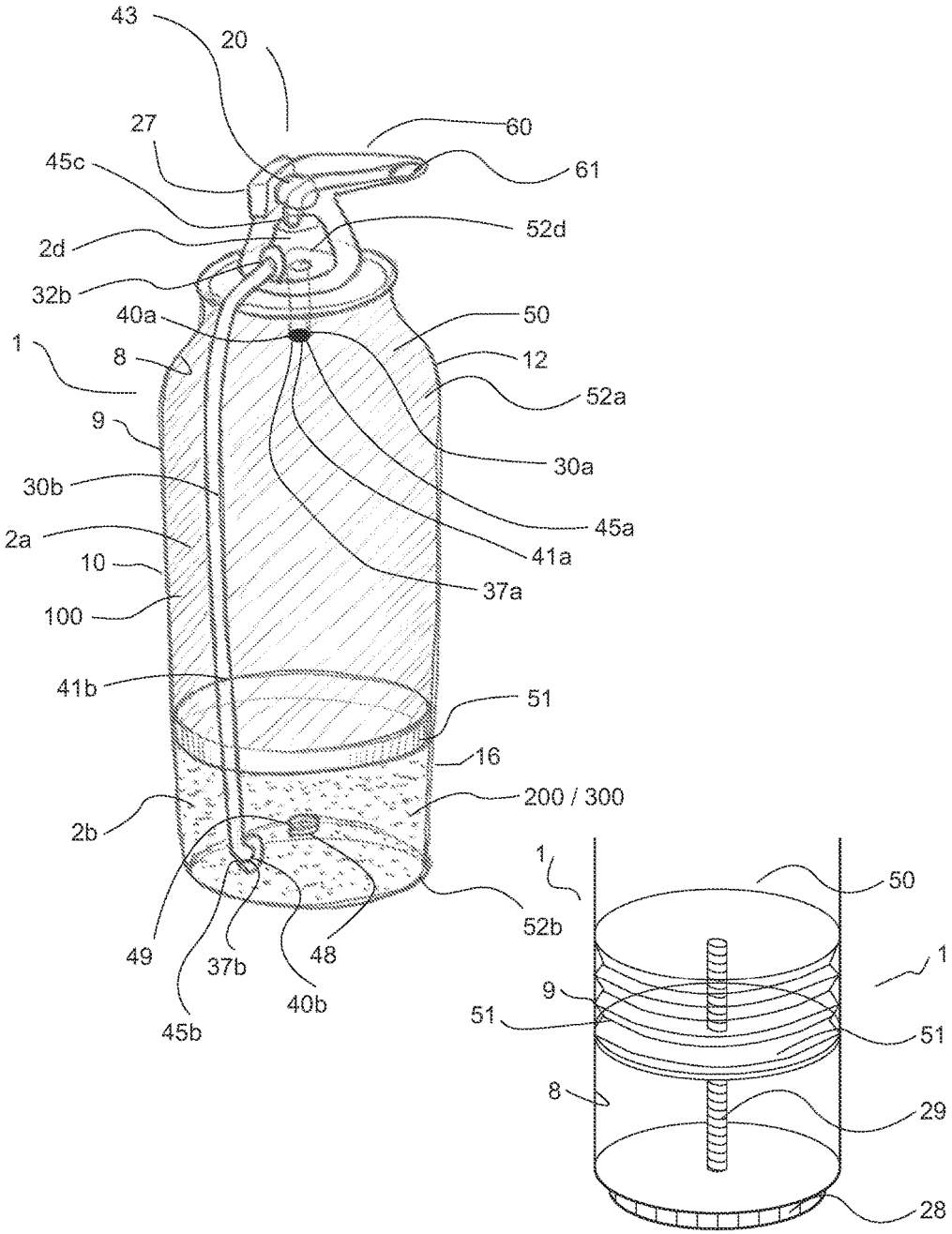
FIG. 2C is a schematic representation of another exemplary embodiment of a container of the present disclosure, where the container includes a propelling mechanism configured as a moveable platform.

As can be seen with respect to FIGS. 2A-2C, in particular instances, the container 1 includes an elongated body 10. The elongated body 10 is formed of an interior surface 8 and an exterior surface 9. As depicted, the elongated body 10 is rounded or curved so as to be cylindrical and tubular, such that the interior and/or exterior surfaces transcribes an arc, e.g., of 360 degrees, thereby forming a chamber 50 within its bounds, in such an instance the interior surface 8 is positioned so as to face the interior of the chamber 50. However, in various instances (not depicted), the body 10 of the container may be configured so as to include a plurality of walls, such as a plurality of opposed walls that together form edges in such a manner as to bound the chamber 50.

For instance, the container may be formed as a cube having front and back surfaces that are separated one from the other by one or more side portions, such as by a pair of opposed side surfaces. However, as depicted in FIGS. 2A-2C, the extended body 10 of the container 1 is comprised of one or more surfaces that are configured in a tubular form such as where the extended body 10 is elongated and/or curved and includes a single bounding member that separates the inside of the cavity 50 from the outside of the canister, and is thus composed of interior and an exterior surface portions. In various instances, the container may also include a top surface and a bottom surface to further bound the top and bottom of the chamber 50.

Regardless of the shape of the container, the extended body member 10 may be configured for bounding a chamber 50. The bounding member 10 may be rigid, semi-rigid, semi-flexible, flexible, or a combination thereof. In various embodiments, the chamber 50 may include a plurality of interior portions, e.g., sub-chambers or cavities 52, wherein the interior surface 8 of the extended body 10 forms a bounding member for the chamber 50, and may further bound one or more lumens, e.g., 52*a*, 52*b*, and/or 52*c*, within the chamber 50, such as where each lumen may be bounded at least partially by the bounding member 10. In such instances, one or more of the cavities and/or one or more lumens may be configured for retaining one or more of a flowable and/or material to be foamed 100, and/or a foaming agent 200, and/or a propellant 300.

As indicated, the flowable and/or foamable material 100, which may be contained within the chamber 50, or a sub-chamber or lumen thereof 52*a*, of the container 1, may be any material capable of being foamed and/or flowed, such as by being converted from a first, non-foamed and/or non-flowable state, into a second foamed and/or flowable state. For example, a typical foamable and/or flowable material 100 may be a gas, liquid, semi-liquid, solution, gel, solid, powder, and/or catalyst that may be contained within the container, and in some instances may be such that when contacted and/or mixed with the foaming agent is converted from being non-foamed into being foamed.

Further, as indicated, a suitable foaming agent 200, which may be contained within one or more lumens, e.g., 52*b*, of the container 1, may be any agent that is capable of converting a non-foamed material into a foamed material, such as when applied to, contacted with, or otherwise mixed amongst the non-foamed material. For instance, a foaming agent may be a gas, liquid, semi-liquid, solution, gel, solid, powder, and/or catalyst that when introduced to and/or mixed with the foamable material converts the foamable material from being substantially non-foamed into being foamed. In various instances, the foaming may be instantaneous upon mixing, or may be upon activation, such as pursuant to an activating event.

In various instances, such as depicted in FIG. 2B, a suitable propellant 300, which may be contained within one or more lumens, e.g., 52*b* and/or 52*c*, of the container 1, may be any agent that is capable of associating with one or more of the flowable and/or foamable material 100 and/or foaming agent 200 and causing the one or more of the material 100 and/or foaming agent 200 to be moved from one position to another, such as within or out from the container, such as for causing the material 100 and/or foaming agent 200 to be expulsed from the chamber 50 of the container 1, such as when the container is opened. For example, a propellant 300 may be a gas, liquid, semi-liquid, solution, gel, solid, powder, mechanical element, and/or catalyst that when introduced to and/or mixed with the flowable and/or foamable material 100 and/or foaming agent 200 causes the one to move with respect to the other and/or causes both to move, such as from within the container 1 to outside of the container 1, e.g., through one or more nozzles 60 and/or valves 40 and/or translating elements 30, or passageways 41, 61 therein, as herein described.

Accordingly, with respect to FIGS. 2A-2C, in various instances, a container 1 is provided wherein the container includes a chamber 50, which chamber can be subdivided, e.g., by one or more partitions or dividers 51, into sub compartments or sub-chambers, e.g., 2*a*, 2*b*, and/or 2*c*, etc., such as where each sub compartment has its own lumen or cavity, e.g., 52*a*, 52*b*, and/or 52*c*, etc. For instance, the container 1 may have a chamber 50 that is further divided into first, second, third, fourth, fifth, etc., lumens, such as by being separated by dividers, e.g., 51*a*, 51*b*, and/or 51*c*, etc. For example, as can be seen with respect to FIG. 2A, in some instances, a container 1 is provided wherein the container 1 includes at least a chamber 50 with at least a first lumen 52*a* and a second lumen 52*b*, such as where the first lumen 52*a* is configured for retaining the flowable and/or foamable material 100, and the second lumen 52*b* is configured for retaining the foaming agent 200 and/or propellant 300, such as where the first 52*a* and second lumen 52*b* are separated from one another, such as by a divider 51, which divider 51 may be an expandable, flexible, or otherwise stretchable membrane that is capable of expanding, such as to receive a foamable and/or flowable material 100 therein. Accordingly, in some embodiments, a container 1 is provided wherein the container is configured to include a first 2*a* and a second 2*b* container portion, so as to at least form a chamber 50 where the chamber 50 includes at least a first lumen 52*a* and a second lumen 52*b* where the two lumens are separated by a divider 51.

However, as can be seen with respect to FIG. 2B, in various embodiments, the container 1 may be configured to include a third container portion 2*c*, and may, therefore, additionally include a third lumen 52*c*. For instance, the first container portion 2*a* may include lumen 52*a*, which lumen 52*a* includes the flowable and/or foamable material 100, and the second container portion 2*b* includes lumen 52*b*, which lumen 52*b* includes one or more of a foaming agent 200 and/or propellant 300, such as where the foamable material 100 and the foaming agent 200 and/or propellant 300 are separated from one another by a divider 51*a*. Additionally, the container 1 may include a third container portion 2*c* that includes a third lumen 52*c*, which third lumen 52*c* may include one or more of a foaming agent 200 and/or propellant 300, such as where the contents contained within lumen 52*b* are separated from the contents contained in lumen 52*c* by a divider 51*b*. In particular instances, the foaming agent 200 and/or propellant 300 may be retained within an auxiliary chamber unit 310.

Further, as configured in FIGS. 2A and 2B, the flowable material 100 may be retained within a first lumen 52*a* within a first container portion 2*a*, and the foaming agent and/or propellant 200/300 may be retained in a second lumen 52*b* within a second container portion 2*b*, in such a manner that the two materials do not intermix, such as where the two lumens are separated by an expandable, resilient, non-permeable membrane that functions as a divider 51, which membrane may also serve as a mechanical propellant, e.g., which may be due to its expandability and/or elasticity. In various instances, the membrane 51 may be permeable or semi-permeable. Additionally, as depicted the material to be delivered 100 is retained within the compartment 2*a*, and the foaming agent 200 and/or propellant 300 is retained within the compartment 2*b*. As depicted in FIG. 2A, the lumen 52*b* contains a foaming agent 200, and as depicted in FIG. 2B, the lumen 52*b* contains a propellant 300.

However, in various other instances, the material to be delivered 100 may be retained within the compartment 2*b*, while the foaming agent 200 and/or propellant 300 may be retained within the compartment 2*a* and/or the nozzle 60 positioned in relation to the elongated body 10 to accommodate such a change in configuration. Further, in these and other such embodiments, the elastic divider portion 51 and compartment 2*a* may be in a reverse orientation as depicted, so as to couple to the distal portion 16 of the container 1, such as in relation to an inlet positioned therein, which inlet may be employed so as to fill the chamber 2*a* with one or more of the material to be delivered, the foaming agent, and/or the propellant. In such an instance, the filling or the releasing of the contents within the chamber 2*a* may effectuate the delivery of the foamable and/or flowable material 100.

Figure 3:
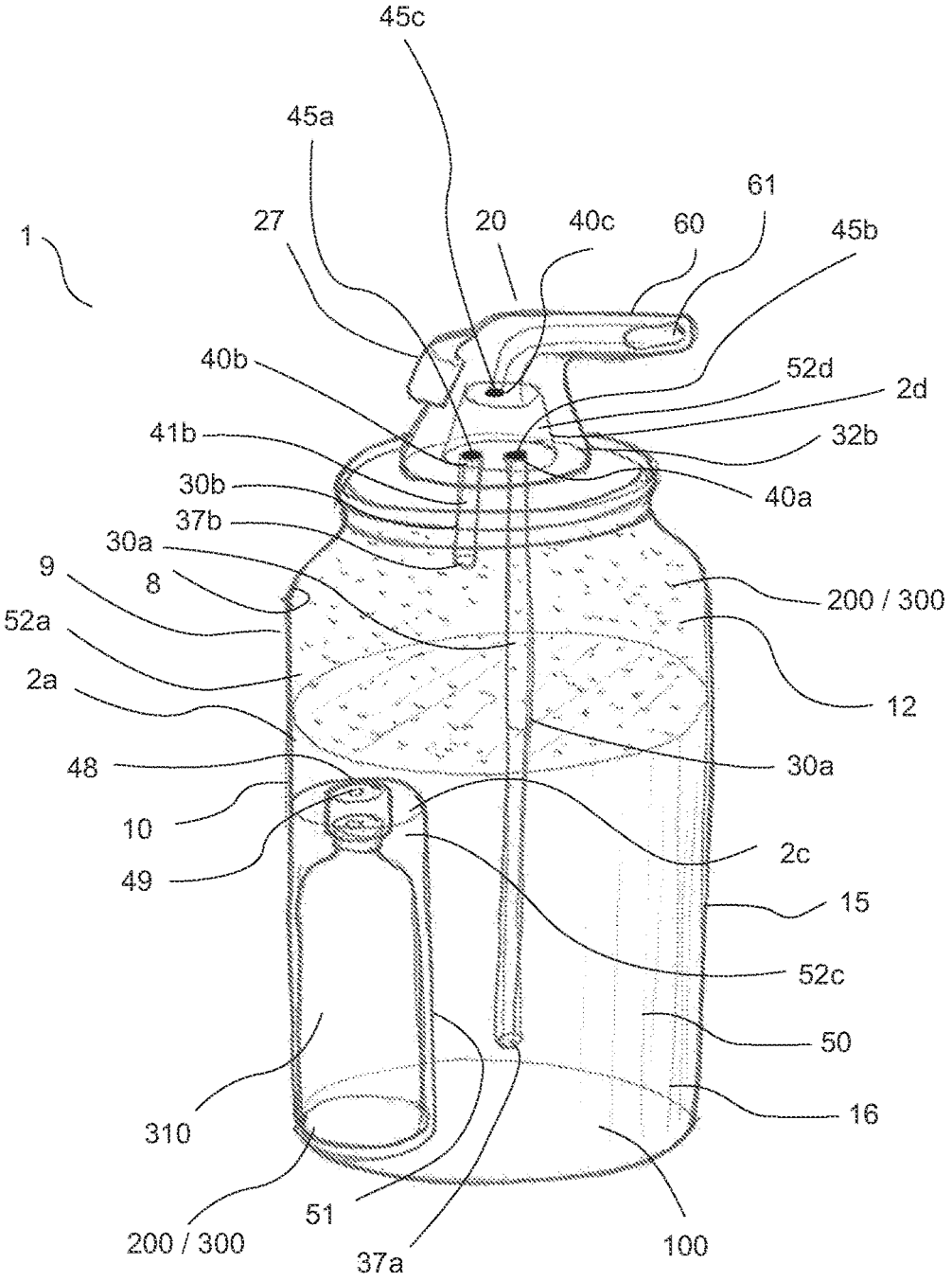
FIG. 3 is another schematic representation of a further exemplary embodiment of a container of the present disclosure, the container including an auxiliary foaming and/or propelling member chamber.

In certain instances, as depicted in FIGS. 2B and 3, the container 1 may be configured such that it includes at least two chambers, such as where one or more of these chambers may be configured for receiving an insertable and/or removable chamber unit 310, such as a cartridge or cylinder, for instance, a cartridge 310 for containing one or more of a propellant 300, and in some instances may include a foaming agent 200 and/or a foamable material 100. For example, as depicted in FIG. 2B, the container 1 may be configured to include a first chamber 50 having a first 2*a* and a second 2*b* chamber portion, such as a first chamber portion 2*a*, for containing a flowable and/or foamable material to be delivered; and may include a second chamber portion 2*b*, for containing a foaming 200 and/or propelling 300 agent, which in this instance is a propelling agent. Further, the container 1 may include a second chamber 2*c*, such as for containing an additional auxiliary chamber unit 310, such as for containing an additional propellant 300. Specifically, as can be seen with respect to FIG. 2B, the chamber portion 2*c* may have a cavity 52*c* that may be adapted for receiving an insertable and/or removable chamber unit 310 containing the propellant 300.

Additionally, as can be seen with respect to FIG. 3, the container 1 may have a first chamber 50 having a first chamber portion 2*a* for retaining both the material to be delivered 100 and a foaming agent 200 and/or propellant 300, such as where these components share the same cavity 52*a*. The container may also include a second chamber 2*c* that may have a cavity 52*c* that may be adapted for receiving an insertable and/or removable chamber unit 310 containing the foaming agent 200 and/or propellant 300. In such instances as depicted in FIGS. 2B and 3, the cartridge 310 may be configured as a foaming member 200, such as where the foaming agent is a gas, such as nitrous oxide, carbon dioxide, oxygen, an inert gas, and the like, that is retained under pressure in the cartridge 310, which cartridge 310 may be fitted within the chamber 52*c* of the container 1. And as indicated, in other instances, the cartridge 310 may be configured as a propellant 300, such as where the propellant is a gas that is retained under pressure in the cartridge 310.

Further, in such instances, the container 1 may include one or more conduits, such as a conduit 48 forming a passageway by which two or more of the chambers and/or cavities may communicate one with the other. In certain instances, conduit 48 may be controlled by a flow control mechanism 49, which may be configured to regulate communication between the various chambers. Such a control mechanism 49 may have any configuration adapted to control the flow through the passageways, e.g., 48, such as upon an activation event. For instance, the control mechanism 49 may be configured for multiple uses, such as a controllable valve, or may be a single use seal that is sealed and thereby prevents communication but then allows such communication once opened. Such a seal may be opened by the application of a force, such as a shear force, by puncturing, bursting, piercing, tearing, fracturing, translating, bending, deforming, displacing, dissolving, burning (pyrotechnic meltable), a needle and seat valve, and the like.

As indicated, in various instances, the passageway of the conduit 48 may further include a valve 49, such as a control valve, which is configured for controlling the flow of the foaming agent 200 and/or propellant 300 out of the cartridge 310, and/or out of chamber 2*c*, through the conduit 48, and into the cavity 52*a* or 52*b*, such as the cavity containing one or more of the flowable and/or foamable material 100 and/or foaming agent 200 and/or propellant 300, such as for intermixing therewith. Hence, once the cartridge 310 containing the foaming agent and/or propellant is coupled with, e.g., inserted into, the container 1, and the control valve 49 opened, the foaming agent and/or propellant may be released out of the cavity 52*c*, through the conduit 48, and into the cavity 52*a* or 52*b*, such as via actuation of an actuator 27 operably connected to the control valve 49, so as to intermix the foamable material 100 with the foaming agent 200 and/or to convert the material 100 from a non-foamed to a foamed state, and/or so as to intermix the flowable material 100 with the propellant 300, and/or so as to propel the material 100 out from the container. Accordingly, in various instances, the communication between the various chamber portions 2*a* and/or 2*b* and/or 2*c* and/or 2*d* (as set forth below) may be controlled by the actuator 27, or may be separably controlled, such as by individually or collectively controllable actuators.

As noted above, in this and other instances described herein, the foaming agent and/or propellant may include one or more elements that when admixed causes an exothermic or endothermic or other reaction that transfers thermal energy in such a manner so as to create a temperature differential, such as between the temperature prior to admixture and subsequent thereto, such as an increase or a decrease in temperature, such as within a chamber of the canister. For instance, any consumable chemical agent that undergoes a physical change, such as from a solid to a liquid and/or gas, or vice-versa, with a resultant temperature change, such as an increase or decrease in temperature, for instance, due to occupying more or less space within the chamber after the change in form, may be employed in this manner. Accordingly, in various embodiments, the temperature change may accompany a change in pressure, such as where there is a pressure change, the resultant change in pressure may produce a change in the temperature, or vice-versa, either higher or lower, such as of the foamable and/or flowable material, which change in pressure may be produced for the purpose of causing the foamable material to foam, such as prior to dispensing. In certain instances, the change in temperature may be produced for the purpose of heating or cooling the foamable material, such as prior to dispensing Additionally, in various instances, the foaming agent and/or propellant may include one or more elements that when admixed, e.g., with one another or the foamable material, causes an exothermic or endothermic or other reaction that transfers energy within the system in such a manner so as to create a pressure differential, such as between the pressure prior to admixture and subsequent thereto, such as an increase or a decrease in pressure, such as within a chamber of the canister. In various embodiments, where there is a pressure change, the resultant change in pressure may be accompanied with a change in the temperature, either higher or lower, such as of the foamable material. For instance, any consumable chemical agent that undergoes a physical change, such as from a solid to a liquid and/or gas, or vice-versa, with a resultant pressure change, such as an increase or decrease in pressure, for instance, due to occupying more or less space within the chamber after the change in form, may be employed in this manner. In such an instance, the change in pressure and/or temperature may be for one or both of converting the foamable material from a non-foamed and/or flowable material to a foamed and/or flowable material and/or the change in temperature and/or pressure may be for the purpose of heating or cooling the temperature of the flowable and/or foamed material.

Accordingly, as set forth above, the addition of the foaming agent and/or propellant to the foamable material may be accompanied by a change in pressure which may result in a temperature change within the canister. For example, a drop in pressure, such as caused by a gas leaving solution by moving into a larger space may result in a coincident lowering of temperature of the remaining solution. Particularly, as a gas expands over an increased volume the temperature within the chamber may drop.

Likewise, an increase in pressure, such as caused by a gas being compressed into a smaller space may result in a coincident increase in temperature. Particularly, as increased gas moves into a confined space, such as by more gas entering into solution, the temperature of the chamber and/or resultant solution may be raised, such as due to an increase in thermal energy caused by the gas. More particularly, in various instances, the foaming and/or propelling agent may be in a gaseous form, such as carbon dioxide, nitrous oxide, hydrogen, helium, argon, other noble gas, compressed air, and the like, wherein the gas is contained within a canister, such as a removable canister, and the control release conduit controls the flow of the gas into the chamber containing the foamable and/or flowable material, whereby upon mixing of the gas with the foamable and/or flowable material one or more of a pressure gradient and/or a temperature gradient is formed and/or a foamed and/or flowable material is produced, such as by the mixing of the foaming agent and/or propellant with the foamable and/or flowable material, such as in the presence of a pressure and/or temperature gradient, which may or may not result in an increase or decrease in temperature of the resultant flowable and/or foamed material. In various instances, the foaming agent may also be a propellant or may include a propellant. Accordingly, in one aspect, the disclosure is directed to the conversion of a foamable material from a first, non-foamed state to a second, foamed state, such as by the introduction of a foaming agent and/or propellant into the foamable material, for instance, for the production of a consumable foamed material end product having a desired amount of foaminess.

For example, the foamable material and the foaming agent and/or propellant are selected such that when admixed the foamable material is converted from a non-foamed state to a foamed state wherein in the foamed state, the foamable material has a colloidal structure that is characterized by the amount of foaming agent that is trapped within the colloid. In various instances, the foamed composition includes 98% of foamable material and 2% foaming agent, 95% of foamable material and 5% foaming agent, 93% of foamable material and 7% foaming agent, 90% of foamable material and 10% foaming agent, 87% of foamable material and 13% foaming agent, 85% of foamable material and 15% foaming agent, 83% of foamable material and 17% foaming agent, 80% of foamable material and 20% foaming agent, 77% of foamable material and 23% foaming agent, 75% of foamable material and 25% foaming agent, 73% of foamable material and 27% foaming agent, 70% of foamable material and 30% foaming agent, 67% of foamable material and 33% foaming agent, 65% of foamable material and 35% foaming agent, 63% of foamable material and 37% foaming agent, 60% of foamable material and 40% foaming agent, 57% of foamable material and 43% foaming agent, 55% of foamable material and 45% foaming agent, 53% of foamable material and 47% foaming agent, 50% of foamable material and 50% foaming agent, 45% of foamable material and 50% foaming agent or 40% of foamable material and 60% foaming agent. In such an instance, the foamable material is changed by the foaming agent, such as being converted from a liquid or semi-liquid or solution or gel or solid, or powder state to a state wherein the composition includes the foaming agent, such as in a foamed state.

For instance, in various instances, the foamable material is a material capable of absorbing and/or otherwise retaining within its formulation at least a portion of the foaming agent and/or propellant. For example, in certain embodiments, the foamable material is a liquid or the like and the foaming agent and/or propellant is one or more of a gas, such as a soluble gas, a liquid, a semi liquid, a solution, a solute, a solid, a gel, a dissolvable powder, a suspension, and the like. In other embodiments, the foamable material may be one or more of a gas, such as a soluble gas, a liquid, a semi liquid, a solution a solute, a solid, a gel, a dissolvable powder, a suspension, and the like, and the foaming agent may be a liquid or the like.

Accordingly, in various embodiments, a composition is provided wherein the composition includes a formulation produced by introducing the foaming agent and/or propellant to the foamable material, such as to produce a foamed composition, such as where the foamable material goes from a first, non-foamed state, to a second foamed state, such as by intermixing with the foaming agent and/or propellant. More particularly, in certain embodiments, the composition provided is a consumable product, such as a beverage, such as a foamed beverage. In further instances, the foamable material is a material capable of absorbing and/or otherwise retaining within its formulation at least a portion of a propellant. For example, in certain embodiments, a propellant may be included wherein the propellant is one or more of a gas, such as a soluble gas, a liquid, a semi liquid, a solution, a solute, a solid, a gel, a dissolvable powder, a suspension, and the like. Additionally, in one aspect, the disclosure is directed to the conversion of a material from a first, non- or partially flowable state to a second, more flowable state, such as by the introduction of a propellant into the material, for instance, for the production of a consumable flowable material end product having a desired amount of flowability.

For instance, the material and the propellant may be selected such that when admixed the material is converted from a non- or semi-flowable state to a more flowable state wherein in the flowable state, the flowable material has a viscosity and/or thixotropic structure that is characterized by the amount of propelling agent and/or other additive that is trapped within the structure. In various instances, the flowable composition includes 98% of flowable material and 2% propelling agent, 95% of flowable material and 5% propelling agent, 93% of flowable material and 7% propelling agent, 90% of flowable material and 10% propelling agent, 87% of flowable material and 13% propelling agent, 85% of flowable material and 15% propelling agent, 83% of flowable material and 17% propelling agent, 80% of flowable material and 20% propelling agent, 77% of flowable material and 23% propelling agent, 75% of flowable material and 25% propelling agent, 73% of flowable material and 27% propelling agent, 70% of flowable material and 30% propelling agent, 67% of flowable material and 33% propelling agent, 65% of flowable material and 35% propelling agent, 63% of flowable material and 37% propelling agent, 60% of flowable material and 40% propelling agent, 57% of flowable material and 43% propelling agent, 55% of flowable material and 45% propelling agent, 53% of flowable material and 47% propelling agent, 50% of flowable material and 50% propelling agent, 45% of flowable material and 50% propelling agent or 40% of flowable material and 60% propelling agent. In such an instance, the flowable material is changed by the propelling agent and/or an additional additive, such as being converted from a liquid or semi-liquid or solution or gel or solid, or powder state to a state wherein the composition includes the propelling agent, such as in a flowable state.

For instance, in various instances, the flowable material is a material capable of absorbing and/or otherwise retaining within its formulation at least a portion of the propellant. For example, in certain embodiments, the flowable material is a liquid or the like and the propelling agent and/or propellant is one or more of a gas, such as a soluble gas, a liquid, a semi liquid, a solution, a solute, a solid, a gel, a dissolvable powder, a suspension, and the like. In other embodiments, the flowable material may be one or more of a gas, such as a soluble gas, a liquid, a semi liquid, a solution a solute, a solid, a gel, a dissolvable powder, a suspension, and the like, and the propelling agent may be a liquid or the like.

Accordingly, in various embodiments, a composition is provided wherein the composition includes a formulation produced by introducing the propellant and/or an additive to the material to be delivered, such as to produce a flowable composition with a determined flow characteristic, such as where the deliverable material goes from a first, non- or partially flowable state, to a second flowable state, such as by intermixing with the propellant and/or additive. More particularly, in certain embodiments, the composition provided is a consumable product, such as a beverage, such as a flowable beverage or other food item. In further instances, the deliverable material is a material capable of absorbing and/or otherwise retaining within its formulation at least a portion of a foaming agent, as described above, and/or an additive, such as listed above. For example, in certain embodiments, a foaming agent and/or an additive may be included or added to the foamable material such as wherein the foaming agent and/or additive is one or more of a gas, such as a soluble gas, a liquid, a semi liquid, a solution, a solute, a solid, a semi-solid, a gel, a dissolvable powder, a suspension, and the like.

Accordingly, in various instances, as depicted in FIGS. 2A and 2C, the container 1 may include a chamber 2*d* configured as an intermixing duct, such as a duct that is configured to allow the contents of one cavity, e.g., 52*a*, to communicate with the contents of another cavity, e.g., 52*b*, such as for intermixing within a third cavity, e.g., 52*d*, such as for the intermixing of the various different substances within the container. For example, the intermixing duct 2*d* may be connected to a first cavity 52*a* by a first feeder element 30*a*, through a first passageway 41*a* having a first valve 40*a* associated therewith. Additionally, the intermixing duct 2*d* may also be connected to a second cavity 52*b* by a second feeder element 30*b*, through a second passageway 41*b* having a second valve 40*b* associated therewith.

In various instances, the valves 40*a* and 40*b*, may include control elements 45*a* and 40*b*, respectively. Hence, the container 1 may be configured so as to connect a first cavity, e.g., 52*a*, containing a material to be foamed and/or flowed 100, and may further connect a second cavity, e.g., 52*b*, containing a foaming agent 200 and/or a propellant 300 with the intermixing duct 52*d*, such as where the intermixing chamber 2*d* may be configured so as to be part of the dispensing mechanism 20. In such an instance, the flowable and foamable material 100 is translated through a distal portion of the translating element 37*a*, e.g. through one or more valves 40*a*, into the mixing chamber 2*d* within the dispensing mechanism 20, and the foaming agent and/or propellant 200/300 is translated through a distal portion of the translating element 37*b*, e.g. through one or more valves 40*b*, into the mixing chamber 2*d*, wherein upon mixing of the foaming agent 200 and/or propellant 300 with the foamable material 100, the foamable material may be converted from a non-foamed to a foamed state, such as by intermixing with the foaming agent 200 and/or propellant 300, which intermixing may be initiated via the operation of a consumer operable control actuator 27. In such an instance, two or more control valves may be employed, as depicted, so as to prevent the foaming and/or propelling agents from escaping directly into the various chambers, such as mixing duct, and/or out of the passageways 41 and/or 61, such as in an attempt to equalize within the system.

Such intermixing may take place prior to insertion of the foamed material into the container, after insertion within the container, such as within a single, e.g., the main, chamber within the container, and/or within one or more auxiliary chambers, such as a mixing chamber, within the container and/or within the dispensing mechanism associated with the container. As indicated above, where the foaming process takes place within the container, the foamable material may be separated, such as by a phase shift or by a physical partition, from the foaming agent and/or an additive or flavoring agent, but in such a manner that the two or more materials are capable of being intermixed, such as in a controlled fashion, so as to produce the foamed material having the desired foaminess and/or flow characteristics. Likewise, where the process of converting a non- or semi-flowable material into a flowable material takes place within the container, the material to be flowed may be separated, such as by a phase shift or by a physical partition, from the propelling agent and/or an additive and/or a flavoring agent, but in such a manner that the two or more materials are capable of being intermixed, such as in a controlled fashion, so as to produce a flowable material having a desirable flow characteristic.

Accordingly, when physically separated, as depicted in FIGS. 2A-2C, such as by a partition or divider 51, a controlled release conduit 41 and/or 48 may be included in the partition and/or an intermixing duct 2*d* so as to regulate the rate and extent of intermixing between one or more of the flowable and foamable material 100, the foaming agent 200, and/or the propellant 300 and/or an additive or flavoring agent, where the controlled release conduit 41 and/or 48 may be configured in such a manner so as to accommodate the physical characteristics of the foamable material, the foaming agent, and/or the propellant, and/or additives, and/or flavoring agents being employed as well as any changes to the same due to such intermixing. In such an instance, dependent on the identity of the foaming agent 200 and/or propellant 300 and/or additive and/or flavoring agent, the controlled release conduit 41 and/or 48 may have any configuration suitable to creating a pressure and/or temperature differential between the inside of the container 1 and the outside of the container and/or between various different cavities 52 within the container 1, such as between the cavity 52*a* containing the foamable and/or flowable material 100 and the cavity 52*b* containing the foaming agent 200 and/or the cavity 52*c* containing the propellant 300 and/or one or more additional cavities having one or more additives and/or flavoring agents therein.

For instance, in various embodiments, one or more control release conduits of the container for allowing communication between the various different chambers and/or cavities of the container, may have a mechanical configuration so as to operate mechanically. For example, a control release conduit may be configured as or to include a slow or quick release valve where the conduit or valve has various controllable diameter dimensions; a hand or screw pump; a screw and plate, a spring release plate, a lever, or other mechanical element capable of increasing the pressure and/or temperature in at least one chamber such as by decreasing the size of that chamber (such as prior to release of the foaming agent from that chamber) or receiving more of a gas therein, a fan, and the like. In various instances, the foaming agent and/or propellant and/or the control release conduit may be one in the same.

In various embodiments, such a control release conduit may have a mechanical, an electrical, and/or electro-mechanical configuration so as to operate at least in part electronically. In such an instance, the control release conduit may be configured as or include an electronic slow or quick release valve; an electronic pump, electronic screw plate, an electronically activated spring release plate; an electronic lever or fan; an electronic MEMS device, and the like. In various instances, where the conduit is controlled electronically, the conduit may have control circuitry, such as a microprocessor that controls the conduit and thereby controls the extent and rate of communication between the chambers. In such an instance, the microprocessor may include one or more of a CPU, a memory, a transmitter, a receiver, a GPS locator, a pressure sensor, a temperature sensor, and/or one or more other sensors or gauges, such as for determining the amount of air or foaming agent or propellant or additive or flavoring agent captured within the generated matrix, colloid, and/or solution of the foamable and/or flowable material generally. In instances such as this, in certain embodiments, the foaming agent, propellant, additive, etc. and controlled release conduit may be one in the same, such as where the opening and closing as well as the diameter of the opening of the conduit is controlled such as either mechanically or electronically.

In specific embodiments, the foaming and/or propelling agent may be a chemical composition and the control release conduit may be configured for facilitating the mixing of the chemical foaming and/or propelling agent and/or additive and/or flavoring agent with the foamable material, such as where the foaming agent and/or additive and/or flavoring agent is in a gaseous, liquid, semi-liquid, solution, gel, solid, and/or powder form, and the like. For instance, the foaming agent and/or propellant may be one or more components that when intermixed with each other and/or the foamable and/or flowable material and/or additive and/or flavoring agent cause an increase in pressure and/or temperature within one or more of the chambers of the container, which increase in pressure and/or temperature may be employed, via the control release conduit, so as to foam the foamable material and/or facilitate in its expulsion from the container, such as in response to activation of the dispensing member. Of course, as indicated, any of the flowable and/or foamable material 100, foaming agent 200, and/or propellant 300 may be one and the same, or in two or more, e.g., three different lumens, such as three or more separate lumens within three or more separate compartments 2*a*, 2*b*, 2*c*, and/or 2*d*, and/or the like, of the container 1, which one or more compartments can be configured to communicate with one another such as via one or more conduits 41 and/or 48 and/or valves 40, control mechanisms 45, and/or mixing ducts 2*d*, and/or mixing chambers 52*d*.

Accordingly, as depicted in FIGS. 1E and 1F, the foaming material 100 may be in the same chamber 50 as the foaming agent 200. However, as depicted in FIGS. 2A and 2C, the foamable material 100 may be in a separate lumen 52*a* from the lumen 52*b* wherein the foaming agent 200 resides, such as where the two lumens 52*a* and 52*b* are separated by a divider 51, which divider may be configured as a stretchable membrane or as a moveable platform or diaphragm. And further, as depicted in FIG. 2B, an additional or alternative compartment 2*c* may be included, e.g., within chamber 50, such as where the compartment 2*c* forms a lumen 52*c*, such as for housing a propellant 300, which in this instance is housed within an auxiliary canister 310. Further, as depicted in FIGS. 2A and 2C, the container 1 may include one or more mixing ducts 2*d*, which ducts may be adapted for allowing the contents in one container portion, e.g., 2*a*, to flow to and intermix with the contents in a different container portion, e.g., 2*b*, such as within an intermixing chamber 52*d* of the dispensing mechanism 20.

Additionally, as can be seen with respect to FIG. 2C, in various embodiments, a vessel such as a container 1 is provided, wherein the container 1 includes chamber 50, such as where the chamber 50 may include at least a first container portion 2*a*, such as for retaining the foamable material 100, and may further include a second container portion 2*b*, such as for retaining a foaming agent 200 and/or propellant 300, where the first and second container portions are separated one from the other by one or more divider portions 51, such as an articulable divider portion capable of moving within the chamber 50 of the container 1 in such a manner that the internal area of the chamber 50 can be of variable volume, so as to be increased or decreased. In a manner such as this, the foaming agent and/or propellant 200/300 within the second container portion 2*b* may be such that it exerts a pressure against the divider portion 51. In such an instance, the actuator 27 may be configured such that when depressed, valves 40*a* and 40*b* may be opened simultaneously or sequentially, e.g., by activation of control mechanisms 45*a*, 45*b*, respectively, thereby opening passageways 41*a* and 41*b* and allowing an egress route out of the cavities 52*a* and 52*b* and into mixing chamber 52*d*, such that as propellant 300 exerts pressure against the articulable divider portion 51, the divider portion moves upwards towards the proximal portion 12 away from distal portion 16 of the container 1 forcing the foamable and flowable material 100 to be translated through the translating element 30*a* and be delivered to chamber 52*d*. Also, valve 40*b* may be opened, e.g., by the initial depressing of actuator 27 or a subsequent depressing action, so as to allow the ingress of foaming agent 200/300 to be received within feeder element 30*b* via distal portion 37*b* so as to be delivered to mixing chamber 52*d* so as to allow the mixing of the flowable and/or foamable material 100 with the foaming agent and/or propelling agent 200/300, such as in mixing duct 2*d*. In such an instance, a further actuation of the actuator 27 may effectuate the opening of valve 40*c* via control mechanism 45*c* so as to open up access to passageway 61 of nozzle 60 for dispensing of the mixed and/or foamed material to the user.

Further, as depicted in the cut away of FIG. 2C, in various instances, the divider 51 may be configured to articulate within the chamber 50 such as by being rotated around an axle unit 29, which rotations may be actuated by an actuator 28 that when twisted or turned moves the divider 51 upwards along the axle unit 29 thereby compressing the contents 100 within the cavity 50 and forcing them out of the nozzle 60. In such an instance, one or more of the interior of the chamber wall 8 and/or the axle unit 29 may include threading or the like to facilitate the movement, such as by converting the rotating motion into linear movement along the axis, e.g., upwards or downwards. The axle unit 29 may be positioned centrally, such as along a central axis within the chamber 50, or may be positioned off center. The divider 51 may have any suitable shape such as circular, donut shaped, square, etc. In various instances, the central axis unit 29 may have a passageway there through, e.g., it may be tubular, with an opening along its length through which one or more of the flowable material 100, the foaming agent 200, and/or propellant 300 may translate, hence, in various instances, the axis unit 29 may function as a feeder tube, as described herein. Furthermore, as depicted the container 1 may include a chamber 50 that in turn includes a plurality of sub-chambers, such as sub-chambers 2*a* and 2*b* that are formed by the divider 51 intersecting the chamber 50. As indicated, in various instances, the platform 51 may be torus such that the axle 29 may be inserted there through, which axle 29 may be covered by a membrane to separate it from the contents within the chamber 2*a*.

In various instances, a further divider 51*a* may be present, which divider 51*a* may be a compressible member, such as a membrane, that is configured so as to be folded upon itself like an accordion so as to be compressed, such as by the articulations of the rotating member 28. Hence, in some embodiments, by rotating the screw-like member 28, the divider 51 moves axially upwards toward the proximal portion of the chamber 50, causing the membrane 51 to fold upon itself and compress the chamber 2*a*, thereby expelling the contents therein, such as through the delivery mechanism 20. In some embodiments, the divider 51 and membrane 51*a* may be configured as a bellows that is controllable by the movements of one or more of the axle 29 and control lever 28, and in such as instance, the compressing action may be carried out by twisting, pushing, and/or pulling. In some instances, one or more rollers or other compressive elements providing a compressive force to the membrane 51*a* may be included so as to effectuate the compressing of the chamber 2*a* and/or the expulsion of the material 100, such as by the collapsing of the chamber 2*a*. Such expulsion can also be through a ratcheting type configuration and/or mechanism. In certain instances, the divider 51 and/or the axle 29 and/or other interior bounding members of the chamber 50 may include one or more elastic members, a spring element, or other biasing element that is coupled thereto so as to facilitate the collapsing of the chamber 2*a*, such as where the platform 51 and axle 29 form a piston type and/or plunger mechanism. In such instances as these, a chemical based propellant may or may not be employed. Rather, the material to be delivered is inserted within the sub-chamber 2*a*, causing it to expand, creating potential energy that is then released when the chamber is opened, such as via valve 40 and through passageway 41.

Additionally, in some embodiments, the central axle unit 29 may comprise an internal element adapted to create a positive pressure within the chamber 50, such as one or more spring or biasing elements that may be configured to couple a top or bottom portion of the container 1 to the divider 51 for assisting in the articulation of the divider 51 within the chamber. Hence, in various instances, the container 1 may include an element configured for creating a positive pressure within the chamber 50 for the expulsion of its contents 100, which element may include one or more of a spring, e.g., a spring loaded valve, a stretchable membrane or bladder, or other source for storing potential energy within the chamber 50 or one or more of its associated cavities 52.

As depicted in FIGS. 2A, 2C, and 3, container 1 includes a mixing chamber 52*d* that is separated from main chamber 50, by one or more passageways 41, e.g., via one or more control valves 45, and further includes an intermixing cavity 2*d* associated therewith. Particularly, chamber 50 includes a first container portion 2*a* that retains a foamable material 100, and includes a second container portion 2*b*/2*c* that retains a foaming agent 200 and/or propellant 300. The first 2*a* and second 2*b*/2*c* container portions are separated one from the other by divider portion 51, and may feed into container portion 2*d*, such as through one or mover valves 40, which valves may include one or more control mechanisms 45.

Hence, in various instances, the container 1, may include one or more metering valves 40/45 that are configured so as to meter the exact proportions of materials to be received within the mixing chamber 2*d* so as to be precisely intermixed therein. The metering valves may be configured to meter exact volumes, such as by controlling amount of materials flowed into chamber 2*d*, time of flowing, proportion of materials flowed therein, and the like. Particularly, the proportion of materials to be flowed into chamber 2*d* may be determined so as to ensure that the final deliverable composition is not too foamy, but not under foamed. More particularly, the metering valves can be configured so to ensure that the first portion delivered maintains the same consistency as the last portion to be delivered. In such instances, the system can be configured so as to not run out of foaming agent and/or propellant prior to delivering the last amount of substantial material. Furthermore, the valves and/or control mechanisms thereof may be configured for sequential activation and subsequently to sequential delivery into mixing chamber 2*d* and/or to the consumer. As indicated herein, such activation may be controlled mechanically, e.g., through switches, toggles, and/or motors, and/or electronically, such as through control of various settings of a microprocessor. In various instances, the container 1 may include one or more sensors, and/or the microprocessor may include a memory containing one or more flavoring and/or foaming and/or projecting profiles so as to allow the user to select the parameters and taste experience of the delivery.

For example, the container portion 2*a* is connected to the container portion 2*d* via valve 40*a* through passageway 41*a*, and the container portion 2*b* is connected to the container portion 2*d* via valve 40*b* through passageway 41*b*. Flow through passageways 41*a* and 41*b* and into mixing duct 2*d* may be controlled via control mechanisms 45*a* and 45*b*, respectively, that control the operation of valves 40*a* and 40*b*, such as in response to one or more operations of actuator 27. Hence, upon the appropriate activations, the passageways 41*a* and 41*b* are opened, simultaneously or sequentially, thereby allowing the contents of container portions 2*a* and 2*b* to intermix within container portion 2*d*.

In such an instance, the actuator 27 may be configured such that when depressed one valve 40*a* is opened thereby releasing the foamable material 100 to be released into mixing duct 2*d*. And when depressed a second time valve 40*b* is opened thereby opening passageway 41*b* and allowing the foaming agent 200 to also be released into mixing duct 2*d*, so as to allow the foamable material 100 to intermix with foaming agent 200 and to be foamed thereby, such as prior to release from the container 1. Additionally, a further actuation of the actuator 27 may effectuate the opening of valve 40*c* via control mechanism 45*c* so as to open up access to passageway 61 of nozzle 60 for dispensing of the mixed and/or foamed material to the user.

Accordingly, the intermixing cavity 52*d* may be configured to be part of the dispensing mechanism 20 and adapted to allow the contents in chamber portion 2*a* and the contents of chamber portion 2*b* to communicate within chamber 2*d*, such as for the intermixing of the substances. For example, the intermixing cavity 52*d* is connected to chamber 2*a*, containing the flowable material 100, by translating element 30*a*, which forms passageway 41*a* and allows the flowable substance to flow into chamber 2*d* through valve 40*a*. Further, the intermixing cavity 52*d* is additionally connected to chamber 2*b*, containing the foaming agent 200, by translating element 30*b*, which forms passageway 41*b* and allows the foaming agent to flow into chamber 2*d* through valve 40*b*. In such an instance, the chamber portion 2*d* may be configured as a foaming chamber so as to allow a foaming agent, such as a gaseous element, to intermix with a food or beverage item, such as for foaming thereof, such as when the actuator 27 is depressed thereby opening up valve mechanisms 45*a* and 45*b*. Where the propellant 300 is also a foaming agent 200, when it intermixes with the flowable material 100, such as in chamber 2*d*, it foams the material 100, such as prior to release through the nozzle 60 and/or directly to the mouth of the consumer. Hence, when actuated, the flowable and foamable material 100 may be translated through the translating element 30*a* through the valve 45*a* into the mixing chamber 2*d* within the dispensing mechanism 20 for mixing with the foaming agent 200/300, upon which mixing the foamable material 100 is converted from the non-foamed to the foamed state, such as by the intermixing with the foaming agent 200 and/or propellant 300.

As can be seen with respect to FIG. 3, in various embodiments, a vessel such as a container 1 is provided, wherein the container 1 includes at least a first container portion 2*a* having a main chamber 50, including a first cavity 52*a*, such as for retaining the foamable material 100, and may further include a second container portion 2*c* having a sub-chamber 52*c*, such as for retaining a foaming agent 200 and/or propellant 300, where the first and second container portions are separated one from the other by one or more divider portions 51, such as divider portion(s) 51 having a conduit 48 there through so as to allow communication between the first container portion 2*a* with the second container portion 2*c*. In various embodiments, a foaming agent 200 may also be included, such as within the first container portion 2*a* and may further be included in the second container portion 2*b*, in some embodiments. The foaming agent 200 and/or propellant 300 may be in various forms, from liquids to solids to powders, and the like, and as indicated, may further be included in the same or in one or more separate compartments from the compartment containing the foamable material.

Accordingly, as can be seen with respect to FIG. 3, the container 1 includes the main chamber 50 having sub-chamber 2*a* including the flowable and/or foamable material 100. The main chamber 50 additionally includes the sub-chamber 2*c* including the propellant 300. Hence, in this particular instance, the foaming agent 200 is included and retained within the same chamber 50 as the flowable and foamable material 100, such as in compartment 2*a*, and the propellant 300 is retained within a separate compartment 2*c*. The foamable material 100 may be facilitated with respect to flowing and/or foaming and/or inter-mixing with the propellant 300 by conduit 48, which conduit 48 may comprise a control release valve 49.

In this instance, the propellant 300 is contained within a propellant/foaming member 310, e.g., a canister containing the propellant 300, which canister is insertable within or otherwise coupled with the container 1. However, in other instances, the canister 310 may be configured so as to be associated with the outside of the bounds of the container 1, such as by a threaded or cammed interface. For example, in certain instances, a foaming and/or propellant member 310, containing a foaming agent 200 and/or a propellant 300, may be included, such as within an insertable and/or ejectable canister or container 310 that is configured for being coupled to the container 1, such as a container 1 having a sub-chamber 2*c* configured so as to have a foaming member receptacle 52*c* therein.

As can be seen with respect to FIG. 3, the container 1 may include one or more lumens or cavities, 52*a* and 52*c*, where the one or more cavities of the container, e.g., the one, two, or three cavities, may be in communication with one another, such as through one or more conduits 48, which conduits may be controlled such as via a control mechanism 49. Additionally, in various embodiments, the container 1 may include a dispensing mechanism 20 that may be coupled to a nozzle 60. The nozzle 60 may be capable of participating in the translation of the flowable material out of the container 1, and in various instances, the nozzle 60 may be operably connected to a series of valve mechanisms 40*a*, 40*b*, and 40*c* and/or 49, which valve mechanisms 40 may be adapted to function in concert or independently to control the flow of the materials 100, 200, and/or 300 throughout the container 1, such as through the various feeder elements 30 and 30*b* and out of the container 1 through the nozzle 60. In some embodiments, the dispensing mechanism 20 may include a mixing chamber 2*d* having a lumen 52*d* for allowing one or more of the flowable and/or foamable material 100 and/or foaming agent 200 and/or propellant 300 and/or an additive, etc. to intermix.

In some instance, a valve 40 may be included where the valve 40 may be comprised of a plurality of valve elements 40*a*, 40*b*, and 40*c*, and/or 49. For instance, a first valve element 40*a* may include a first conduit 41*a* that is configured for interfacing with a primary translation member 30*a* so as to facilitate and/or control the release of the flowable material 100 from within the chamber 50, such as for delivery to mixing chamber 2*d* and/or to a user and/or a consumer of the translated material 100. For example, the container 1 may include a valve controller and/or other control mechanism, such as actuator 27, for controlling the various valve mechanisms 40, 45, 48, 49, and/or communication between the chambers and/or for allowing and/or regulating the extent and/or rate of intermixing of the foamable material 100 with the foaming agent 200, such as within a mixing cavity region 52*d* of the container or a dispensing mechanism associated therewith 20, so as to ensure the production of a consumable and/or otherwise ingestible end product having the optimal proportion of foamable material to foaming agent and/or propellant and/or additive, flavoring agent, etc. such that the resulting foamed and/or flowable material has the desired amount of foaminess and/or rate of flow, such as rate of egress from the container and/or canister.

Additionally, in certain instances, the delivery mechanism 20, may include or otherwise be associated with a secondary conduit 41*b*, which secondary conduit 41*b* may be connected to a secondary translation member 30*b*, as well as with mixing chamber 2*d*, such as through additional valve element 40*b*. In such an instance, the main translation member 30*a* may be relatively long, extending so as to be proximate the distal portion 16 of the chamber 50, and configured for delivering the flowable material 100 to the dispensing mechanism 20, such as through mixing cavity 52*d*, such as when the container 1 is positioned in a first orientation, for instance, when held with the proximal portion 12 upwards, positioned above the distal portion 16, towards the mouth of the user. In addition, the secondary translation member 30*b* may be shorter, extending interiorly within the chamber 50, but proximate the proximal portion 12, and configured for delivering the flowable material 100 to the dispensing mechanism 20, when the container 1 is positioned in a second orientation, for instance, when held with the distal portion 16 upwards, positioned above the proximal portion 12, towards the mouth of the user. The valve controller 40 may additionally include a valve element 40*c*, which valve element 40*c* may be configured for controlling release of the mixed substances out of the nozzle 60 and to the user, such as through passageway 61.

Figure 4A:
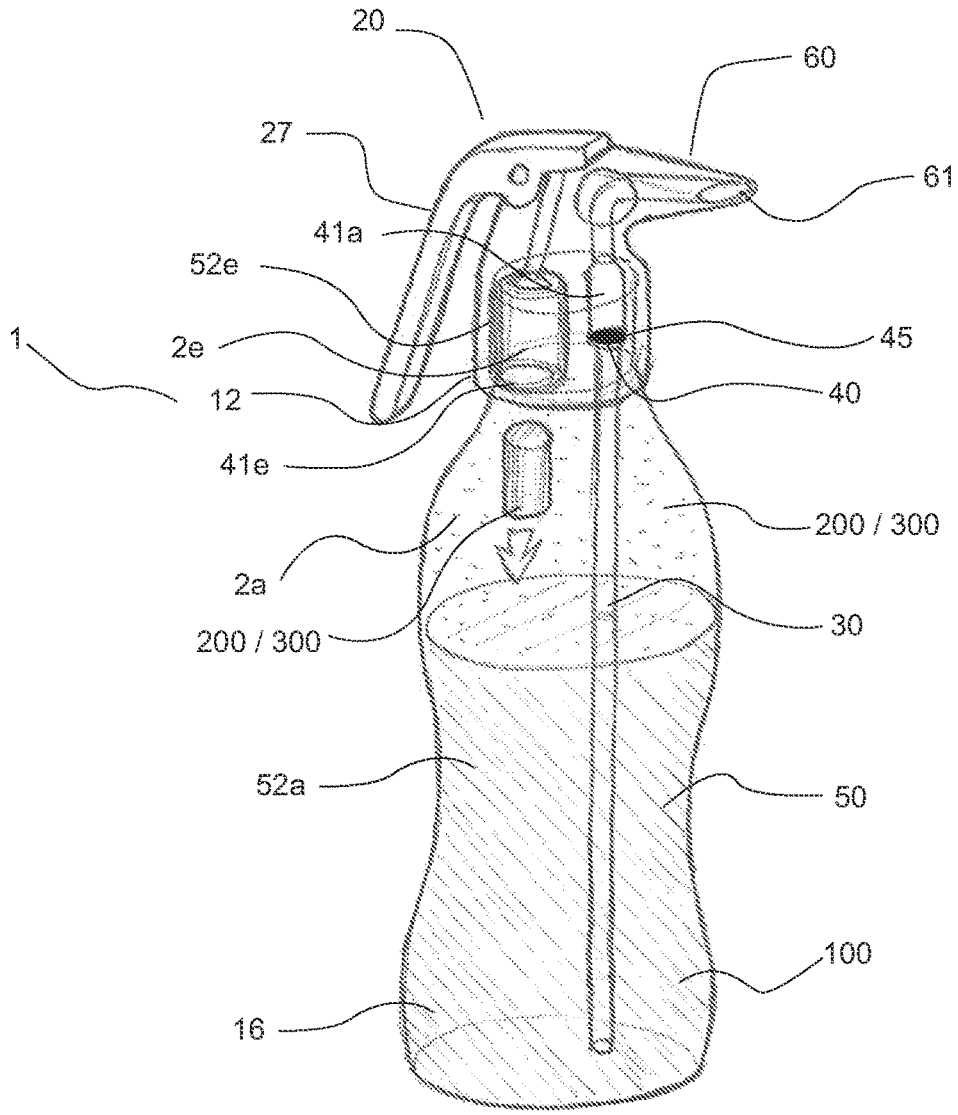
FIG. 4A is a schematic representation of an additional exemplary embodiment of a container of the present disclosure, the container having a delivery mechanism including an auxiliary foaming and/or propelling chamber.

As can be seen with respect to FIG. 4A, a container 1 containing an ingestible composition 100 is provided, wherein the ingestible composition, in certain embodiments, is a beverage. In such an instance, the ingestible beverage 100 may be a foamable material, such as a flowable material capable of being foamed and therefore may be a foamable material that is retained with in a cavity 52*a* of chamber 50 in a first container portion 2*a*, such as in a non-foamed state. In various instances, the material may be a material to be flowed, and as such a foaming agent 200 and/or propellant 300 may be included. In certain instances, the propellant and/or foaming agent 200/300 may be retained within the same container portion 2*a* as the foamable material 100. Further, in various instances, as depicted in FIG. 4A, a (additional) foaming agent 200 and/or propellant may also be included and may be retained in a second container portion 2*e* having a second cavity 52*e*.

For instance, in various instances, the container 1 may include an auxiliary container portion 2*e*, which container portion may be part of or otherwise associated with a dispensing mechanism 20 that is positioned at a proximal portion 12 of the container 1. In such an instance, the auxillary cavity 52*e* may be connected to the first cavity 52*a*, such as by a conduit 41*e* that is capable of being opened, for instance, by an actuator 27, which actuator may also be configured for effectuating the release of the foamable material 100, such as through the translating element 30, through the demand valve 45, into conduit 41*a* and out through the distal opening 61 of the nozzle 60. In such instances, a foaming agent 200 and/or propellant 300 may also be included, such as a propellant that may be retained in the first container portion 2*a*, or in some instances a propellant may not be included. In various embodiments, where a propellant is included, the propellant 300 may be retained within a second or even a third container portion of the container 1, such as depicted in FIGS. 2B and 3. Where a third or fourth container portion is present, the third and/or fourth container portion may be connected to the first and/or second container portions, such as by one or more conduits that are openable, for instance, by the actuator 27.

In various embodiments, where the foaming agent 200 and/or propellant 300 is retained within an auxiliary cavity portion 52*e* that is connected to a first cavity portion 52*a*, such as through conduit 41*e*, the foaming agent 200 and/or propellant 300 may be composed of a material that when contacted and/or admixed with the foamable material 100 converts the foamable and/or flowable material from a first, non-foamed state to a second, foamed and/or flowable state. In such an instance, the foaming agent 200 may be any material that is capable of producing a foam when contacted with the foamable material, such as an effervescence material configured as a tablet. In certain instances, one or more of the foamable material and/or the foaming agent may include an additive and/or a flavoring agent. In other instances, the cavity 52*e* may retain a propellant 300 and/or additive, flavoring agent, and/or the like within and be releaseable from the cavity 52*e*, such as upon activation of an actuator 27, and the like.

Accordingly, such a cavity 52*e* of the container 1, may include a flavoring agent, thickening agent, and/or other food or beverage topping. For instance, one or more powders having various radii of preselected sizes so as to achieve a various preselected flow characteristic. For example, a powder may be present wherein each component of the powder may be of uniform volume and/or size, which may be employed so as to increase or decrease the density of the overall composition, such as where the powder may be distributed according to particle size and selectively employed to trap air within the composition so as to enhance its flow characteristics, e.g., make the composition more flowable. In some instances, air may be added directly to the composition, such as through an aeration process, so as to enhance its flowability or taste. Particularly, where no extra air is contained in the composition, it may be more compressive, and may be more dense and flow more slowly. However, where air is added, the composition may become less dense and flow more swiftly and/or smoothly.

Hence, in certain instances, the dispensing mechanism 20 may be configured such that the foaming, propelling, and/or flavoring agent is released for contact with the foamable and/or flowable material when the actuator 27 is actuated thereby at least partially opening the conduit 41*e*, such that when the actuator 27 is actuated, e.g., by being depressed, the foaming agent and/or propellant and/or additive and/or flavoring agent may be released, may traverse through a suitably configured conduit 41*e*, and enter into the main cavity 52*a* so as to be mixed with the foamable material 100, thereby converting the foamable material from the non-foamed and/or non-flowable state to a foamed and/or flowable state. In various instances, the container 1 may include an additional container portion housing a propellant, which propellant may be released into the main container portion 2*a* for intermixing therewith, such as through an additional conduit that may be controlled by actuating actuator 27 of dispensing mechanism 20, or some other controlling mechanism.

As indicated above, the container may include an outlet 41*a*, such as an outlet that is coupled with the first (and/or second) container portion(s), such that once produced the foamed and/or flowable material may be translated, e.g., via the translating member 30, from within the first container portion 2*a* to the outside of the container 1, such as through the control valve 45, for instance, and out through the outlet of the nozzle 61 for delivery to a consumer, e.g., for consumption and/or adding to another food or drink item. In various instances, such as depicted in FIG. 4A, the translation of the flowable and/or foamed material 100 may be facilitated by the inclusion of a propellant 300, as described above, which propellant may be within the main chamber 50 (and/or in a tertiary container portion) in a state of partial admixture with the foamable material 100, such as where the propellant 300 is at least partially soluble within the foamable material.

In such an instance, when the foaming agent 200 is contacted with the foamable material 100, such as via activation of the actuator 27 and/or the conduit 41*a* is opened, thereby allowing pressure, e.g., gas pressure, within the container 1 to begin to equalize with the air pressure outside of the container, the foamable material 100 may be converted to a foamed state and may be propelled out of the container 1, such as through the translating element 30 and/or valve 40 and/or nozzle 60. For instance, when the foamable material is mixed with one or more of the foaming agent 200 and/or propellant 300, these agents may act to expel the resultant composition out from the interior 50 of the container 1, such as through the translating element 30. Where an additive is included, such as a flavor, the flavor may be delivered with the foamed material, such as in a foamed, flavored beverage form.

Figure 4B:
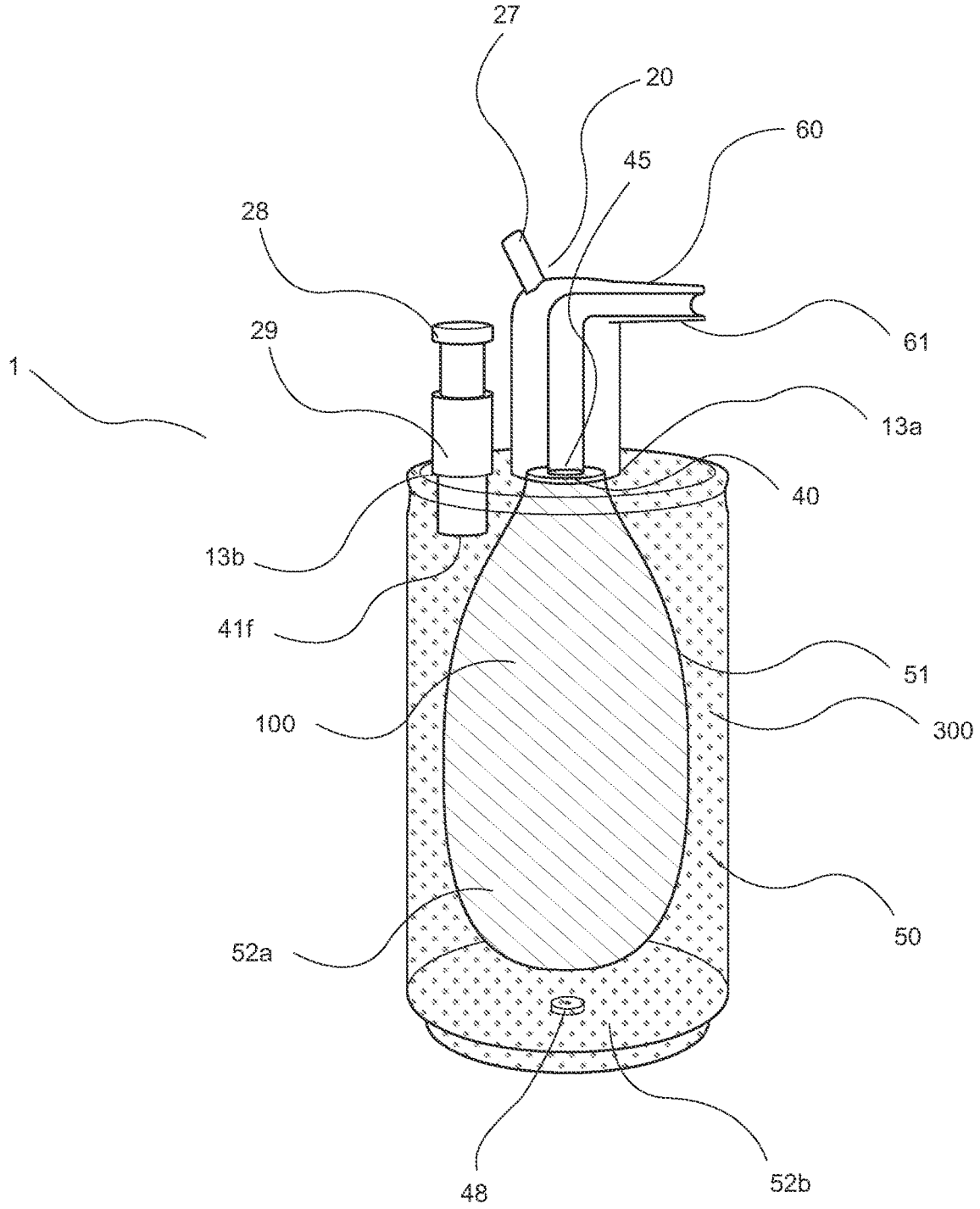
FIG. 4B is a schematic representation of another embodiment of an exemplary container of the present disclosure, the container including an auxiliary pumping mechanism for increasing pressure within the cavity.

As can be seen with respect to FIG. 4B, in various instances, a container 1 is provided. The container includes a chamber 50 having a first cavity 52*a* and/or a second cavity 52*b*, such as where the first cavity includes a foamable and/or flowable material 100 and the second cavity includes a propellant 300. In this instance, the first cavity 52*a* is divided from the second cavity 52*b* by a divider 51, such as a flexible and/or stretchable membrane that may expand or otherwise change its volumetric capacity when filled with the foamable and/or flowable material 100. In such an instance, when actuator 27 is depressed, valve 40, such as control release valve 45, may be articulated and thereby open passageway 41*a*, thereby allowing the contents of the first cavity 52*a* to be expelled out of the container 1, such as by flowing through the nozzle 60 and out from the outlet 61.

In various instances, as indicated, the interior container portion 50 may include a propellant 300 to facilitate such expulsion. In particular instances, the divider 51 is not included and the propellant 300 acts directly on the contents 100. Additionally, as can be seen with respect to FIG. 4B, in particular embodiments, a pumping mechanism 28 may be included, such as proximate the dispensing mechanism 20, which pumping mechanism may include a plunger or other pumping element 29 that is adapted to move within a conduit 41*f* and further configured so as to thereby increase the pressure and/or temperature within the chamber 50, and consequently further the expulsion of the material 100 from the chamber, such as when the actuator 27 is depressed and the valve 45 is opened. In such an instance, the plunger 29 would be in an airtight sealing with the proximal end 13 of the container 1, such as via a gasket, e.g., an o-ring, positioned around the plunger 29 and within the conduit 41*f* so as to seal the conduit 41*f*. In various instances, the chamber 50, or one or more of its subparts may be self-pressurizing. Hence, by activating the pumping mechanism 28 pressure and/or temperature within the chamber 50 would be increased by pushing and pulling the plunger 29 up and down, so as to increase pressure within the chamber 50 and/or facilitate the expulsion of the contents 100, such as through passageway 61, which may be a food or drink item or an additive or flavoring thereto, such as a topping or condiment.

Figure 5A:
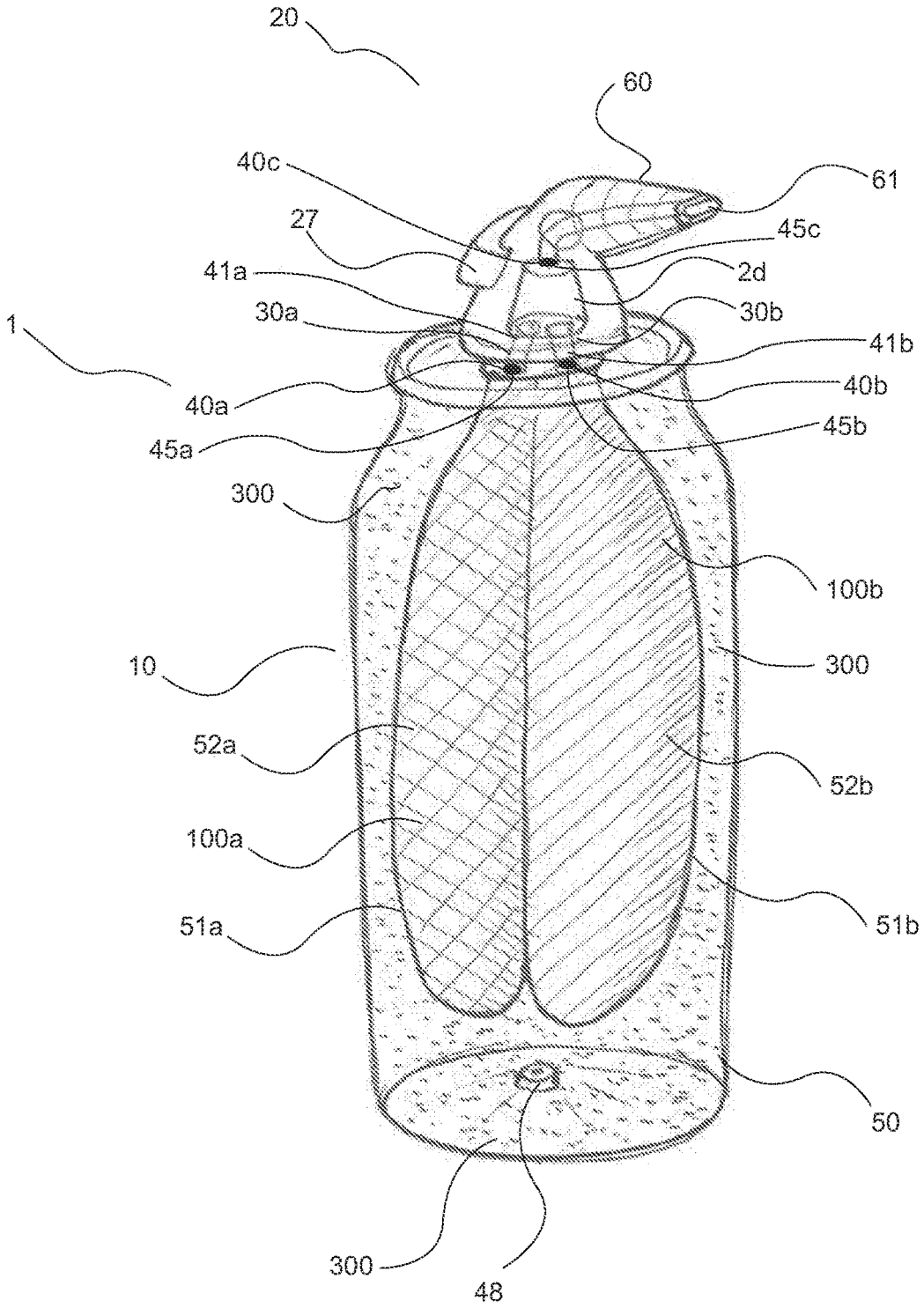
FIG. 5A is a schematic representation of an additional exemplary embodiment of a container of the present disclosure, the container including a plurality of sub-compartments containing ingestible substances.
Figure 5B:
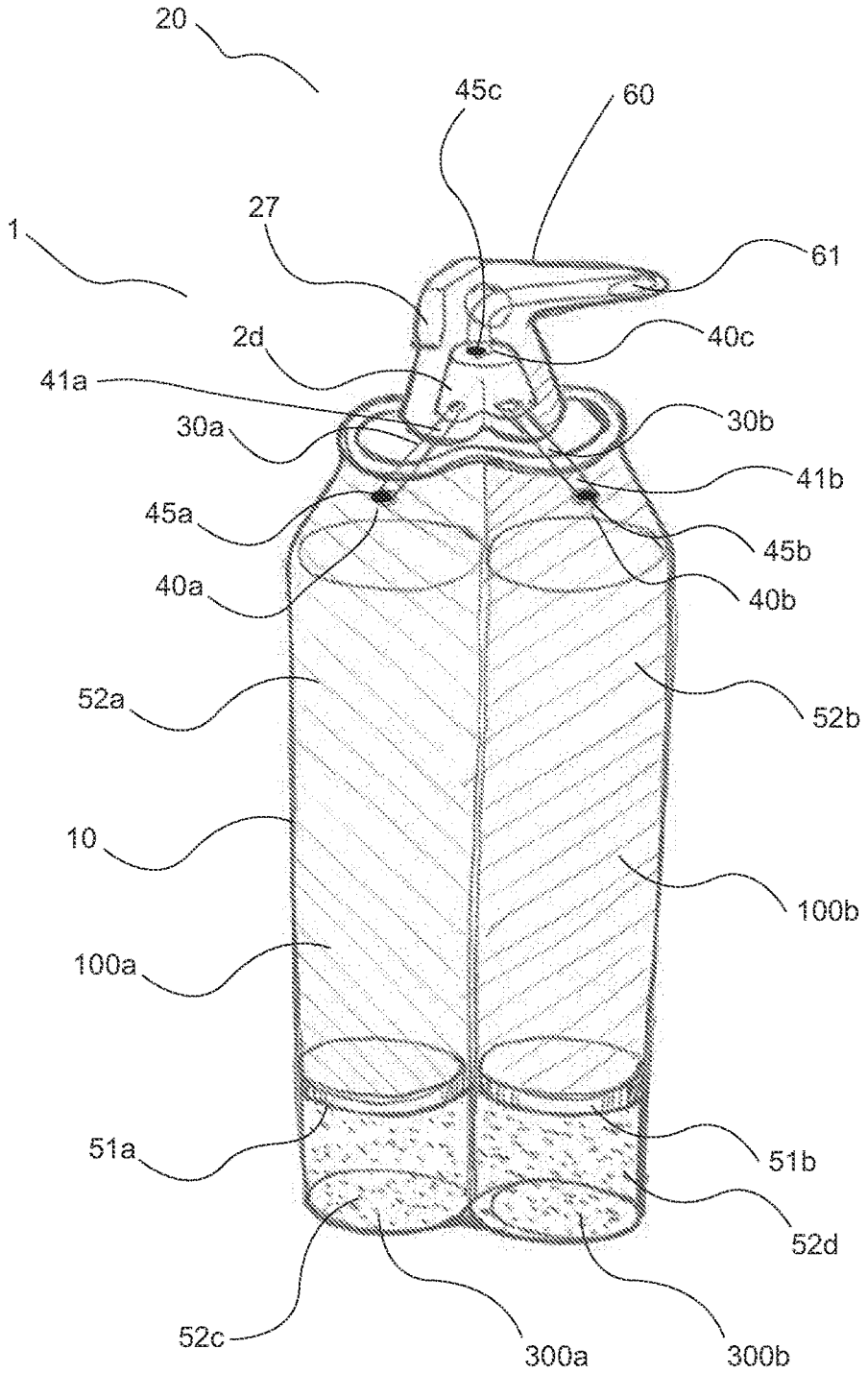
FIG. 5B is a schematic representation of a further embodiment of FIG. 5A in accordance with the present disclosure.
Figure 5C:
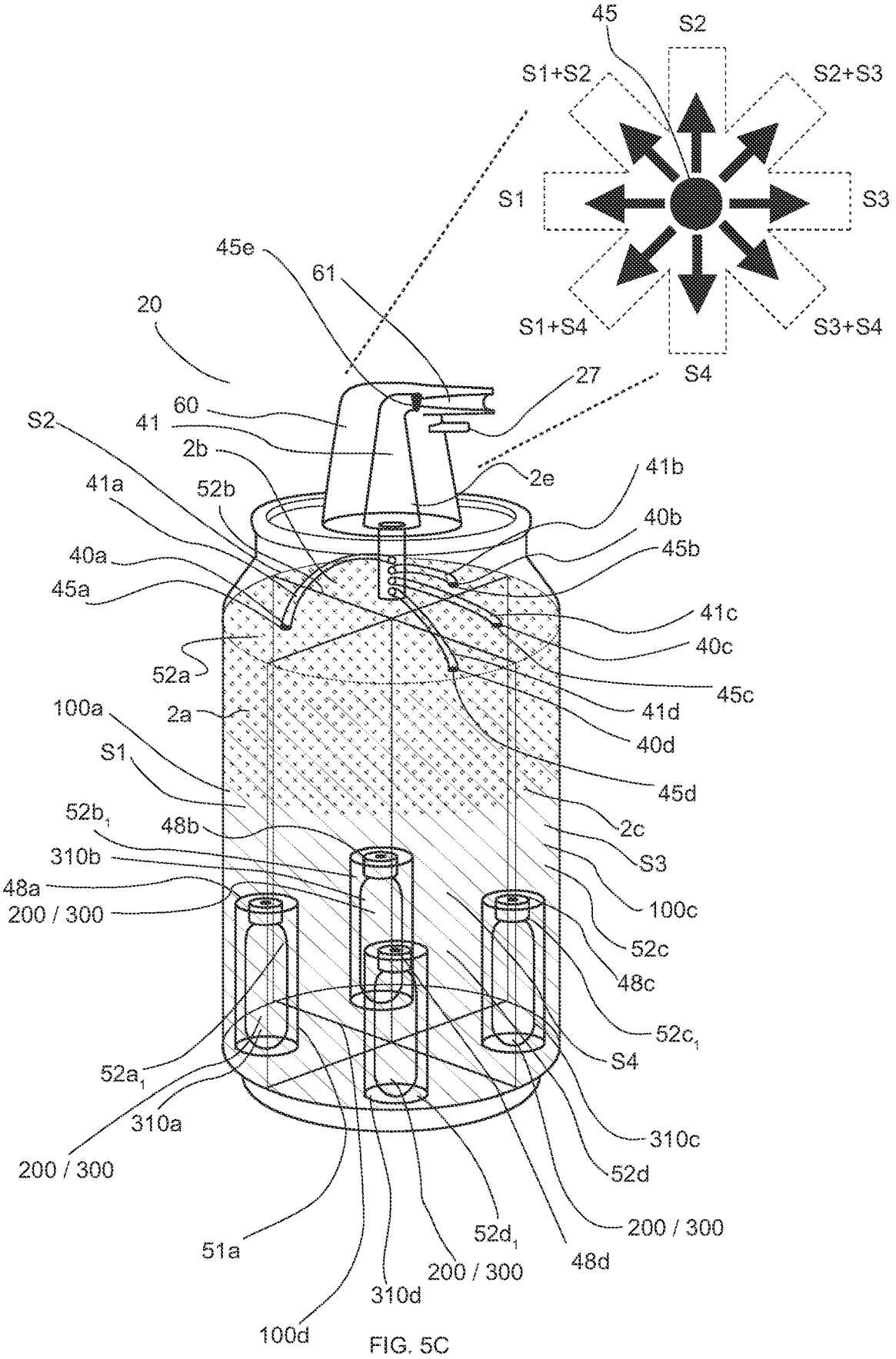
FIG. 5C is a schematic representation of a further embodiment of FIG. 5A in accordance with the present disclosure.

For instance, in various embodiments, as seen in FIGS. 5A, 5B, and 5C, a container 1 of the disclosure is provided wherein the container may have a cavity 50. The cavity 50 may be configured as or otherwise include or be associated with a plurality of chambers, 52*a* and 52*b*, such as one or more sub-chambers each adapted for containing a flowable and/or foamable material, such as a food and/or drink item and/or food supplement, condiment, or topping therefore. For example, a container 1 of the disclosure may be configured to retain and dispense a combination of materials that are commonly or uncommonly paired together. For example, one chamber, e.g., 52*a*, may include, a drinkable liquid, such as milk or soy milk or almond milk or formula, a first juice component, a first soda, an alcohol, or the like, and the other chamber, e.g., 52*b*, may include a mixer, such as a flowable chocolate, a second juice component, a second soda, another alcohol or tonic or soda water or water, or other mixer, e.g., fruit juice, and the like.

Likewise, in various instances, one or more of the chambers may include flowable food supplements, or condiments, such as ketchup, mustard, mayonnaise, relish or a vegetable item, such as an onion, pepper, a dressing or spread, such as ranch or blue cheese or thousand islands, or honey mustard, or Italian dressing, an oil, a vinegar, butter, a vegetable spread, a pate, and the like, such as for delivery in combination and/or sequentially to a food or drink item. In other instances, the one or more chambers may include one or more flowable food items, such as a peanut or almond or other nut based spread, e.g., nutella, jelly or jam, a fruit, and the like. In various instances, the contained materials may be those not commonly thought of as miscible, e.g., oil and water, an acetone (e.g., wine) and oxygen, and/or may be retained and delivered in such a manner so as to prevent contamination or rancidity, such as is caused when oil is mixed with air. In some instances, the contained material may be a flowable material, such as a medicine, a medicament, and the like.

Accordingly, to effectuate such sequential and/or conjunctive delivery, the container 1 may include a cavity 50 having two or more separate reservoirs 52*a* and 52*b* therein, such as where one reservoir, e.g., 52*a*, contains one flowable material 100*a* that is meant to be mixed with the contents of a second reservoir, e.g., 52*b*, containing a second material 100*b*, either prior to or post dispensing. In such an instance, the container 1 may include a propelling mechanism 300, which propelling mechanism 300 may be configured for facilitating the delivery of the flowable and/or mixable materials 100*a* and/or 100*b* from the reservoirs 52*a* and 52*b*, through respective translating elements 30*a* and 30*b*, and out through nozzle 60. For instance, the container 1 may include a dispensing mechanism 20 having a conduit 61 connecting the translation elements 30*a* and 30*b* to an outlet of the nozzle 60, and may further include one or more controllable release valves 40*a*, 40*b*, and 40*c* which release valves may be controlled, via a suitably configured control element 45*a*, 45*b*, and 45*c*, with respect to the configurations, surface areas, and/or diameters of their opening and closing.

Such a control element, for example, may have any suitable configuration so long it is adapted for opening and/or closing one or more of the controllable release valves 40*a*, 40*b*, and/or 40*c*, such as conjunctively or sequentially, and/or for selectively choosing between them. For instance, the valve 40 may have a toggling mechanism that can allow the contents of both cavities 52*a* and 52*b* and/or any other included cavities to flow freely into mixing chamber 2*d*, or may rotate, expand, or otherwise move to impinge within a feeder element 30 or passageway 41 or 61 so as to limit or otherwise control the flow out of one or more of the cavities, such that more or less of the contents of one cavity is allowed to flow more rapidly or fully through the passageways, while the contents of the other is limited and/or prevented therefrom.

A configuration such as this may be adapted to work regardless of the contents within each cavity 52, such as where one cavity includes a gas, the other a liquid, both contain gases, both contain liquids, or one or both of the chambers contain a solid. Further, because of the dynamics of the system, the container 1 can be configured to allow the contents to mix, whether typically miscible or not, such as within the mixing chamber 2*d*, even when the two components are not readily miscible, such a oil and vinegar, etc. Hence, in a manner such as this, the valve mechanism 45 is capable of controlling and/or determining the mixing dynamics as well as the proportion and/or ratio of mixing between the various contents of the cavities 52, such as prior to release. In various instances, the valve 40 and/or control element 45 may itself be controlled, such as by an actuator 27, which actuator 27 may further be configured for controlling the propelling mechanism(s) 300, with respect to its effectuating the propelling of the materials 100*a* and 100*b* through the translation elements 30*a* and 30*b* and out of the nozzle 60, such as through one or more passageways 41 and/or 61.

Particularly, in some embodiments, such as illustrated in FIG. 5A, the container 1 may include a cavity 50 that may include a sub-compartment 52, which sub-compartment may be divided into two parts 52*a* and 52*b*. For instance, the container 1 may or may not include a rigid, inelastic, and/or other bounding member 10 that resists expansion against a force, pressure, or heat. In such an instance, the rigid bounding member, where included, may bound a cavity 50 that may include a plurality of flexible sub-compartments 52*a* and 52*b*, bounded by flexible and/or expanding members 51*a* and 51*b*, that are configured as reservoirs for retaining flowable materials 100*a* and 100*b*, respectively. The cavity 50 may further include a propellant 300, such as where the propellant 300 surrounds the reservoirs 52*a* and 52*b*.

In such a manner as this, one or more of the first and second reservoirs 52*a* and 52*b* may be composed of an elastic, flexible, expandable, or otherwise volumetrically adaptable bladder that is configured to fill and/or stretch and/or expand such as in response to receiving the insertion of the flowable materials, e.g., there into. This expansion, along with the propellant 300 (if included) within the cavity 50 creates a positive pressure within the lumen of the cavity 50 and against the bladders 51*a* and 51*b*. It is to be noted that although there are only two chambers containing two or more food items for mixing and/or delivery, there may be 3, 4, 5, 6, 7, or more chambers that may be included, each of which may be individually or collectively operated with respect to its delivery of its retained contents by a consumer operable control mechanism 27, as described herein, so as to vary the amounts, proportions, and/or timing of the delivery of the various contents.

Hence, the elastic and/or expansive action of the reservoir materials (which may act like a mechanical propellant) and/or the propellant 300 may exert a constant pressure against the flowable materials 100*a* and/or 100*b* such that when the control mechanism 27 is actuated and one or more of control valves 40*a* and/or 40*b* are opened the flowable materials 100*a* and/or 100*b* are pushed out of their respective reservoirs 52*a* and 52*b*, into the passageways 41*a* and 41*b*, respectively, and out of passageway 61 of the nozzle 60, such as for delivery to a food item or directly to the mouth of a user. In this instance, the delivery mechanism 20 includes a mixing chamber 2*d* that is coupled to the translation elements 30*a* and 30*b*, and is configured for receiving the flowable materials 100*a* and 100*b* for mixing prior to exiting through the passageway 61. However, in other instances, passageway 41 may include two sub-parts 41*a* and 41*b* that would keep the flowable materials 100*a* and 100*b* from mixing prior to delivery and/or may include a toggle mechanism to allow a user to select which of the various food or drink items is delivered at which times. Additionally, the container 1 may include an inlet 48 such as for insertion of the propellant 300 into the cavity 50.

Further, in some embodiments, such as illustrated in FIG. 5B, the container 1 may include a body 10 that may be divided into two parts 50*a* and 50*b*, wherein each part may be further divided into two or more sub-compartments or reservoirs, e.g., 52*a* and 52*c* as well as 52*b* and 52*d*, respectively, such as by movable dividers 51*a* and 51*b*. In such a manner as this, the first cavity portion 50*a* may include two or more sub-compartments, e.g., 52*a* and 52*c*, which may form a first part or portion of cavity 50, such as where the first sub-compartment 52*a* acts like a delivery reservoir and includes the flowable material 100*a*, and the second sub-compartment 52*c* acts like a propellant reservoir and includes the propellant 300*a*. Likewise, the second cavity portion 50*b* may include two or more sub-compartments, e.g., 52*b* and 52*d*, that may form a second part or portion of cavity 50, such as where the third sub-compartment 52*b* acts like a delivery reservoir and includes the flowable material 100*b*, and the fourth sub-compartment 52*d* acts like a propellant reservoir and includes the propellant 300*b*.

In such an instance, the propellants 300*a* and 300*b* may be configured to exert a constant pressure against the dividers 51*a* and 51*b* such that when the control mechanism 27 is actuated and one or more of control valves 45*a* and/or 45*b* are opened the flowable materials 100*a* and 100*b* are pushed out of their respective reservoirs 52*a* and 52*b*, into the passageways 41*a* and 41*b*, and out of passageway 61 of the nozzle 60, such as for delivery to a food or drink item or directly to the mouth of a user. In various instances, the delivery mechanism 20 may include a mixing chamber 2*d*, such as for the combining of the various substances within the nozzle 60, such as where the chamber 2*d* is coupled to the translation elements 30*a* and 30*b*, and may be configured for receiving the flowable materials 100*a* and 100*b* prior to exiting through the passageway(s) 41*a* and/or 41*b*, such as for allowing the materials 100*a* and 100*b* to intermix and/or foam prior to delivery through the nozzle 60. In certain instances, such intermixing may be controlled with respect to modulating the various characteristics of the resultant combined material so as to control the flow of that material through the nozzle such as in relation to its flow rate, amount of flowable material, and/or in other respects that may be configured to control the flow, such as with respect to its thixotropic and/or viscous properties.

For instance, as can be seen with respect to FIG. 5C, an embodiment of the container 1 is provided. In this instance, a container 1 is provided, wherein the container includes a chamber portion 50 which chamber portion includes a plurality of interior cavities 52*a*, 52*b*, 52*c*, and 52*d*, such as for containing one or more foamable and/or flowable materials to be delivered, such as directly to the mouth of a user. For these purposes, the container 1 includes a nozzle 60 having a passageway 61, which passageway 61 connects to a corresponding passageway 41, which passageway 41 connects to the cavities 52*a*, 52*b*, 52*c*, and 52*d*, such as through conduits 41*a*, 41*b*, 41*c*, and 41*d*, so as to allow the consumable materials 100*a*, 100*b*, 100*c*, and/or 100*d* to flow, be foamed, and/or intermixed, and delivered to a user of the container 1 through their respective passageways.

In such an instance, each cavity 52 may be connected to the outlet 41 such as through passageways 41*a*, 41*b*, 41*c*, and 41*d*, which outlets 41 may be coupled to a mixing chamber 2*d* as set forth herein so as to connect the interior of the cavities 52 with the mixing chamber 2*d* and/or the passageway 61 of the nozzle 60. The flow through passageways 41 may each be controlled by a mechanism 45 configured for closing and/or opening of valves 45*a*, 45*b*, 45*c*, and/or 45*d*, so as to thereby control flow of the flowable and/or foamable material out of the container 1. Such flow may be controlled individually, such as by controlling the opening and its extent of each individual valve 45 separately, or the flow may be controlled collectively by opening and/or closing the valves 45*a, b, c*, and/or *d* in concert, so as to allow for the mixing and its extent of the materials 100*a, b, c*, and/or *d*, within the various respective container portions. In such an instance, the passageways 41*a, b, c*, and/or *d* may each lead to a mixing chamber 2*e*, within which chamber the deliverable materials 100 may be intermixed such as prior to delivery through the passageway 61 out of the nozzle 60, which delivery may be through the opening and/or closing of valve 45*e*. In a particular instance, as indicated in the cutaway view of the valve 45 of container 1, a control mechanism may control the flow of the materials 100*a, b, c*, and/or *d* into and through passageway 41, which control mechanism may be one or more rotating elements, fly wheels, pivotal elements, flaps, closures, diaphragms, permeable membranes, or other valve members, e.g., individual valves 45*a*, 45*b*, 45*c*, and 45*d*, capable of opening and/or closing so as to open and/or close the apertures within the chamber 50 thereby controlling the flow there through.

Accordingly, the container 1 may include a valve control mechanism 45 that may include one or more, e.g., a plurality of actuators and/or motors, for controlling the opening, closing, and/or extent of the same, so as to control one or more characteristics of the flow through the valves 40. Hence, valves 40*a*, 40*b*, 40*c*, and/or 40*d*, may include respective actuators 45*a*, 45*b*, 45*c*, and/or 45*d*, that can be operated individually or collectively, or in any combination, so as to control the flow from one or more cavities 52*a*, 52*b*,

52*c*, and/or 52*d* through one or more passageways 41*a*, 41*b*, 41*c*, and/or 41*d* into mixing chamber 2*e* and/or out of passageway 41, such as through valve 45*e*, and thereby may precisely control the extent and characteristics, e.g., the proportion of mixing between the various different contained materials.

For example, in various instances, the valves 40 may include a control mechanism 45, such as a tilt modulator, which modulator may be an extended element adapted for rotating and/or tilting and thereby configured for opening, partially opening, partially closing, and closing one or more of the valve elements 45*a*, 45*b*, 45*c*, and/or 45*d*, such as via the orientation, e.g., tilting, of the modulator 45, such as the angle between an axis passing longitudinally through the center of the modulator at rest and one or more axes passing normal thereto and aligned with the valves 40 and or cavities 52, such that as the modulator is tilted and/or rotated one or more of the valves 40*a, b, c*, and/or *d* may be opened and/or closed, e.g., individually or in concert, thereby opening access to the respective cavities 52. In some instances, the various valves 40 and passageways, e.g., 41, may be controlled with respect to their opening and/or closing by a switch selectable control element. Hence, as can be seen with respect to the cutaway view of the valve control mechanism 45 of the container 1, dependent upon the orientation of the controller 45, flow out of individual chambers S1, S2, S3, and/or S4 may be effectuated, or mixing of the flowable materials may be effectuated, such as where the materials in the various chambers are allowed to intermix, such that S1 and S2 can intermix, S2 and S3 can intermix, S3 and S4 can intermix, and/or S4 and S1 can intermix, or other such combinations, dependent upon the configuration of the container and the respective valves 40 and controllers 45. Further, by depressing the toggle 45 downwards towards the distal portion 16 of the container 1, all valve elements 45*a, b, c*, and *d* may be opened, thereby allowing all of the flowable materials 100*a, b, c*, and *d* to intermix, such as within chamber 2*e*, such as prior to delivery out of the nozzle 60 and to the mouth of a user.

In various instances, one of more of the cavities 52*a*, 52*b*, 52*c*, and/or 52*d*, may have a sub-chamber, such as 52*a*1, 52*b*1, 52*c*1, and/or 52*d*1, which sub-chambers may be configured for retaining a foaming 200 and/or propelling 300 agent therein, such as for foaming of the respective materials 100 within the respective chambers, and/or for the propelling of those materials 100 out of their respective chambers 52. In certain instances, the foaming 200 and/or propelling agent 300 may be retained within a canister 310, e.g., 310*a*, 310*b*, 310*c*, and/or 310*d*, which may be communicably connected to respective chambers 52*a*, 52*b*, 52*c*, and/or 52*d*, such as by respective conduits 48*a*, 48*b*, 48*c*, and/or 48*d*, such as through the control of various control mechanisms and/or valve elements 49*a*, 49*b*, 49*c*, 49*d*, such that the materials 100 within the respective chambers may be foamed and/or flowed prior to delivery to a user.

Accordingly, in view of the above, in particular instances, a system is provided wherein a flowable and/or foamable food and/or beverage material may be stored in one physical state within a canister and may therein undergo a physical change, such as prior to or upon delivery, e.g., direct delivery, to a user whereby due to the physical change the flowable and/or foamable material may be converted at least partially to another physical state, such as from a non-foamed to at least a partially foamed state. For instance, in various instances, the foamable material may be a beverage, in a liquid form, and upon the addition or intermixing of the foamable material, which in various instances may be a gas, the liquid is changed, e.g., converted, from a liquid to at least a partial colloid, such as to form a foamable material. Particularly, the foamable material may be such that it is capable of forming a matrix with one or more components of the foaming agent and/or propellant so as to form a colloid such as upon the foaming agent and/or propellant being introduced with and/or mixed with the foamable material, such as within the container.

For example, the flowable and deliverable material and the foaming agent and/or propellant may be such that the two materials are at least partially soluble one within the other, such as where the foaming agent and/or propellant may at least be partially dissolvable within the foamable material so as to be captured within a matrix thereof, or vice-versa, and in various instances together may form a foamable colloid therewith. Particularly, the flowable material and propellant and/or foaming agent may be selected so as to be able to bond, e.g., chemically, with one another, such that as the more volatile component enters and/or leaves solution, bubbles may form within the matrix, which dependent on the configuration of the components and control mechanisms can result in the formation of bubbles of a predetermined size, such as small, medium, large, and extra large. The number of bubbles within the solution may also be controlled via one or more of the control mechanisms of the container, such as via activation of the consumer operable control mechanism. Such control may be for the purpose of enhancing the taste to the user, for changing the flow characteristics, e.g., flow rate, viscosity and/or thixotropic effects, of the deliverable substance, and/or for facilitating absorption such as within the biological system of the user.

For instance, the insides of the container can be contoured, such as with respect to increase and/or decrease shear, thereby affecting the flow of the material proximate the bounding member of the container, so as to increase or decrease flow of various parts of the material. For example, shear may be increased so that the rate of flow of the center of the fluid material is increased relative to the flow of the material proximate the bounds of the container, or shear may be decreased so as to produce a more even flow. Thickening and/or thinning agents and/or other additives and/or flavoring agents may also be employed in a manner such as this, such as by changing the viscosity and/or of the material. In particular, a gel may be used to make the composition more viscous.

Additionally, other chemical and/or mechanical elements may be included within or as part of the container such as for affecting flowability, for example, thicker, semi-solid, and/or gel like substances that would not readily be flowable may be made to flow such as by decreasing or increasing internal viscosity, decreasing its thixotropic properties, and/or increasing internal agitation of the material, e.g., mechanically, such as by increasing vibration, shaking, stirring, or pressure; or chemically, such as by increasing temperature, increasing or decreasing the retention of air within the material, or by other mechanisms configured for increasing stress within the chemical composition to be delivered, such as by decreasing and/or increasing the surface area or volume of the substance and/or the container or its component parts, such as decreasing the radius of passageways along their length and/or including shearing elements therein. As indicated, heating may be applied to cause agitation and increase flowability, and/or cooling may be applied to decrease flowability to the desired amount, such as where once flow starts, it may proceed too rapidly and thus need to be slowed down subsequent to flow being initiated. Further, additives, such as powders, ingestible beads, or other volumizers may be included so as to decrease friction and/or adhesion and increase flow. Particularly, increased shearing may be employed so as to thin the material and/or decrease its viscosity, and increase flow. Such increasing of shearing may be at a constant, increasing, or decreasing rate over time, which will decrease or increase viscosity over that time period, respectively. Thus, the increase and/or decrease in flow may be configured so as to be time dependent, such as based on the needs and/or desires of the user. Furthermore, one or more stressors can be implemented to increase yield and/or to initiate flow.

The bubbles within the suspension or liquid may also be controlled with respect to their duration before popping or persistence, which may be for a short time, medium length of time, or longer time, such as from fractions of a second to many seconds and/or many minutes, dependent on the desire of the user. More particularly, in some instances, due to a pressure and/or temperature differential the more volatile gas may leave solution rapidly, so as to form a multitude of smaller bubbles, and in other instances, the volatile gas may leave solution more slowly so as to form a lesser number of bigger bubbles. For instance, when heated, the solution becomes more turbulent wherein the more volatile component may leave the solution faster due to an increase in temperature within the container and/or the composition, and likewise as the solution cools, flowability may decrease.

In some instances, the bubbles don't set within the solution, but rather pop or otherwise dissolve resulting in defoaming. Hence, based on the configuration of the container and/or the materials employed therein, the bubbles may persist from a mere fraction of seconds to seconds, minutes, several minutes, an hour, hours, etc. Consequently, in some instances, the foam is not static, but rather changes as the matrix collapses, causing the bubbles to burst, which bursting may be configured so as to occur within the mouth of the user, such as subsequent to delivery, which sensation may be experienced as pleasurable. In particular instances, an agent configured to ensure the persistence and/or size of the bubbles within the matrix may be added. Additionally, in some embodiments, the agent does not generate a foam, but rather helps maintain the structure of the foam within the container, such as by increasing the persistence and/or the extension of time within the matrix and/or the colloid.

Hence, the foaminess of the substance to be controlled in any sufficient manner, such as due to the amount of foaming agent, e.g., gas, to be introduced into the substance, such as by controlling the valves controlling the release and/or flow of the foaming agent and/or propellant introduced into the deliverable substance, or controlling the amount coming out of a flow passageway, so as to control the amount and/or rate of intermixing, or by controlling the size, shape, and/or contours of a passageway, such as to control the flow characteristics. For instance, foaminess may be controlled due to the configuration of the bladder, piston, and/or other pressurizing and/or temperature controlling mechanism and may be such that the container and/or its functioning is able to control the foaminess of the composition, such as with respect to the size or volume of bubbles, uniformity of bubbles, number of bubbles, length or duration of bubbles retained within the solution, and the like. In various instances, intermixing may not be controlled but flow out of the container may be controlled. It is to be noted that the flowable material may be a liquid, such as a beverage and/or other food item made to flow. In various instances, the deliverable material may be a flowable material, such as a medicine, a medicament, and the like.

In certain instances, such as for the purpose of controlling one or more flow characteristics of the materials within the container, the material to be delivered may include a thickener and/or a stabilizer, emulsifier, a gelling agent, a surfactant, a food or flavor enhancer, and/or other additive may be added to the substance to be delivered. For instance, a thickener, such as those based on polysaccharides (e.g., starches, carbohydrates, vegetable gums, and/or pectins, e.g., grapefruit pectin, and the like), sugars (e.g., simple sugars, complex sugars, oligosaccharides, agar, carrageenan, and/or galactose), and/or various proteins, such as including collagen, egg whites, other amino acids, furcellaran, and gelatin. The thickening agent may also be a flavoring agent or may include flavorless, powdered starch, such as a fecula, such as one or more of arrowroot, cornstarch, katakuri-starch, potato-starch, sago, tapioca and/or their starch derivatives. Vegetable gums may also be used as a thickener, and may include alginin, guar gum, locust bean gum, glucomannan polysaccharide gum, and/or xanthan gum. One or more pre- or probiotics and/or esters may be provided.

Preservatives, scents, perfumes, essences, sweeteners, gelatin, soy lecithin, sodium phosphate, sodium stearoyl lactylate, polysorbate 80, carbo carboxymethyl cellulose, polyglycerol esters, sorbitan esters, polyglycol esters, monoglycerides, acetylated monoglycerides, lactolated monoglycerides, anti-freeze components, and the like. Other coloring agents, flavoring agents, and/or vitamins or other food supplements may be included, such as Vitamins A, B, C, D, E, and/or K and the like. In some instances, a stabilizer, such as a matrix stabilizer configured for inhibiting separation of a suspension, emulsion, and/or a foam may be included. Other volumizing agents may also be used. In particular instances, an effervescent or other material capable of generating a gas, such as within the container may be employed. For example, an acid and/or base pair may be employed or an alcohol, such as to produce a gas and a salt within the deliverable substance.

Accordingly, a container, as herein described, having at least a first cavity or reservoir and an exit passageway and/or valve associated therewith, may be provided. In various instances, a portion of the cavity may retain a flowable and/or a foamable material, such as a liquid, e.g., a beverage; and in some instances, the cavity may include a second portion that may retain a foaming agent, such as a gas, e.g., a liquid soluble gas or a mixture of gasses. In certain instances, the container may include two separate reservoirs, such as one for storing the flowable and/or foamable material, and one for storing the foaming agent. In particular instances, the container may include three or more separate reservoirs, such as one for storing the flowable and/or foamable material, one for storing the foaming agent, and/or one for storing the propelling agent.

At some point prior to dispensing, such as where the flowable and/or foamable material is a liquid beverage, the material may be intermixed with a liquid soluble gas in a manner sufficient to form a foam that may then be delivered directly to the mouth of a user for consumption, such as for drinking. Hence, in various instances, the container may be a beverage container that contains a liquid beverage as well as a foaming agent, such as a gas or mixture of gases, such that prior to or upon opening of the container, e.g., actuation of the valve, such as via a control valve, a solution of the liquid and gas, e.g., in a foamed state, is released or otherwise dispensed, such as directly to the mouth of the consumer, such as via a nozzle coupled to the container, in a manner that allows for the direct drinking of the beverage by the user.

For instance, in a particular embodiment, the container along with the foamable material, e.g., liquid beverage, in combination with the foaming agent and/or a propelling agent, e.g., in gaseous form, forms a pressure gradient, such as between the two or more contents within the container and/or the ambient pressure outside of the container. In such an instance, as the valve is actuated the passageway connecting the outside environment with the reservoir is opened and the foamable liquid and the gaseous foaming agent and/or propellant exit the container, e.g., through the passageway, valve, and/or nozzle. In a manner such as this, the positive or negative pressure gradient may cause the gas to go into solution and/or gas already in solution to leave the solution, which entering and/or exiting of the gas into and/or out of solution causes bubbling, which bubbling is at such an amount and rate so as to cause the liquid beverage to foam, e.g., by gas bubbles being created and/or captured within a matrix of the liquid so as to form a matrix and/or colloid. The beverage once foamed may be delivered to the user, such as via the nozzle, for direct consumption, e.g., ingestion, by the user, such as for drinking or otherwise imbibing the foamed solution.

In other instances, the canister may include a flowable material that may or may not be foamable, which material may be a gaseous, liquid, powdered, and/or semi-solid imbibable drink, food, food additive, supplement, and/or other additive that is capable of being propelled out of the reservoir of the container such as via the action of a propelling agent, which propelling agent may be a chemical agent and/or mechanical mechanism. For instance, where the propellant is a chemical agent, it may be such that it exerts a force, such as a positive pressure on an intermediary agent, such as a moveable platform, that when the valve is actuated and the passageway opened the platform moves towards the opening due to the positive pressure of the chemical propellant on the platform, causing the flowable material to be expulsed from the reservoir of the container. Likewise, where the propelling agent is a mechanical mechanism, such as an expandable bladder, the potential energy created by the expansion of the bladder, such as is due to the flowable material being inserted there into, acts like a positive force that causes the expulsion of the material contained within the bladder, such as when the actuating mechanism is actuated and the valve and adjoining passageway is opened.

Hence, as detailed herein, a container for containing a beverage or food or food additive product may be provided where the container includes one or more of a top portion, a bottom portion and a sidewall portion, such as a sidewall between the top and the bottom portions. The sidewall may be configured of one piece and may be circular, or may have one or more corners and be triangular, square, or other such shape. The container may include a first cavity, such as within or otherwise defined by the top, bottom, and sidewall portions, where the first cavity is sized or otherwise configured to hold an ingestible beverage or food item, which in various instances, may be a foamable liquid, such as in a pre-, mid-, or post-foamed state.

As described above, the container of the system may include a valve. The valve may be any device that is capable of opening and closing and may be coupled to and/or otherwise associated with an outlet portion of the container, and/or passageway associated therewith. In various instances, the valve may be operably connected to a translation mechanism, such as a feeder tube, and/or a mixing chamber and/or a passageway, such as a passageway passing through and opening out of a nozzle. The valve may be designed to regulate, control, and/or direct the flow of the flowable material, e.g., in fluid or fluidized form, through one or more elements of the system and/or out of the container.

For instance, the valve may be any valve element, such as a mechanical and/or electronic element, that is configured for regulating the passage of the flowable material through one or more of the chambers and/or passageways disclosed herein. Hence, in various instances, a valve may be an element that functions for the purpose of regulating the opening, closing, and/or size of a passageway through which the flowable material and/or propellant translates or otherwise passes. For example, a suitable valve may be adapted for opening, closing, and/or partially opening and/or closing in a manner that allows or prevents admittance of a flow, such as of the flowable material, from one part of the vessel or passageway into another part and/or out from within the vessel. In some instances, the valve may be adapted for changing one or more characteristics of the flow of the material, e.g., fluid, through the system, such as by partially obstructing or dilating the diameter of the passageway and/or by allowing various fluid components of the system to intermix, which in turn affects the flow dynamics through the system and/or its components. More particularly, when a valve is opened, the flowable material is allowed to flow from contained portions of higher pressure or temperature within the system to portions of lower pressure temperature such as within or out from the system.

A typical valve may have a proximal portion and a distal portion, such as where the proximal portion of the valve extends outward from the top of the container, and the distal portion of the valve extends inwards toward one or more cavities of the container. In such an instance, the valve may be a control valve that is controllable by a consumer, such as to regulate a flow of the ingestible material from the distal portion and out through the proximal portion of the valve. For instance, the valve may be a demand valve that includes an orifice of variable dimensions that extends there through, which orifice provides for communication from the exterior to the interior of the container.

In certain instances, the orifice may be configured such that there resides therein a higher-pressure chamber and a lower and/or intermediate pressure chamber (which may be at, above, or below atmospheric pressure), which chambers may be separated by a diaphragm. In certain instances, the diaphragm may be operably connected to a piston, which piston, in turn, may be operably connected to a biased element, e.g., a biased spring element, such as a spring that is biased in the compressed, closed direction (in some instances, the spring may be biased in an expanded, open direction). In such an instance, when there is an increased pressure differential, such as a drop or a rise in pressure, between the higher and lower pressure chambers, such as when a user of the container inhales, such as through a proximal portion of an accompanying nozzle or valve associated therewith, the pressure in the lower and/or intermediate chamber drops, causing the biased spring to transition from a biased to a non-biased position, or vice versa, such as from a compressed to an expanded condition (in some instances, from an expanded to a compressed condition), thus displacing the piston and/or the diaphragm causing the orifice to open and the flowable material, contained under pressure within the container, to be expulsed therefrom and delivered to the mouth of the user, such as for drinking. In some instances, the piston may be adjustable, such as via a spring or ratcheting mechanism. Further, in some instances, the valve may be a pin or a needle valve, and in other instances the valve may be a butterfly valve, a ball valve, a duplex ball valve, a gate valve, a choke valve, a diaphragm valve, a pinch valve, a piston valve, a poppet valve, a thermal expansion valve, a plug valve, and the like or a combination of the same.

As indicated, in various instances, the valve may be coupled with a nozzle, such as a nozzle having a distal portion configured for being coupled with the proximal portion of the container and/or associated valve, and a proximal portion configured for delivering the ingestible material directly to the user, e.g., to the mouth of the user, such as for direct ingestion, by the user, and/or application to an additional food product. Hence, the nozzle may be composed of one or more pieces or parts, such as a part that regulates the flow of the material through and out of the nozzle, and a part that engages in direct delivery to the consumer or additional food product. For instance, one part of the nozzle may include a flow and/or pressure regulator, and another part of the nozzle may include a user interface portion, such as a duckbill portion. For example, a nozzle for use in accordance with the devices disclosed herein may be any device that is capable of being coupled to and/or otherwise associated with a portion of the container and/or valve and/or a portion of an associated feeding mechanism, such as a delivery portion thereof, such as for delivering a flowable material to a user. In certain instances, the nozzle may further be designed to affect one or more characteristics of flow, such as the flow of the flowable material, e.g., in fluid form, out of the container, passageway, valve, and/or feeding mechanism. Accordingly, in certain instances, the nozzle may be operably coupled to one or both of a valve and/or a feeding mechanism, such as a translating element, e.g., a feeder tube.

As indicated, a typical nozzle and/or a passageway there through may have any shape or size, and in various embodiments, may be configured to include a simple or complex orifice or passageway that is adapted for controlling the direction, speed, mass, pressure, flow, shape, and/or characteristics of the flowable material out of the canister, such as through the valve. In various instances, the nozzle may be configured to distribute a flowable material, e.g., a liquid or gas or suspension or semi-solid, etc., over an increased area, such as to break up the fluid into droplets so as to increase the surface area of the flowable material, and/or create a decreased impact force. In other instances, the nozzle may be configured to distribute the flowable material over a decreased area, such as to congregate the fluid into a stream or other flow so as to decrease the surface area of the flowable material, and/or create an increased impact force. In such instances, the nozzle may have one or more outlets, and can be a plain orifice, shaped orifice, surface impingement, pressure swirl, solid cone, or the like, such as where the fluid being dispensed is a single fluid.

Accordingly, in certain instances, the nozzle may be a single or multiple fluid nozzle, such as where two or more fluids may be mixed internally or externally, or where the nozzle is a twin fluid nozzle, such as where the nozzle allows a gas, such as a foaming agent and/or propellant, to mix with the flowable and/or foamable material, such prior to or upon ejection from the nozzle. In certain instances, this contacting can cause shearing and therefore vaporization of the fluid, such as where a higher velocity fluid contacts a lower velocity fluid moving through the system; and in other instances, the contacting can cause foaming, such as where the two materials are traversing at slow or slower speeds and/or when there is a pressure change, e.g., a pressure increase or decrease, such as prior to ejection from the nozzle. In particular instances, the nozzle can be configured such that as the valve is opened, pressure is equalized throughout the flowable material thereby allowing a contained foaming agent to leave out of solution thereby causing the flowable material to foam. Hence, in certain instances, the nozzle may be configured so as to increase one or more of the kinetic energy, pressure, and/or the internal energy of the flowable material. The nozzle may be convergent (narrowing down from a wide diameter to a smaller diameter, e.g., in the direction of the flow), so as to accelerate flow speed or rate; divergent (expanding from a smaller diameter to a larger one, e.g., in the direction of the flow), so as to decelerate flow; or a mix of the two having a convergent section and a divergent section, e.g., sequentially, one right after the other. In various embodiments, the nozzle may be choked.

In certain instances, the nozzle may be a simple spray nozzle (to disperse the flowable material such as into a spray), or may be a propelling nozzle, such as a jet, e.g., a fluid or laminar jet nozzle, and in some instances, the nozzle may be a magnetic nozzle. In various instances, the nozzle may include an atomizer and/or an aspirator portion, and thus, may be an atomizing and/or aspirating, e.g., an air aspirating, nozzle. For instance, in certain embodiments, the nozzle may have a cone shape and/or may be a siphon nozzle and/or may be configured for injecting air, another gas, liquid, or solid, etc. into the stream of flowable material as it exits the nozzle, which in some instances, may be employed so as to cause the flowable material to foam or defoam.

In some instances, such as where the flowable and/or foamable material includes a solute or solid component, the nozzle may be configured such that the propellant and/or flowing and/or foaming agent moves from a higher, e.g., atomizing, pressure zone to a lower pressure zone upon mixing causing a vacuum as the flowable material exits the nozzle, which vacuum then pulls additional material through the passageway. In such instances, the nozzle may be configured to control the shape of the fluid, e.g., the stream, spray, or flow, as it exits the nozzle, and in one instance, may be a swirl nozzle, such as where the nozzle is configured for directing the flow tangentially through the nozzle causing it to vortex as it exits the nozzle, such as in a cone shape. In other instances, the flow may have a dispersed, condensed, foamed, rounded, or flat pattern, such as where the cross-section discharge is used to reshape one or more components of the flow of the flowable material. In some instances, the nozzle may be a rotary nozzle having a rotating outlet so as to form a hollow cone spray of the flowable material as it is released out of the container, such as where the rotational speed determines the size of the foam, spray, and/or droplets therein. In various instances, the nozzle and/or valve may be formed as a nebulizer.

In various embodiments, the container, one or more of the flowable and/or foamable material, the foaming agent, the propellant, the feeder element, valve, and/or nozzle may be configured so as to control the characteristics of the flow and/or foam being ejected from the container. For instance, one or more of these components may be configured to modulate the liquid properties, temperature, specific gravity, viscosity, surface tension, and the like of the flowable material and, thereby, modulate the flow characteristics of the foamable and/or flowable material as it exits the container.

In various embodiments, the container may include a translating mechanism, for instance, a feeding member, e.g., a feeder tube, having a proximal end that is coupled with the distal portion of the valve, or other outlet of the container, and a distal end that is in communication within an interior portion of the container, or a material therein. For instance, the feeding mechanism may be in communication with one or more lumens within the container, such as where the lumen includes one or more of a flowable and/or foaming material, and/or a foaming agent, and/or a propellant. In such an instance, such a lumen may be a reservoir. In various instances, the feeding mechanism is configured for translating one or more of the flowable material, foaming agent, and/or propellant from within one portion of the cavity and/or container to a second portion of the container or other component of the system, such as an additional lumen, passageway, valve, and/or nozzle.

Hence, in one embodiment, the translating element may be configured so as to be positioned in a first cavity, wherein the translating element includes one portion associated with a bounding member of the container, such as to facilitate release of the contained material(s), and further includes a second portion positioned within a cavity or lumen of the container, such as proximate the bottom of the container or lumen. Accordingly, the feeder element may include an elongated body having a proximal interface and a distal interface, such as where the proximal interface is configured for communicating with the proximal or top portion of the container, such as via the distal portion of the passageway and/or valve; and where the distal interface is configured for communicating with an ingestible food item or beverage or medicine, e.g., foamable material, within the cavity, e.g., within a first and/or second lumen within the cavity.

In various embodiments, the feeder and/or translating element may be configured or otherwise adapted for transferring the flowable material, e.g., ingestible beverage, from the lumen of the first cavity to the valve of the container, such as for delivery of the ingestible material to the user or food supplement, for example prior to or post foaming of the beverage. In such an instance, the translating element may have any shape and/or size and/or configuration so long as it is capable of receiving a flowable material therein and translating it from one portion within the container to a second portion within or outside of the container, such as to a release valve and/or delivery nozzle. For instance, the translating element may have an extended, tubular body that may be straight or curved or bent (or bendable) or tortuous, such as from end to end. The diameter of the lumen of the translating element may be of any suitable dimension and may be selected so as to achieve the desired flowing and/or foaming characteristics.

As indicated above, the container may include one or both of a foaming agent and/or propelling mechanism that may be connected with one or more of the first cavity or a secondary and/or third cavity, such as a secondary or tertiary cavity within a valve, or a dispensing valve, of the container. In various instances, the foaming and/or propelling mechanism may be adapted to or otherwise configured for converting the ingestible beverage from a non-foamed state to a foamed state, and may be further configured for flowing, e.g., upon consumer control of a controllable dispensing mechanism, the ingestible food or beverage, e.g., in the foamed state, through the feeding mechanism to the controllable dispensing valve and out the proximal portion of the container and/or valve, e.g., out through the nozzle, if included. In certain embodiments, the foaming and propelling mechanism includes a foaming agent, e.g., the foaming and propelling mechanism may be the same as the foaming agent, and in other embodiments, they are distinct elements that may act in concert to foam and/or propel the beverage such as within and/or out of the container.

Accordingly, in various embodiments, the container may include a first cavity containing, e.g., containing the foamable material, and may include a second cavity that may be operationally or otherwise connected with the first cavity, such as by a secondary valve, e.g., a controllable feeding valve, or by a feeder element. In such an instance, the first cavity may be configured for retaining and storing the foamable beverage, and the second cavity may be configured for retaining and/or storing the foaming and/or propelling mechanism, e.g., which may be a foaming agent, such as until the consumer activates one or both of the dispensing and/or feeder control valves. In such instances, a feeder valve may be included and configured so as to control the operation of the feeding mechanism, e.g., the feeding of the foaming agent into contact with the foamable material, such as within the first or second or even a third cavity. For instance, in certain embodiments, a third cavity, e.g., a mixing cavity, may also be present such as where the third cavity is operationally or otherwise coupled with one or both of the first and/or second cavities, such as where the first and/or second cavities feed directly into the third cavity, e.g., via a tertiary control valve, such as a tertiary mixing valve; or the first and/or second cavities may feed into the third cavity, such as for the purpose of mixing the foamable material with the foaming agent, by the operation of the feeder element.

As indicated above, in various instances, such a third cavity may be part of, e.g., within the bounds of the container, and/or may be a part of a control, e.g., a dispensing valve, and/or part of a dispensing nozzle. It is to be understood that any of the valves and/or nozzles disclosed herein may be configured for regulating the flow, mixing, and/or foaminess of the flowable and/or mixable materials disclosed herein, such as with respect to controlling or otherwise regulating the rate, amount, quality, and/or other characteristics of the flow, mixing, and/or foaminess of the flowable and/or mixable materials. For instance, in various embodiments, the foaminess of the material to be delivered may be controlled by the amount of propellant, e.g., gas, being introduced into the delivery chamber. Such valves may be positioned anywhere within the bounds of the container or a component thereof such as between the boundaries of the various compartments or within one or more of the translating elements and/or nozzles.

In view of the different configurations of the container and/or the cavities therein, the translating member, e.g., feeder element, may be configured so as to act as a conduit directing the flow of the various flowable materials held within one or more components of the system. For instance, the translating member or feeder tube may be composed of one or more elements that are configurable for or otherwise adapted for directing a flow of one or more of the flowable materials, e.g., the one or more foamable materials and/or one or more foaming agents and/or propellants, that are held or otherwise stored within the one or more cavities of the container. One or more control valves may be included as part of the feeder element so as to further control and direct the flow of the flowable materials through the feeder element. Hence, the translating element may include a portion that contacts the flowable and/or foamable material and/or may include a portion that contacts the flowable foaming agent and/or propellant, and may include another portion that contacts a top portion of the container, such as via a dispensing valve and/or dispensing nozzle, so as to facilitate the flow and/or mixing of the flowable materials within and/or out of the container.

In various embodiments, the translating member translates the one or more flowable materials through its componentry via the action of a propellant, actuation of one or more of the control valves detailed herein, and/or the creation of a vacuum, such as that created by a user sucking or blowing into one or more of a user contactable portion of a dispensing nozzle, dispensing valve, and/or proximal portion of the feeder element directly. Accordingly, a translating member of the disclosure may have any suitable configuration that may be useful in translating the flowable materials through the system such as for one or both of mixing and/or direct dispensing to the user, e.g., directly to the mouth of the user for ingestion, such as for imbibing or ingesting, or to a supplementary food item. In various instances, the translating member is configured for functioning regardless of the orientation of the canister, such as regardless of how the device is manipulated and/or used by the consumer in ingesting, e.g., drinking, the foamable material stored therein. Hence, the translating member may be composed of one or more feeder tube(s), as disclosed herein, which may be configured to assist in directing the flow of the mixable elements, assisting in mixing the elements, and for delivering the mixture to a user, such as in a flowable, foamed state, e.g. via a control valve, such as a siphon valve, or nozzle.

Hence, in various embodiments, the container may include a liquid or a mixture of liquids, e.g., in a drinkable and/or foamable beverage form, and/or may include a liquid soluble gas or a mixture of gasses that may be configured as one or both of a foaming and/or a propelling agent, wherein upon contact of the liquid with the soluble gas a solution may be formed, such as a foamable solution, that may be delivered to a user, such as for drinking or otherwise ingestion, e.g. directly from the container, such as through a suitably formed delivery nozzle. As indicated, the liquid and/or liquid soluble gas may be retained within the container in the same or different compartments, can be intermixed in the same or different compartments, and/or can be translated throughout the system and/or to a user, such as through one or more suitably formed translating elements, e.g., feeder tubes, and/or one or more control valves associated therewith.

In some embodiments, the container includes a first compartment for retaining both the food or beverage item and the gas, such as where the food item and/or beverage is a liquid or semi liquid or slurry and the gas are separated from one another in the canister, such as via a pressure gradient between the two, e.g., under increased pressure; and in some embodiments, the container includes a first compartment for retaining the food or beverage item and a second compartment for retaining the gas, such as where the flowable material and the gas are separated from one another in the container by a dividing wall but may be configured for communicating with one another, such as for the purpose of intermixing, such as via one or more valves, e.g., a feeding, mixing, and/or dispensing valve, and/or one or more translating elements, and/or one or more nozzle elements.

In such an instance, the food or beverage item may be an ingestible item, and the gas may be at least a partially liquid soluble gas and the feeder element(s) and/or release valve(s) may be configured for intermixing the ingestible material and the soluble gas, such as to produce a foamed material, such as on release, e.g., actuation of a release mechanism of the container. As indicated, in various embodiments, the referenced second compartment may be configured for receiving an interchangeable gas reservoir, such as a cartridge containing a foaming member therein, e.g., a gas cartridge, which cartridge may be inserted into the container for discharging, and may be replaceable once the cartridge has been discharged, such as through activation of a release mechanism of the container or a component associated with the container.

In a further aspect, methods for producing and/or delivering a flowable and/or foamable material is provided, such as where the foamable material is comprised of a fluid, such as a liquid or semi-fluid beverage or food item or medicine, that may be consumed, for instance, in drinkable, swallowable, and/or eatable form, or where the foamable material is at least partially prefoamed but subjected to conditions that function to increase or decrease the foaminess of the material, such as prior to delivery from a storage and/or delivery canister. The methods may include one or more steps, such as a step that includes actuating a delivery mechanism of the canister, which actuation functions to eject the flowable, foamable, and/or foamed material out of the canister. For example, the actuation of the delivery mechanism may involve the actuation of one or more of a nozzle, a valve, and/or a translation element associated with a canister configured for retaining the flowable and/or foamable material, such as where the actuation may involve activating a control element, such as by depressing or pulling a button, turning a nozzle or screw or knob, pulling a trigger, squeezing a depressible element, flipping a switch, and the like. In some instances, one or more of the components contained within the container may be under pressure, and such actuation may function to mix the contained components and/or release one or more of the contained components, such as after they have been mixed together, such as to produce at least a partially foamed material.

In particular, the recited actuation may involve one or more of actuating the release of one flowable component into another flowable component contained within the container, such as by the opening of one or more valves; and/or the translating of one or more of the components such that they come into contact with one another, such as within one or more chambers within the container, valves, and/or nozzles associated therewith, such as prior to or in conjunction with actuation of the delivery mechanism and/or release from the container. In some instances, the actuation may involve an electronic control mechanism, for instance involving a control circuit that may be in a wired or wireless configuration, such as part of a processor on a microchip, such that by electronic activation of the control circuit the delivery mechanism may be activated and the components of the container may be mixed and/or released, such as for delivery of the foamable material to a user.

In view of the above, in various embodiments, the container may include a bounding member, which bounding member bounds a cavity suitable for retaining a flowable and/or foamable material, and the method includes the insertion of the flowable and/or foamable material into the cavity of the container, such as by a first fill valve. For instance, the bounding member may include a proximal portion and a distal portion, which proximal and distal portions are separated by an extended portion, such as where together the proximal, extended, and distal portions are configured so as to bound the cavity, and wherein in certain embodiments, the bounding member includes at least the first fill valve. The cavity may be configured to both retain the flowable material that may be configured to promote the foaming and/or propelling of the material from the container, such as through activation of a control mechanism of the container. Accordingly, the container may include one or more valves, such as a release or delivery valve and/or an injection or fill valve, such as where the flowable material may be added in to the container through the injection or fill valve, and released from the container through the release or delivery valve. In certain embodiments, the container 1 may include a safety mechanism so as to prevent unintentional activation of the container and/or its components, so as to prevent unwanted mixing and/or delivery of the contained material(s), such as while in packaging and/or in transit. For instance, the container may include a tamper evident seal, locking ring, and/or the like.

Further, in various instances, the container may include a foaming and/or propelling mechanism, which in some embodiments may be a plurality of different elements, and in other instances may be the same element. For example, in certain instances, the foaming agent and/or propellant may be a chemical agent. Accordingly, in such an instance, the method may include inserting the foaming and/or propelling agent into the container through one or more auxiliary fill or injection valves, e.g., through the first or a secondary fill valve. It is to be noted that in some instances, the foamable material and foaming and/or propelling agent may be inserted into and retained within the same compartment of the container, such as where the two components are phase separated within the same chamber of the container.

In some instances, the foaming agent and/or propellant may be an electrical element or electro-mechanical element and the method may involve activating the element, such as by generating an electrical signal and/or impulse, such as by actuating a remote control mechanism, which electronic signal and/or impulse is received by the electric or mechanical element, which upon receipt activates the foaming and/or propelling mechanism that functions to foam and/or build pressure within the container, which increase in pressure may then be employed to expel the flowable material from the container, such as through the release valve. In various instances, the electrical element includes a power source, such as a battery.

In various embodiments, the foaming and/or propelling mechanism(s) may be a mechanical element, such as a biasing and/or spring element, and the method may include releasing stored energy so as to foam and/or translating the foamed material out of the container. For instance, in certain embodiments, the container may include an elastic member, such as a bladder, which bladder may be a stretchable or expandable member and may be self healing, such that when the flowable material is inserted in through the container, as described above, and/or into the bladder, the bladder expands to accommodate the flowable material, however, to do so the bladder expands creating a reserve of potential energy. Such a bladder may be made of any suitable material that is capable of receiving a material therein and reversibly expanding in response thereto, such as by being deformed from a first, non-expanded condition to a second, expanded condition and thereby storing potential energy therein. Such a material, for instance, may be an elastic material.

The bladder may be connected to the release valve, and the method may include activating the release valve such that as the valve is opened, the potential energy stored via the expansion of the bladder is released thereby expelling the flowable material. In such an instance, the foamable material may be inserted into the container in a foamed state or a prefoamed state, and the activating of the release valve may simply act to release the foamed material, or may further act to convert the prefoamed material into a foamed material. For instance, in such instances, the release valve and/or container may be associated with a nozzle element, which nozzle element may be adapted to control the flow of the material out through the container and/or may be configured to foam the material as it is delivered through the release valve and/or nozzle to the user. In certain instances, the release valve and/or nozzle may be associated with a translation element that is itself in communication with a reservoir, such as a reservoir containing a foaming and/or propelling agent that upon opening of the release valve and/or activation of the nozzle, the foaming and/or propelling agent is translated through the translation element to the valve and/or nozzle and thereby allowed to mix with the flowable material so as to foam and/or propel the flowable material as it exits the container.

In a particular embodiment, the container may include a computing device, such as a computing device that is configured to control the operation of one or more components of the container, as disclosed herein. In such an instance, the container may include one or more sensing elements coupled to the computing device, and the method may include generating sensor data, such as data that may be sensed and/or gathered from an environment that is internal or external to the computing device, and may further include receiving such data, such as by at least one sensor or other associated electronic data input device coupled with the computing device. The data received may represent one or more attributes related to the foamable and/or flowable material, the foaming agent, the propellant, the foamed material, an internal environment condition and/or an external environmental condition (such as temperature, pressure, a characteristic of the user, etc.). In certain instances, the computing device, e.g., micro processor, may further include one or more of: at least one wireless receiver and/or transmitter, for communicating with a wireless network and/or wireless control device. In various instances, the container may include an interactive display, e.g., an interactive, touch screen display, electronically coupled to the internal processor.

The method, therefore, may further include one or more of receiving of sensed data, e.g., by the internal or external controller, the data representing one or more internal or external characteristics; and/or processing, e.g., by the internal processor of the computing device, such as in accordance with a desired foaminess and/or flow rate of the foamed material. In some particular embodiments, the method may also include generating user interface, such as a graphical user interface, for display on the interactive display of the computing device such that the user may select an option as an option related to the flow rate or amount of foaminess of the material to be ingested by the user.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

The invention claimed is:

1. An apparatus for serving an ingestible, foamable substance, the apparatus comprising:

a container having a first and a second cavity, the first cavity being of a size to hold an ingestible substance, the first and second cavity being divided by a movable portion, the movable portion being translatable within the first and second cavities in a manner to modulate the size of the first cavity with respect to the second cavity;

a delivery nozzle comprising a distal portion configured for being coupled to a proximal portion of the container and a proximal portion extending away from the proximal portion of the container, the delivery nozzle further comprising a pathway extending from an inlet portion of the distal portion of the delivery nozzle to an exit aperture of the proximal portion of the delivery nozzle, the pathway forming a conduit between the first cavity and the delivery nozzle and being configured for delivering the ingestible substance from the first cavity and out through the exit aperture;

a valve mechanism coupled with one or more of the container and the delivery nozzle, and having a feeding mechanism associated with the first cavity of the container to access the ingestible substance therein, the valve mechanism having a valve configured to regulate a flow of the ingestible substance from the first cavity through the pathway formed by the delivery nozzle to the exit aperture, wherein the valve mechanism is an electronic valve mechanism;

a user-operable flow controller electronically coupled with the electronic valve mechanism to control the valve to vary the flow between no flow and a maximal flow proportional to a degree of a physical force applied by a consumer to a consumer-operable flow controller; and a propelling mechanism comprising a gas contained within the second cavity to generate a pneumatic pressure against the movable portion sufficient to enlargen an area within the second cavity and simultaneously decrease an area within the first cavity so as to propel the ingestible substance from the first cavity, through the feeding mechanism and out of the exit aperture of the distal portion of the delivery nozzle, for the foaming and delivery of the ingestible substance when the valve is activated by a force being applied to the user-operable flow controller.

2. The apparatus in accordance with claim 1, wherein the movable portion separating the first cavity from the second cavity includes a deformable bladder.

3. The apparatus in accordance with claim 1, wherein the feeding mechanism includes an inlet aperture and an outlet aperture, the inlet aperture being positioned to contact the ingestible substance within the cavity and the outlet aperture is configured for coupling the feeding mechanism to one or more of the valve mechanism and the pathway of the delivery nozzle, such that while the ingestible substance is delivered, the inlet aperture of the feeding mechanism is proximate a portion of the container that is closest toward the center of the earth, and an angle between a vector from the inlet aperture of the feeding mechanism to the exit aperture of the delivery nozzle and a vector from the inlet aperture of the feeding mechanism to the center of the earth is greater than 90 degrees.

4. The apparatus in accordance with claim 1, wherein the user-operable flow controller is configured for controlling a cross-sectional area of an aperture of the pathway in a manner to create a shear force capable of foaming the ingestible substance.

5. An apparatus for foaming and serving an ingestible substance, the apparatus comprising:

a container having a first cavity to hold the ingestible substance, and a second cavity comprising a propelling mechanism, the first cavity by a movable portion;

a delivery nozzle forming a pathway from the container, the delivery nozzle comprising a distal portion extending from the container, and a proximal portion having an exit aperture from the pathway that is adapted to deliver the ingestible substance;

a valve mechanism coupled with the delivery nozzle, and having a feeding mechanism associated with the first cavity of the container to access the ingestible substance therein, the valve mechanism having a valve configured to regulate a flow of the ingestible substance from the first cavity through the pathway formed by the delivery nozzle, wherein the valve mechanism is an electronic valve mechanism; and a user-operable flow controller electronically coupled with the valve to control the electronic valve mechanism to vary the flow between no flow and a maximal flow proportional to a degree of a physical force applied by a consumer to a consumer-operable flow controller;

the propelling mechanism comprising a gas and being coupled with the first cavity via movement of the movable portion to generate a pressure against the ingestible substance within the first cavity sufficient to both foam and propel the ingestible substance from the first cavity, through the feeding mechanism, and out of the distal portion of the delivery nozzle for foamed delivery of the ingestible substance when the valve is actuated by the consumer-operable flow controller and the gas intermixes with the ingestible substance.

6. The apparatus in accordance with claim 5, wherein the movable portion of the first cavity includes a deformable bladder and activation of the user-operable flow controller causes the deformable bladder to decrease in an area the deformable bladder occupies within the first cavity thereby expelling the ingestible substance out of the container via the pathway of the delivery nozzle.

7. The apparatus in accordance with claim 5, wherein the user-operable flow controller is configured for controlling a cross-sectional area of an aperture of the pathway in a manner to create a shear force capable of foaming the ingestible substance.

8. A product for foaming and delivering a foamed ingestible substance from a container directly to a mouth of a consumer, the product comprising:

a container having a first cavity to hold an ingestible substance in a non-foamed state;

a delivery nozzle forming a pathway through the delivery nozzle and being coincident with the first cavity of the container, the delivery nozzle comprising a distal portion extending from the container, and a proximal portion that is sized and adapted to be received in the mouth of the consumer, the proximal portion having an exit aperture from the pathway that is adapted to deliver the foamed and ingestible substance from the first cavity of the container directly to the mouth of the consumer;

a valve to control a passage of the ingestible substance through the pathway of the delivery nozzle, the valve having a proximal portion coupled with the delivery nozzle, and a distal portion associated with the first cavity of the container, the valve being operable to move from a closed position to an open position;

a consumer-operable flow controller connected with the valve to control movement of the valve from the closed position to the open position so as to regulate a flow of the ingestible substance from the first cavity and through the pathway of the delivery nozzle and out the exit aperture when the consumer-operable flow controller is activated; and a second cavity coupled to the first cavity by a moveable portion and comprising a gaseous propellant, the first cavity being separated from the second cavity by the moveable portion, the gaseous propellant being configured for intermixing with and propelling the ingestible substance out of the first cavity, into an inlet aperture, and out of the exit aperture of the distal portion of the delivery nozzle for delivery of the ingestible substance directly to the mouth of the consumer when the consumer-operable flow controller is activated, the gaseous propellant further being configured for foaming the ingestible substance prior to the ingestible substance's egress through the exit aperture.

9. The product in accordance with claim 8, wherein the first cavity is coupled to the second cavity via a conduit, the conduit having the moveable portion for controlling the flow of the gaseous propellant from the second cavity into the first cavity via the conduit, the moveable portion being configured for moving the valve from the closed position to the open position based on the activation of the consumer-operable flow controller.

10. The product in accordance with claim 8, wherein the consumer-operable flow controller is configured for controlling a cross-sectional area of an aperture of the pathway in a manner to create a shear force capable of further foaming the ingestible substance during its passage through the pathway.

11. The product in accordance with claim 8, wherein the valve and the moveable portion comprise an electronic valve mechanism, and the consumer-operable flow controller is electronically coupled with the one or more electronic valve mechanisms to control respective valves to vary the flow between no flow and a maximal flow proportional to a degree of a force applied by the consumer to the consumer-operable flow controller.

* * * * *